US012286874B2

(12) United States Patent
Yeung et al.

(10) Patent No.: US 12,286,874 B2
(45) **Date of Patent: *Apr. 29, 2025**

(54) SYSTEMS AND METHODS TO OPERATE HYDRAULIC FRACTURING UNITS USING AUTOMATIC FLOW RATE AND/OR PRESSURE CONTROL

(71) Applicant: BJ Energy Solutions, LLC, The Woodlands, TX (US)

(72) Inventors: Tony Yeung, The Woodlands, TX (US); Ricardo Rodriguez-Ramon, The Woodlands, TX (US); Joseph Foster, The Woodlands, TX (US)

(73) Assignee: BJ Energy Solutions, LLC, The Woodlands, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/442,960

(22) Filed: Feb. 15, 2024

(65) Prior Publication Data

US 2024/0368972 A1 Nov. 7, 2024

Related U.S. Application Data

(63) Continuation of application No. 17/248,485, filed on Jan. 27, 2021, now Pat. No. 11,939,853, which is a (Continued)

(51) Int. Cl.
*E21B 43/26* (2006.01)
*F04B 23/04* (2006.01)
*F04B 49/10* (2006.01)

(52) U.S. Cl.
CPC ..... *E21B 43/2607* (2020.05); *F04B 23/04* (2013.01)

(58) Field of Classification Search
None
See application file for complete search history.

(56) References Cited

U.S. PATENT DOCUMENTS 1,716,049 A 6/1929 Greve
1,726,633 A 9/1929 Smith
(Continued)

FOREIGN PATENT DOCUMENTS

AU 9609498 A 7/1999
AU 737970 B2 9/2001
(Continued)

OTHER PUBLICATIONS

"Turbine Frac Units," WMD Squared (2012), https://wmdsquared.com/work/gfes-turbine-frac-units/.
(Continued)

*Primary Examiner* — Matthew R Buck
*Assistant Examiner* — Douglas S Wood
(74) *Attorney, Agent, or Firm* — Norton Rose Fulbright US LLP

(57) ABSTRACT

Systems and methods for operating hydraulic fracturing units to pump fracturing fluid into a wellhead may include receiving a target flow rate and/or a target pressure for fracturing fluid supplied to the wellhead. The systems and methods may increase a flow rate from the hydraulic fracturing units according to a controlled increasing flow rate schedule toward the target flow rate and/or target pressure. When it has been determined the target flow rate and/or target pressure has been achieved, the systems and methods also may include operating the hydraulic fracturing units to maintain the target flow rate and/or target pressure. When the target flow rate has not been achieved, the systems and methods also may include generating notification signals, and/or when the target pressure has not been achieved, the (Continued)

systems and methods further may include operating the hydraulic fracturing units to maintain a maximum flow rate.

20 Claims, 8 Drawing Sheets

Related U.S. Application Data continuation-in-part of application No. 17/248,484, filed on Jan. 27, 2021, now Pat. No. 11,933,153.

(60) Provisional application No. 62/705,649, filed on Jul. 9, 2020, provisional application No. 62/705,369, filed on Jun. 24, 2020, provisional application No. 62/705,328, filed on Jun. 22, 2020.

(56) References Cited

U.S. PATENT DOCUMENTS 2,178,662 A 11/1939 Hanson
2,427,638 A 9/1947 Vilter et al.
2,498,229 A 2/1950 Adler
2,535,703 A 12/1950 Smith et al.
2,572,711 A 10/1951 Fischer
2,820,341 A 1/1958 Amann
2,868,004 A 1/1959 Runde
2,940,377 A 6/1960 Darnell et al.
2,947,141 A 8/1960 Russ
2,956,738 A 10/1960 Af et al.
3,068,796 A 12/1962 Pfluger et al.
3,191,517 A 6/1965 Solzman
3,257,031 A 6/1966 Dietz
3,274,768 A 9/1966 Klein
3,378,074 A 4/1968 Kiel
3,382,671 A 5/1968 Ehni, III
3,401,873 A 9/1968 Privon et al.
3,463,612 A 8/1969 Whitsel, Jr.
3,496,880 A 2/1970 Wolff
3,550,696 A 12/1970 Kenneday
3,560,053 A 2/1971 Ortloff
3,586,459 A 6/1971 Zerlauth
3,632,222 A 1/1972 Cronstedt
3,656,582 A 4/1972 Alcock
3,667,868 A 6/1972 Brunner
3,692,434 A 9/1972 Schnear
3,739,872 A 6/1973 McNair
3,757,581 A 9/1973 Mankin et al.
3,759,063 A 9/1973 Bendall
3,765,173 A 10/1973 Harris
3,771,916 A 11/1973 Flanigan et al.
3,773,438 A 11/1973 Hall et al.
3,781,135 A 12/1973 Nickell
3,786,835 A 1/1974 Finger
3,791,682 A 2/1974 Mitchell
3,796,045 A 3/1974 Foster-Pegg
3,814,549 A 6/1974 Cronstedt
3,820,922 A 6/1974 Sensinger et al.
3,847,511 A 11/1974 Cole
3,851,186 A 11/1974 Koo
3,866,108 A 2/1975 Yannone et al.
3,875,380 A 4/1975 Rankin
3,963,372 A 6/1976 McLain et al.
4,010,613 A 3/1977 McInerney
4,019,477 A 4/1977 Overton
4,031,407 A 6/1977 Reed
4,047,569 A 9/1977 Tagirov et al.
4,050,862 A 9/1977 Buse
4,059,045 A 11/1977 McClain
4,086,976 A 5/1978 Holm et al.
4,117,342 A 9/1978 Melley, Jr.
4,173,121 A 11/1979 Yu
4,204,808 A 5/1980 Reese et al.
4,209,079 A 6/1980 Marchal et al.
4,209,979 A 7/1980 Woodhouse et al.
4,222,229 A 9/1980 Uram
4,239,396 A 12/1980 Arribau et al.
4,269,569 A 5/1981 Hoover
4,311,395 A 1/1982 Douthitt et al.
4,330,237 A 5/1982 Battah
4,341,508 A 7/1982 Rambin, Jr.
4,357,027 A 11/1982 Zeitlow
4,383,478 A 5/1983 Jones
4,402,504 A 9/1983 Christian
4,430,047 A 2/1984 Ilg
4,442,665 A 4/1984 Fick et al.
4,457,325 A 7/1984 Green
4,470,771 A 9/1984 Hall et al.
4,483,684 A 11/1984 Black
4,505,650 A 3/1985 Hannett et al.
4,574,880 A 3/1986 Handke
4,584,654 A 4/1986 Crane
4,620,330 A 11/1986 Izzi, Sr.
4,672,813 A 6/1987 David
4,754,607 A 7/1988 Mackay
4,782,244 A 11/1988 Wakimoto
4,796,777 A 1/1989 Keller
4,869,209 A 9/1989 Young
4,913,625 A 4/1990 Gerlowski
4,983,259 A 1/1991 Duncan et al.
4,990,058 A 2/1991 Eslinger
5,032,065 A 7/1991 Yamamuro et al.
5,135,361 A 8/1992 Dion
5,167,493 A 12/1992 Kobari
5,245,970 A 9/1993 Iwaszkiewicz et al.
5,275,041 A 1/1994 Poulsen
5,281,023 A * 1/1994 Cedillo ..... B01F 35/82 366/20
5,291,842 A 3/1994 Sallstrom et al.
5,326,231 A 7/1994 Pandeya et al.
5,362,219 A 11/1994 Paul et al.
5,482,116 A 1/1996 El-Rabaa et al.
5,511,956 A 4/1996 Hasegawa et al.
5,517,854 A 5/1996 Plumb et al.
5,537,813 A 7/1996 Davis et al.
5,553,514 A 9/1996 Walkowc
5,560,195 A 10/1996 Anderson et al.
5,586,444 A 12/1996 Fung
5,622,245 A 4/1997 Reik et al.
5,626,103 A 5/1997 Haws et al.
5,634,777 A 6/1997 Albertin et al.
5,651,400 A 7/1997 Corts et al.
5,678,460 A 10/1997 Walkowc
5,717,172 A 2/1998 Griffin, Jr. et al.
5,720,598 A 2/1998 de Chizzelle
5,761,084 A 6/1998 Edwards
5,811,676 A 9/1998 Spalding et al.
5,839,888 A 11/1998 Harrison
5,846,062 A 12/1998 Yanagisawa et al.
5,875,744 A 3/1999 Vallejos
5,983,962 A 11/1999 Gerardot
5,992,944 A 11/1999 Hara
6,041,856 A 3/2000 Thrasher et al.
6,050,080 A 4/2000 Horner
6,067,962 A 5/2000 Bartley et al.
6,071,188 A 6/2000 O'Neill et al.
6,074,170 A 6/2000 Bert et al.
6,123,751 A 9/2000 Nelson et al.
6,129,335 A 10/2000 Yokogi
6,145,318 A 11/2000 Kaplan et al.
6,230,481 B1 5/2001 Jahr
6,279,309 B1 8/2001 Lawlor et al.
6,321,860 B1 11/2001 Reddoch
6,334,746 B1 1/2002 Nguyen et al.
6,367,548 B1 4/2002 Purvis et al.
6,401,472 B2 6/2002 Pollrich et al.
6,530,224 B1 3/2003 Conchieri
6,543,395 B2 4/2003 Green
6,644,844 B2 11/2003 Neal et al.
6,655,922 B1 12/2003 Flek
6,669,453 B1 12/2003 Breeden et al.
6,765,304 B2 7/2004 Baten et al.
6,786,051 B2 9/2004 Kristich et al.
6,832,900 B2 12/2004 Leu
6,851,514 B2 2/2005 Han et al.

(56) References Cited

U.S. PATENT DOCUMENTS 6,859,740 B2 2/2005 Stephenson et al.
6,901,735 B2 6/2005 Lohn
6,935,424 B2 8/2005 Lehman et al.
6,962,057 B2 11/2005 Kurokawa et al.
7,007,966 B2 3/2006 Campion
7,047,747 B2 5/2006 Tanaka
7,065,953 B1 6/2006 Kopko
7,143,016 B1 11/2006 Discenzo et al.
7,222,015 B2 5/2007 Davis et al.
7,281,519 B2 10/2007 Schroeder et al.
7,388,303 B2 6/2008 Seiver
7,404,294 B2 7/2008 Sundin
7,442,239 B2 10/2008 Armstrong et al.
7,516,793 B2 4/2009 Dykstra
7,524,173 B2 4/2009 Cummins
7,545,130 B2 6/2009 Latham
7,552,903 B2 6/2009 Dunn et al.
7,563,076 B2 7/2009 Brunet et al.
7,563,413 B2 7/2009 Naets et al.
7,574,325 B2 8/2009 Dykstra
7,581,379 B2 9/2009 Yoshida et al.
7,594,424 B2 9/2009 Fazekas
7,614,239 B2 11/2009 Herzog et al.
7,627,416 B2 12/2009 Batenburg et al.
7,677,316 B2 3/2010 Butler et al.
7,721,521 B2 5/2010 Kunkle et al.
7,730,711 B2 6/2010 Kunkle et al.
7,779,961 B2 8/2010 Matte
7,789,452 B2 9/2010 Dempsey et al.
7,836,949 B2 11/2010 Dykstra
7,841,394 B2 11/2010 McNeel et al.
7,845,413 B2 12/2010 Shampine et al.
7,861,679 B2 1/2011 Lemke et al.
7,886,702 B2 2/2011 Jerrell et al.
7,900,724 B2 3/2011 Promersberger et al.
7,921,914 B2 4/2011 Bruins et al.
7,938,151 B2 5/2011 Hockner
7,955,056 B2 6/2011 Pettersson
7,980,357 B2 7/2011 Edwards
8,056,635 B2 11/2011 Shampine et al.
8,083,504 B2 12/2011 Williams et al.
8,099,942 B2 1/2012 Alexander et al.
8,186,334 B2 5/2012 Ooyama
8,196,555 B2 6/2012 Ikeda et al.
8,202,354 B2 6/2012 Iijima
8,316,936 B2 11/2012 Roddy et al.
8,336,631 B2 12/2012 Shampine et al.
8,388,317 B2 3/2013 Sung
8,414,673 B2 4/2013 Raje et al.
8,469,826 B2 6/2013 Brosowske
8,500,215 B2 8/2013 Gastauer et al.
8,506,267 B2 8/2013 Gambier et al.
8,575,873 B2 11/2013 Peterson et al.
8,616,005 B1 12/2013 Cousino, Sr.
8,621,873 B2 1/2014 Robertson et al.
8,641,399 B2 2/2014 Mucibabic et al.
8,656,990 B2 2/2014 Kajaria et al.
8,672,606 B2 3/2014 Glynn et al.
8,707,853 B1 4/2014 Dille et al.
8,708,667 B2 4/2014 Collingborn
8,714,253 B2 5/2014 Sherwood et al.
8,757,918 B2 6/2014 Ramnarain et al.
8,763,583 B2 7/2014 Hofbauer et al.
8,770,329 B2 7/2014 Spitler
8,784,081 B1 7/2014 Blume
8,789,601 B2 7/2014 Broussard et al.
8,794,307 B2 8/2014 Coquilleau et al.
8,801,394 B2 8/2014 Anderson
8,851,186 B2 10/2014 Shampine et al.
8,851,441 B2 10/2014 Acuna et al.
8,886,502 B2 11/2014 Walters et al.
8,894,356 B2 11/2014 Lafontaine et al.
8,905,056 B2 12/2014 Kendrick
8,951,019 B2 2/2015 Hains et al.
8,973,560 B2 3/2015 Krug
8,997,904 B2 4/2015 Cryer et al.
9,011,111 B2 4/2015 Lesko
9,016,383 B2 4/2015 Shampine et al.
9,032,620 B2 5/2015 Frassinelli et al.
9,057,247 B2 6/2015 Kumar et al.
9,097,249 B2 8/2015 Petersen
9,103,193 B2 8/2015 Coli et al.
9,121,257 B2 9/2015 Coli et al.
9,140,110 B2 9/2015 Coli et al.
9,175,810 B2 11/2015 Hains et al.
9,187,982 B2 11/2015 Dehring et al.
9,206,667 B2 12/2015 Khvoshchev et al.
9,212,643 B2 12/2015 Deliyski
9,217,318 B2 12/2015 Dusterhoft et al.
9,222,346 B1 12/2015 Walls
9,297,250 B2 3/2016 Dusterhoft et al.
9,324,049 B2 4/2016 Thomeer et al.
9,341,055 B2 5/2016 Weightman et al.
9,346,662 B2 5/2016 Van Vliet et al.
9,366,114 B2 6/2016 Coli et al.
9,376,786 B2 6/2016 Numasawa
9,394,829 B2 7/2016 Cabeen et al.
9,395,049 B2 7/2016 Vicknair et al.
9,401,670 B2 7/2016 Minato
9,410,406 B2 8/2016 Yuan
9,410,410 B2 8/2016 Broussard et al.
9,410,546 B2 8/2016 Jaeger et al.
9,429,078 B1 8/2016 Crowe et al.
9,435,333 B2 9/2016 McCoy et al.
9,488,169 B2 11/2016 Cochran et al.
9,493,997 B2 11/2016 Liu et al.
9,512,783 B2 12/2016 Veilleux, Jr. et al.
9,534,473 B2 1/2017 Morris et al.
9,546,652 B2 1/2017 Yin
9,550,501 B2 1/2017 Ledbetter et al.
9,556,721 B2 1/2017 Jang et al.
9,562,420 B2 2/2017 Morris et al.
9,570,945 B2 2/2017 Fischer
9,579,980 B2 2/2017 Cryer et al.
9,587,649 B2 3/2017 Oehring
9,593,710 B2 3/2017 Laimboeck et al.
9,611,728 B2 4/2017 Oehring
9,617,808 B2 4/2017 Liu et al.
9,638,101 B1 5/2017 Crowe et al.
9,638,194 B2 5/2017 Wiegman et al.
9,650,871 B2 5/2017 Oehring et al.
9,656,762 B2 5/2017 Kamath et al.
9,689,316 B1 6/2017 Crom
9,695,808 B2 7/2017 Giessbach et al.
9,739,130 B2 8/2017 Young
9,764,266 B1 9/2017 Carter
9,777,748 B2 10/2017 Lu et al.
9,803,467 B2 10/2017 Tang et al.
9,803,793 B2 10/2017 Davi et al.
9,809,308 B2 11/2017 Aguilar et al.
9,829,002 B2 11/2017 Crom
9,840,897 B2 12/2017 Larson
9,840,901 B2 12/2017 Oehring et al.
9,845,730 B2 12/2017 Betti et al.
9,850,422 B2 12/2017 Lestz et al.
9,856,131 B1 1/2018 Moffitt, Jr.
9,863,279 B2 1/2018 Laing et al.
9,869,305 B1 1/2018 Crowe et al.
9,871,406 B1 1/2018 Churnock et al.
9,879,609 B1 1/2018 Crowe et al.
RE46,725 E 2/2018 Case et al.
9,893,500 B2 2/2018 Oehring et al.
9,893,660 B2 2/2018 Peterson et al.
9,897,003 B2 2/2018 Motakef et al.
9,920,615 B2 3/2018 Zhang et al.
9,945,365 B2 4/2018 Hernandez et al.
9,964,052 B2 5/2018 Millican et al.
9,970,278 B2 5/2018 Broussard et al.
9,981,840 B2 5/2018 Shock
9,995,102 B2 6/2018 Dille et al.
9,995,218 B2 6/2018 Oehring et al.
10,008,880 B2 6/2018 Vicknair et al.
10,008,912 B2 6/2018 Davey et al.
10,018,096 B2 7/2018 Wallimann et al.

(56) References Cited

U.S. PATENT DOCUMENTS 10,020,711 B2 7/2018 Oehring et al.
10,024,123 B2 7/2018 Steffenhagen et al.
10,029,289 B2 7/2018 Wendorski et al.
10,030,579 B2 7/2018 Austin et al.
10,036,238 B2 7/2018 Oehring
10,040,541 B2 8/2018 Wilson et al.
10,060,293 B2 8/2018 Del Bono
10,060,349 B2 8/2018 Álvarez et al.
10,077,933 B2 9/2018 Nelson et al.
10,082,137 B2 9/2018 Graham et al.
10,094,366 B2 10/2018 Marica
10,100,827 B2 10/2018 Devan et al.
10,107,084 B2 10/2018 Coli et al.
10,107,085 B2 10/2018 Coli et al.
10,114,061 B2 10/2018 Frampton et al.
10,119,381 B2 11/2018 Oehring et al.
10,125,750 B2 11/2018 Pfaff et al.
10,134,257 B2 11/2018 Zhang et al.
10,138,098 B2 11/2018 Sørensen et al.
10,151,244 B2 12/2018 Giancotti et al.
10,161,423 B2 12/2018 Rampen et al.
10,174,599 B2 1/2019 Shampine et al.
10,184,397 B2 1/2019 Austin et al.
10,196,258 B2 2/2019 Kalala et al.
10,221,856 B2 3/2019 Hernandez et al.
10,227,854 B2 3/2019 Glass
10,227,855 B2 3/2019 Coli et al.
10,246,984 B2 4/2019 Payne et al.
10,247,182 B2 4/2019 Zhang et al.
10,253,598 B2 4/2019 Crews et al.
10,254,732 B2 4/2019 Oehring et al.
10,267,439 B2 4/2019 Pryce et al.
10,280,724 B2 5/2019 Hinderliter
10,287,943 B1 5/2019 Schiltz
10,288,519 B2 5/2019 De La Cruz
10,303,190 B2 5/2019 Shock
10,305,350 B2 5/2019 Johnson et al.
10,316,832 B2 6/2019 Byrne
10,317,875 B2 6/2019 Pandurangan et al.
10,329,888 B2 6/2019 Urbancic et al.
10,337,402 B2 7/2019 Austin et al.
10,358,035 B2 7/2019 Cryer et al.
10,371,012 B2 8/2019 Davis et al.
10,374,485 B2 8/2019 Morris et al.
10,378,326 B2 8/2019 Morris et al.
10,393,108 B2 8/2019 Chong et al.
10,407,990 B2 9/2019 Oehring et al.
10,408,031 B2 9/2019 Oehring et al.
10,415,348 B2 9/2019 Zhang et al.
10,415,557 B1 9/2019 Crowe et al.
10,415,562 B2 * 9/2019 Kajita ..... F04B 49/06
10,422,207 B2 9/2019 Aidagulov et al.
RE47,695 E 11/2019 Case et al.
10,465,689 B2 11/2019 Crom
10,478,753 B1 11/2019 Elms et al.
10,526,882 B2 1/2020 Oehring et al.
10,563,649 B2 2/2020 Zhang et al.
10,570,704 B2 2/2020 Colvin et al.
10,577,908 B2 3/2020 Kisra et al.
10,577,910 B2 3/2020 Stephenson
10,584,645 B2 3/2020 Nakagawa et al.
10,590,867 B2 3/2020 Thomassin et al.
10,598,258 B2 3/2020 Oehring et al.
10,605,060 B2 3/2020 Chuprakov et al.
10,610,842 B2 4/2020 Chong
10,662,749 B1 5/2020 Hill et al.
10,677,961 B1 6/2020 Chen et al.
10,711,787 B1 7/2020 Darley
10,738,580 B1 8/2020 Fischer et al.
10,753,153 B1 8/2020 Fischer et al.
10,753,165 B1 8/2020 Fischer et al.
10,760,416 B2 9/2020 Weng et al.
10,760,556 B1 9/2020 Crom et al.
10,794,165 B2 10/2020 Fischer et al.
10,794,166 B2 10/2020 Reckels et al.
10,801,311 B1 10/2020 Cui et al.
10,815,764 B1 10/2020 Yeung et al.
10,815,978 B2 10/2020 Glass
10,830,032 B1 11/2020 Zhang et al.
10,830,225 B2 11/2020 Repaci
10,851,633 B2 12/2020 Harper
10,859,203 B1 12/2020 Cui et al.
10,864,487 B1 12/2020 Han et al.
10,865,624 B1 12/2020 Cui et al.
10,865,631 B1 12/2020 Zhang et al.
10,870,093 B1 12/2020 Zhong et al.
10,871,045 B2 12/2020 Fischer et al.
10,895,202 B1 1/2021 Yeung et al.
10,900,475 B2 1/2021 Weightman et al.
10,907,459 B1 2/2021 Yeung et al.
10,914,139 B2 2/2021 Shahri et al.
10,920,538 B2 2/2021 Rodriguez Herrera et al.
10,920,552 B2 2/2021 Rodriguez Herrera et al.
10,927,774 B2 2/2021 Cai et al.
10,927,802 B2 2/2021 Oehring et al.
10,954,770 B1 3/2021 Yeung et al.
10,954,855 B1 3/2021 Ji et al.
10,961,908 B1 3/2021 Yeung et al.
10,961,912 B1 3/2021 Yeung et al.
10,961,914 B1 3/2021 Yeung et al.
10,961,993 B1 3/2021 Ji et al.
10,961,995 B2 3/2021 Mayorca
10,982,523 B1 4/2021 Hill et al.
10,989,019 B2 4/2021 Cai et al.
10,995,564 B2 5/2021 Miller et al.
11,002,189 B2 5/2021 Yeung et al.
11,008,950 B2 5/2021 Ethier et al.
11,015,423 B1 5/2021 Yeung et al.
11,035,213 B2 6/2021 Dusterhoft et al.
11,035,214 B2 6/2021 Cui et al.
11,047,379 B1 6/2021 Li et al.
11,053,853 B2 7/2021 Li et al.
11,060,455 B1 7/2021 Yeung et al.
11,066,915 B1 7/2021 Yeung et al.
11,068,455 B2 7/2021 Shabi et al.
11,085,281 B1 8/2021 Yeung et al.
11,085,282 B2 8/2021 Mazrooee et al.
11,105,250 B1 8/2021 Zhang et al.
11,105,266 B2 8/2021 Zhou et al.
11,125,156 B2 9/2021 Zhang et al.
11,143,000 B2 10/2021 Li et al.
11,143,005 B2 * 10/2021 Dusterhoft ..... E21B 43/26
11,143,006 B1 10/2021 Zhang et al.
11,168,681 B2 11/2021 Boguski et al.
11,236,739 B2 2/2022 Yeung et al.
11,242,737 B2 2/2022 Zhang et al.
11,243,509 B2 2/2022 Cai et al.
11,251,650 B1 2/2022 Liu et al.
11,261,717 B2 3/2022 Yeung et al.
11,268,346 B2 3/2022 Yeung et al.
11,280,266 B2 3/2022 Yeung et al.
11,306,835 B1 4/2022 Dille et al.
RE49,083 E 5/2022 Case et al.
11,339,638 B1 5/2022 Yeung et al.
11,346,200 B2 5/2022 Cai et al.
11,373,058 B2 6/2022 Jaaskelainen et al.
RE49,140 E 7/2022 Case et al.
11,377,943 B2 7/2022 Kriebel et al.
RE49,155 E 8/2022 Case et al.
RE49,156 E 8/2022 Case et al.
11,401,927 B2 8/2022 Li et al.
11,428,165 B2 8/2022 Yeung et al.
11,441,483 B2 9/2022 Li et al.
11,448,122 B2 9/2022 Feng et al.
11,466,680 B2 10/2022 Yeung et al.
11,480,040 B2 10/2022 Han et al.
11,492,887 B2 11/2022 Cui et al.
11,499,405 B2 11/2022 Zhang et al.
11,506,039 B2 11/2022 Zhang et al.
11,512,570 B2 11/2022 Yeung et al.
11,519,395 B2 12/2022 Zhang et al.
11,519,405 B2 12/2022 Deng et al.
11,530,602 B2 12/2022 Yeung et al.
11,549,349 B2 1/2023 Wang et al.

(56) References Cited

U.S. PATENT DOCUMENTS 11,555,390 B2 1/2023 Cui et al.
11,555,756 B2 1/2023 Yeung et al.
11,557,887 B2 1/2023 Ji et al.
11,560,779 B2 1/2023 Mao et al.
11,560,845 B2 1/2023 Yeung et al.
11,572,775 B2 2/2023 Mao et al.
11,575,249 B2 2/2023 Ji et al.
11,592,020 B2 2/2023 Chang et al.
11,596,047 B2 2/2023 Liu et al.
11,598,263 B2 3/2023 Yeung et al.
11,603,797 B2 3/2023 Zhang et al.
11,607,982 B2 3/2023 Tian et al.
11,608,726 B2 3/2023 Zhang et al.
11,624,326 B2 4/2023 Yeung et al.
11,629,583 B2 4/2023 Yeung et al.
11,629,589 B2 4/2023 Lin et al.
11,649,766 B1 5/2023 Yeung et al.
11,649,819 B2 5/2023 Gillispie
11,662,384 B2 5/2023 Liu et al.
11,668,173 B2 6/2023 Zhang et al.
11,668,289 B2 6/2023 Chang et al.
11,677,238 B2 6/2023 Liu et al.
11,939,853 B2 * 3/2024 Yeung ..... F04B 49/007
2002/0126922 A1 9/2002 Cheng et al.
2002/0197176 A1 12/2002 Kondo
2003/0031568 A1 2/2003 Stiefel
2003/0061819 A1 4/2003 Kuroki et al.
2003/0161212 A1 8/2003 Neal et al.
2004/0016245 A1 1/2004 Pierson
2004/0074238 A1 4/2004 Wantanabe et al.
2004/0076526 A1 4/2004 Fukano et al.
2004/0187950 A1 9/2004 Cohen et al.
2004/0219040 A1 11/2004 Kugelev et al.
2005/0051322 A1 3/2005 Speer
2005/0056081 A1 3/2005 Gocho
2005/0139286 A1 6/2005 Poulter et al.
2005/0196298 A1 9/2005 Manning
2005/0226754 A1 10/2005 Orr et al.
2005/0274134 A1 12/2005 Ryu et al.
2006/0061091 A1 3/2006 Osterloh
2006/0062914 A1 3/2006 Garg et al.
2006/0155473 A1 7/2006 Soliman et al.
2006/0196251 A1 9/2006 Richey
2006/0211356 A1 9/2006 Grassman
2006/0228225 A1 10/2006 Rogers
2006/0260331 A1 11/2006 Andreychuk
2006/0272333 A1 12/2006 Sundin
2007/0029090 A1 2/2007 Andreychuk et al.
2007/0041848 A1 2/2007 Wood et al.
2007/0066406 A1 3/2007 Keller et al.
2007/0098580 A1 5/2007 Petersen
2007/0107981 A1 5/2007 Sicotte
2007/0125544 A1 6/2007 Robinson et al.
2007/0169543 A1 7/2007 Fazekas
2007/0181212 A1 8/2007 Fell
2007/0272407 A1 11/2007 Lehman et al.
2007/0277982 A1 12/2007 Shampine et al.
2007/0295569 A1 12/2007 Manzoor et al.
2008/0006089 A1 1/2008 Adnan et al.
2008/0041594 A1 2/2008 Boles et al.
2008/0098891 A1 5/2008 Feher et al.
2008/0161974 A1 7/2008 Alston
2008/0164021 A1 * 7/2008 Dykstra ..... E21B 43/267
166/250.1
2008/0212275 A1 9/2008 Waryck et al.
2008/0229757 A1 9/2008 Alexander et al.
2008/0264625 A1 10/2008 Ochoa
2008/0264649 A1 10/2008 Crawford
2008/0298982 A1 12/2008 Pabst et al.
2009/0053072 A1 2/2009 Borgstadt et al.
2009/0064685 A1 3/2009 Busekros et al.
2009/0068031 A1 3/2009 Gambier et al.
2009/0092510 A1 4/2009 Williams et al.
2009/0124191 A1 5/2009 Van Becelaere
2009/0178412 A1 7/2009 Spytek
2009/0212630 A1 8/2009 Flegel et al.
2009/0249794 A1 10/2009 Wilkes et al.
2009/0252616 A1 10/2009 Brunet et al.
2009/0308602 A1 12/2009 Bruins et al.
2010/0019626 A1 1/2010 Stout et al.
2010/0071899 A1 3/2010 Coquilleau et al.
2010/0218508 A1 9/2010 Brown et al.
2010/0224365 A1 9/2010 Abad
2010/0300683 A1 12/2010 Looper et al.
2010/0310384 A1 12/2010 Stephenson et al.
2011/0030963 A1 2/2011 Demong et al.
2011/0041681 A1 2/2011 Duerr
2011/0052423 A1 3/2011 Gambier et al.
2011/0054704 A1 3/2011 Karpman et al.
2011/0067857 A1 3/2011 Underhill et al.
2011/0085924 A1 4/2011 Shampine et al.
2011/0120702 A1 5/2011 Craig
2011/0120705 A1 5/2011 Walters et al.
2011/0120706 A1 5/2011 Craig
2011/0120718 A1 5/2011 Craig
2011/0125471 A1 5/2011 Craig et al.
2011/0125476 A1 5/2011 Craig
2011/0146244 A1 6/2011 Farman et al.
2011/0146246 A1 6/2011 Farman et al.
2011/0173991 A1 7/2011 Dean et al.
2011/0197988 A1 8/2011 Van Vliet et al.
2011/0241888 A1 10/2011 Lu et al.
2011/0265443 A1 11/2011 Ansari et al.
2011/0272158 A1 11/2011 Neal
2012/0023973 A1 2/2012 Mayorca
2012/0048242 A1 3/2012 Surnilla et al.
2012/0085541 A1 4/2012 Love et al.
2012/0137699 A1 6/2012 Montagne et al.
2012/0179444 A1 7/2012 Ganguly et al.
2012/0192542 A1 8/2012 Chillar et al.
2012/0199001 A1 8/2012 Chillar et al.
2012/0204627 A1 8/2012 Anderl et al.
2012/0255734 A1 10/2012 Coli et al.
2012/0310509 A1 12/2012 Pardo et al.
2012/0324903 A1 12/2012 Dewis et al.
2013/0068307 A1 3/2013 Hains et al.
2013/0087045 A1 4/2013 Sullivan et al.
2013/0087945 A1 4/2013 Kusters et al.
2013/0134702 A1 5/2013 Boraas et al.
2013/0140031 A1 6/2013 Cohen et al.
2013/0158959 A1 * 6/2013 Gu ..... E21B 43/26
703/2
2013/0189915 A1 7/2013 Hazard
2013/0205798 A1 8/2013 Kwok et al.
2013/0233165 A1 9/2013 Matzner et al.
2013/0255953 A1 10/2013 Tudor
2013/0259707 A1 10/2013 Yin
2013/0284455 A1 10/2013 Kajaria et al.
2013/0300341 A1 11/2013 Gillette, II
2013/0306322 A1 11/2013 Sanborn et al.
2014/0000668 A1 1/2014 Lessard
2014/0010671 A1 1/2014 Cryer et al.
2014/0013768 A1 1/2014 Laing et al.
2014/0027386 A1 1/2014 Munisteri
2014/0032082 A1 1/2014 Gehrke et al.
2014/0044517 A1 2/2014 Saha et al.
2014/0048253 A1 2/2014 Andreychuk
2014/0090729 A1 4/2014 Coulter et al.
2014/0090742 A1 4/2014 Coskrey et al.
2014/0094105 A1 4/2014 Lundh et al.
2014/0095114 A1 4/2014 Thomeer et al.
2014/0095554 A1 4/2014 Thomeer et al.
2014/0123621 A1 5/2014 Driessens et al.
2014/0130422 A1 5/2014 Laing et al.
2014/0138079 A1 5/2014 Broussard et al.
2014/0144641 A1 5/2014 Chandler
2014/0147291 A1 5/2014 Burnette
2014/0158345 A1 6/2014 Jang et al.
2014/0174097 A1 6/2014 Hammer et al.
2014/0196459 A1 7/2014 Futa et al.
2014/0216736 A1 * 8/2014 Leugemors ..... B01F 35/7549
166/266
2014/0219824 A1 8/2014 Burnette
2014/0250845 A1 9/2014 Jackson et al.

(56) References Cited

U.S. PATENT DOCUMENTS

2014/0251623 A1 9/2014 Lestz et al.
2014/0262232 A1 9/2014 Dusterhoft et al.
2014/0277772 A1 9/2014 Lopez et al.
2014/0290266 A1 10/2014 Veilleux, Jr. et al.
2014/0318638 A1 10/2014 Harwood et al.
2014/0322050 A1 10/2014 Marette et al.
2015/0027730 A1 1/2015 Hall et al.
2015/0075778 A1 3/2015 Walters et al.
2015/0078924 A1 3/2015 Zhang et al.
2015/0096739 A1 4/2015 Ghasripoor et al.
2015/0101344 A1 4/2015 Jarrier et al.
2015/0114652 A1 4/2015 Lestz et al.
2015/0129210 A1 5/2015 Chong et al.
2015/0135659 A1 5/2015 Jarrier et al.
2015/0159553 A1 6/2015 Kippel et al.
2015/0176387 A1 6/2015 Wutherich
2015/0192117 A1 7/2015 Bridges
2015/0204148 A1 7/2015 Liu et al.
2015/0204174 A1 7/2015 Kresse et al.
2015/0204322 A1 7/2015 Iund et al.
2015/0211512 A1 7/2015 Wiegman et al.
2015/0214816 A1 7/2015 Raad
2015/0217672 A1 8/2015 Shampine et al.
2015/0226140 A1 8/2015 Zhang et al.
2015/0252661 A1 9/2015 Glass
2015/0275891 A1 10/2015 Chong
2015/0337730 A1 11/2015 Kupiszewski et al.
2015/0340864 A1 11/2015 Compton
2015/0345385 A1 12/2015 Santini
2015/0369351 A1 12/2015 Hermann et al.
2016/0032703 A1 2/2016 Broussard et al.
2016/0032836 A1 2/2016 Hawkinson et al.
2016/0076447 A1 3/2016 Merlo et al.
2016/0090823 A1 3/2016 Alzahabi et al.
2016/0102581 A1 4/2016 Del Bono
2016/0105022 A1 4/2016 Oehring et al.
2016/0108705 A1 4/2016 Maxwell et al.
2016/0108713 A1 4/2016 Dunaeva et al.
2016/0123185 A1 5/2016 Le Pache et al.
2016/0168979 A1 6/2016 Zhang et al.
2016/0177675 A1 6/2016 Morris et al.
2016/0177945 A1 6/2016 Byrne et al.
2016/0186671 A1 6/2016 Austin et al.
2016/0195082 A1 7/2016 Wiegman et al.
2016/0215774 A1 7/2016 Oklejas et al.
2016/0230525 A1 8/2016 Lestz et al.
2016/0244314 A1 8/2016 Van Vliet et al.
2016/0248230 A1 8/2016 Tawy et al.
2016/0253634 A1 9/2016 Thomeer et al.
2016/0258267 A1 9/2016 Payne et al.
2016/0265330 A1 9/2016 Mazrooee et al.
2016/0265331 A1 9/2016 Weng et al.
2016/0273328 A1 9/2016 Oehring
2016/0273346 A1 9/2016 Tang et al.
2016/0290114 A1 10/2016 Oehring et al.
2016/0304225 A1* 10/2016 Monti ..... B65B 61/20
2016/0305223 A1 10/2016 Phillippi et al.
2016/0319650 A1 11/2016 Oehring et al.
2016/0326845 A1 11/2016 Djikpesse et al.
2016/0348479 A1 12/2016 Oehring et al.
2016/0369609 A1 12/2016 Morris et al.
2017/0009905 A1 1/2017 Arnold
2017/0016433 A1 1/2017 Chong et al.
2017/0030177 A1 2/2017 Oehring et al.
2017/0038137 A1 2/2017 Turney
2017/0045055 A1 2/2017 Hoefel et al.
2017/0051598 A1 2/2017 Ouenes
2017/0052087 A1 2/2017 Faqihi et al.
2017/0074074 A1 3/2017 Joseph et al.
2017/0074076 A1 3/2017 Joseph et al.
2017/0074089 A1 3/2017 Agarwal et al.
2017/0082110 A1 3/2017 Lammers
2017/0089189 A1 3/2017 Norris et al.
2017/0114613 A1 4/2017 Lecerf et al.
2017/0114625 A1 4/2017 Norris et al.
2017/0122310 A1 5/2017 Ladrón de Guevara
2017/0131174 A1 5/2017 Enev et al.
2017/0145918 A1 5/2017 Oehring et al.
2017/0177992 A1 6/2017 Klie
2017/0191350 A1 7/2017 Johns et al.
2017/0218727 A1 8/2017 Oehring et al.
2017/0226839 A1 8/2017 Broussard et al.
2017/0226842 A1 8/2017 Omont et al.
2017/0226998 A1 8/2017 Zhang et al.
2017/0227002 A1 8/2017 Mikulski et al.
2017/0233103 A1 8/2017 Teicholz et al.
2017/0234165 A1 8/2017 Kersey et al.
2017/0234308 A1 8/2017 Buckley
2017/0241336 A1 8/2017 Jones et al.
2017/0241671 A1 8/2017 Ahmad
2017/0247995 A1 8/2017 Crews et al.
2017/0248034 A1 8/2017 Dzieciol et al.
2017/0248208 A1 8/2017 Tamura
2017/0248308 A1 8/2017 Makarychev-Mikhailov et al.
2017/0254186 A1 9/2017 Aidagulov et al.
2017/0275149 A1 9/2017 Schmidt
2017/0288400 A1 10/2017 Williams
2017/0292409 A1 10/2017 Aguilar et al.
2017/0302135 A1 10/2017 Cory
2017/0305736 A1 10/2017 Haile et al.
2017/0306847 A1 10/2017 Suciu et al.
2017/0306936 A1 10/2017 Dole et al.
2017/0322086 A1 11/2017 Luharuka et al.
2017/0328179 A1 11/2017 Dykstra et al.
2017/0333086 A1 11/2017 Jackson
2017/0334448 A1 11/2017 Schwunk
2017/0335842 A1 11/2017 Robinson et al.
2017/0350471 A1 12/2017 Steidl et al.
2017/0356470 A1 12/2017 Jaffrey
2017/0370199 A1 12/2017 Witkowski et al.
2017/0370480 A1 12/2017 Witkowski et al.
2018/0016895 A1 1/2018 Weng et al.
2018/0034280 A1 2/2018 Pedersen
2018/0038216 A1 2/2018 Zhang et al.
2018/0038328 A1 2/2018 Louven et al.
2018/0041093 A1 2/2018 Miranda
2018/0045202 A1 2/2018 Crom
2018/0058171 A1 3/2018 Roesner et al.
2018/0087499 A1 3/2018 Zhang et al.
2018/0087996 A1 3/2018 De La Cruz
2018/0149000 A1 5/2018 Roussel et al.
2018/0156210 A1 6/2018 Oehring et al.
2018/0172294 A1 6/2018 Owen
2018/0183219 A1 6/2018 Oehring et al.
2018/0186442 A1 7/2018 Maier
2018/0187662 A1 7/2018 Hill et al.
2018/0209415 A1 7/2018 Zhang et al.
2018/0223640 A1 8/2018 Keihany et al.
2018/0224044 A1 8/2018 Penney et al.
2018/0229998 A1 8/2018 Shock
2018/0230780 A1 8/2018 Klenner et al.
2018/0258746 A1 9/2018 Broussard et al.
2018/0266412 A1 9/2018 Stokkevåg et al.
2018/0278124 A1 9/2018 Oehring et al.
2018/0283102 A1 10/2018 Cook
2018/0283618 A1 10/2018 Cook
2018/0284817 A1 10/2018 Cook et al.
2018/0290877 A1 10/2018 Shock
2018/0291781 A1 10/2018 Pedrini
2018/0298731 A1 10/2018 Bishop
2018/0298735 A1 10/2018 Conrad
2018/0307255 A1 10/2018 Bishop
2018/0313456 A1 11/2018 Bayyouk et al.
2018/0328157 A1 11/2018 Bishop
2018/0334893 A1 11/2018 Oehring
2018/0363435 A1 12/2018 Coli et al.
2018/0363436 A1 12/2018 Coli et al.
2018/0363437 A1 12/2018 Coli et al.
2018/0363438 A1 12/2018 Coli et al.
2019/0003272 A1 1/2019 Morris et al.
2019/0003329 A1 1/2019 Morris et al.
2019/0010793 A1 1/2019 Hinderliter
2019/0011051 A1 1/2019 Yeung
2019/0048993 A1 2/2019 Akiyama et al.

(56) References Cited

U.S. PATENT DOCUMENTS

2019/0055836 A1 2/2019 Felkl et al.
2019/0063263 A1 2/2019 Davis et al.
2019/0063341 A1 2/2019 Davis
2019/0067991 A1 2/2019 Davis et al.
2019/0071946 A1 3/2019 Painter et al.
2019/0071992 A1 3/2019 Feng
2019/0072005 A1 3/2019 Fisher et al.
2019/0078471 A1 3/2019 Braglia et al.
2019/0088845 A1 3/2019 Sugi et al.
2019/0091619 A1 3/2019 Huang
2019/0106316 A1 4/2019 Van Vliet et al.
2019/0106970 A1 4/2019 Oehring
2019/0112908 A1 4/2019 Coli et al.
2019/0112910 A1 4/2019 Oehring et al.
2019/0119096 A1 4/2019 Haile et al.
2019/0120024 A1 4/2019 Oehring et al.
2019/0120031 A1 4/2019 Gilje
2019/0120134 A1 4/2019 Goleczka et al.
2019/0128247 A1 5/2019 Douglas, III
2019/0128288 A1 5/2019 Konada et al.
2019/0131607 A1 5/2019 Gillette
2019/0136677 A1 5/2019 Shampine et al.
2019/0153843 A1 5/2019 Headrick
2019/0153938 A1 5/2019 Hammoud
2019/0154020 A1 5/2019 Glass
2019/0155318 A1 5/2019 Meunier
2019/0169962 A1 6/2019 Aqrawi et al.
2019/0178234 A1 6/2019 Beisel
2019/0178235 A1 6/2019 Coskrey et al.
2019/0185312 A1 6/2019 Bush et al.
2019/0203572 A1 7/2019 Morris et al.
2019/0204021 A1 7/2019 Morris et al.
2019/0211661 A1 7/2019 Reckels et al.
2019/0211814 A1 7/2019 Weightman et al.
2019/0217258 A1 7/2019 Bishop
2019/0226317 A1 7/2019 Payne et al.
2019/0245348 A1 8/2019 Hinderliter et al.
2019/0249652 A1 8/2019 Stephenson et al.
2019/0249754 A1 8/2019 Oehring et al.
2019/0257297 A1 8/2019 Botting et al.
2019/0264667 A1 8/2019 Byrne
2019/0277279 A1 9/2019 Byrne et al.
2019/0277295 A1 9/2019 Clyburn et al.
2019/0309585 A1 10/2019 Miller et al.
2019/0316447 A1 10/2019 Oehring et al.
2019/0316456 A1 10/2019 Beisel et al.
2019/0323337 A1 10/2019 Glass et al.
2019/0330923 A1 10/2019 Gable et al.
2019/0331117 A1 10/2019 Gable et al.
2019/0337392 A1 11/2019 Joshi et al.
2019/0338762 A1 11/2019 Curry et al.
2019/0345920 A1 11/2019 Surjaatmadja et al.
2019/0353103 A1 11/2019 Roberge
2019/0356199 A1 11/2019 Morris et al.
2019/0376449 A1 12/2019 Carrell
2019/0383123 A1 12/2019 Hinderliter
2020/0003205 A1 1/2020 Stokkevåg et al.
2020/0011165 A1 1/2020 George et al.
2020/0040878 A1 2/2020 Morris
2020/0049136 A1 2/2020 Stephenson
2020/0049153 A1 2/2020 Headrick et al.
2020/0071998 A1 3/2020 Oehring et al.
2020/0072201 A1 3/2020 Marica
2020/0088202 A1 3/2020 Sigmar et al.
2020/0095854 A1 3/2020 Hinderliter
2020/0109610 A1 4/2020 Husøy et al.
2020/0109616 A1 4/2020 Oehring et al.
2020/0132058 A1 4/2020 Mollatt
2020/0141219 A1 5/2020 Oehring et al.
2020/0141326 A1 5/2020 Redford et al.
2020/0141907 A1 5/2020 Meck et al.
2020/0166026 A1 5/2020 Marica
2020/0206704 A1 7/2020 Chong
2020/0208733 A1 7/2020 Kim
2020/0223648 A1 7/2020 Herman et al.
2020/0224645 A1 7/2020 Buckley
2020/0225381 A1 7/2020 Walles et al.
2020/0232454 A1 7/2020 Chretien et al.
2020/0256333 A1 8/2020 Surjaatmadja et al.
2020/0263498 A1 8/2020 Fischer et al.
2020/0263525 A1 8/2020 Reid et al.
2020/0263526 A1 8/2020 Fischer et al.
2020/0263527 A1 8/2020 Fischer et al.
2020/0263528 A1 8/2020 Fischer et al.
2020/0267888 A1 8/2020 Putz
2020/0291731 A1 9/2020 Haiderer et al.
2020/0295574 A1 9/2020 Batsch-Smith
2020/0300050 A1 9/2020 Oehring et al.
2020/0309027 A1 10/2020 Rytkönen
2020/0309113 A1 10/2020 Hunter et al.
2020/0325752 A1 10/2020 Clark et al.
2020/0325760 A1 10/2020 Markham
2020/0325761 A1 10/2020 Williams
2020/0325791 A1 10/2020 Himmelmann
2020/0325893 A1 10/2020 Kraige et al.
2020/0332784 A1 10/2020 Zhang et al.
2020/0332788 A1 10/2020 Cui et al.
2020/0340313 A1 10/2020 Fischer et al.
2020/0340322 A1 10/2020 Sizemore et al.
2020/0340340 A1 10/2020 Oehring et al.
2020/0340344 A1 10/2020 Reckels et al.
2020/0340404 A1 10/2020 Stockstill et al.
2020/0347725 A1 11/2020 Morris et al.
2020/0354928 A1 11/2020 Wehler et al.
2020/0355055 A1 11/2020 Dusterhoft et al.
2020/0362760 A1 11/2020 Morenko et al.
2020/0362764 A1 11/2020 Saintignan et al.
2020/0370394 A1 11/2020 Cai et al.
2020/0370408 A1 11/2020 Cai et al.
2020/0370429 A1 11/2020 Cai et al.
2020/0371490 A1 11/2020 Cai et al.
2020/0386169 A1 12/2020 Hinderliter et al.
2020/0386222 A1 12/2020 Pham et al.
2020/0388140 A1 12/2020 Gomez et al.
2020/0392826 A1 12/2020 Cui et al.
2020/0392827 A1 12/2020 George et al.
2020/0393088 A1 12/2020 Sizemore et al.
2020/0398238 A1 12/2020 Zhong et al.
2020/0400000 A1 12/2020 Ghasripoor et al.
2020/0400005 A1 12/2020 Han et al.
2020/0407625 A1 12/2020 Stephenson
2020/0408071 A1 12/2020 Li et al.
2020/0408144 A1 12/2020 Feng et al.
2020/0408147 A1 12/2020 Zhang et al.
2020/0408149 A1 12/2020 Li et al.
2021/0010361 A1 1/2021 Kriebel et al.
2021/0010362 A1 1/2021 Kriebel et al.
2021/0025324 A1 1/2021 Morris et al.
2021/0025383 A1 1/2021 Bodishbaugh et al.
2021/0032961 A1 2/2021 Hinderliter et al.
2021/0054727 A1 2/2021 Floyd
2021/0071503 A1 3/2021 Ogg et al.
2021/0071574 A1 3/2021 Feng et al.
2021/0071579 A1 3/2021 Li et al.
2021/0071654 A1 3/2021 Brunson, Jr.
2021/0071752 A1 3/2021 Cui et al.
2021/0079758 A1 3/2021 Yeung et al.
2021/0079851 A1 3/2021 Yeung et al.
2021/0086851 A1 3/2021 Zhang et al.
2021/0087883 A1 3/2021 Zhang et al.
2021/0087916 A1 3/2021 Zhang et al.
2021/0087925 A1 3/2021 Heidari et al.
2021/0087943 A1 3/2021 Cui et al.
2021/0088042 A1 3/2021 Zhang et al.
2021/0123425 A1 4/2021 Cui et al.
2021/0123434 A1 4/2021 Cui et al.
2021/0123435 A1 4/2021 Cui et al.
2021/0131409 A1 5/2021 Cui et al.
2021/0140416 A1 5/2021 Buckley
2021/0148208 A1 5/2021 Thomas et al.
2021/0148221 A1 5/2021 Dusterhoft et al.
2021/0156240 A1 5/2021 Cicci et al.
2021/0156241 A1 5/2021 Cook
2021/0172282 A1 6/2021 Wang et al.

(56) References Cited

U.S. PATENT DOCUMENTS

2021/0180517 A1 6/2021 Zhou et al.
2021/0190045 A1 6/2021 Zhang et al.
2021/0199110 A1 7/2021 Albert et al.
2021/0222690 A1 7/2021 Beisel
2021/0239112 A1 8/2021 Buckley
2021/0246774 A1 8/2021 Cui et al.
2021/0270261 A1 9/2021 Zhang et al.
2021/0270264 A1 9/2021 Byrne et al.
2021/0285311 A1 9/2021 Ji et al.
2021/0285432 A1 9/2021 Ji et al.
2021/0301807 A1 9/2021 Cui et al.
2021/0301815 A1 9/2021 Chretien et al.
2021/0306720 A1 9/2021 Sandoval et al.
2021/0308638 A1 10/2021 Zhong et al.
2021/0324718 A1 10/2021 Anders
2021/0348475 A1 11/2021 Yeung et al.
2021/0348476 A1 11/2021 Yeung et al.
2021/0348477 A1 11/2021 Yeung et al.
2021/0355927 A1 11/2021 Jian et al.
2021/0372394 A1 12/2021 Bagulayan et al.
2021/0372395 A1 12/2021 Li et al.
2021/0376413 A1 12/2021 Asfha
2021/0388760 A1 12/2021 Feng et al.
2022/0082007 A1 3/2022 Zhang et al.
2022/0090476 A1 3/2022 Zhang et al.
2022/0090477 A1 3/2022 Zhang et al.
2022/0090478 A1 3/2022 Zhang et al.
2022/0112892 A1 4/2022 Cui et al.
2022/0120262 A1 4/2022 Ji et al.
2022/0145740 A1 5/2022 Yuan et al.
2022/0154775 A1 5/2022 Liu et al.
2022/0155373 A1 5/2022 Liu et al.
2022/0162931 A1 5/2022 Zhong et al.
2022/0162991 A1 5/2022 Zhang et al.
2022/0181859 A1 6/2022 Ji et al.
2022/0186724 A1 6/2022 Chang et al.
2022/0213777 A1 7/2022 Cui et al.
2022/0220836 A1 7/2022 Zhang et al.
2022/0224087 A1 7/2022 Ji et al.
2022/0228468 A1 7/2022 Cui et al.
2022/0228469 A1 7/2022 Zhang et al.
2022/0235639 A1 7/2022 Zhang et al.
2022/0235640 A1 7/2022 Mao et al.
2022/0235641 A1 7/2022 Zhang et al.
2022/0235642 A1 7/2022 Zhang et al.
2022/0235802 A1 7/2022 Jiang et al.
2022/0242297 A1 8/2022 Tian et al.
2022/0243568 A1* 8/2022 AlTammar ..... E21B 43/26
2022/0243613 A1 8/2022 Ji et al.
2022/0243724 A1 8/2022 Li et al.
2022/0250000 A1 8/2022 Zhang et al.
2022/0255319 A1 8/2022 Liu et al.
2022/0258659 A1 8/2022 Cui et al.
2022/0259947 A1 8/2022 Li et al.
2022/0259964 A1 8/2022 Zhang et al.
2022/0268201 A1 8/2022 Feng et al.
2022/0282606 A1 9/2022 Zhong et al.
2022/0282726 A1 9/2022 Zhang et al.
2022/0290549 A1 9/2022 Zhang et al.
2022/0294194 A1 9/2022 Cao et al.
2022/0298906 A1 9/2022 Zhong et al.
2022/0307359 A1 9/2022 Liu et al.
2022/0307424 A1 9/2022 Wang et al.
2022/0314248 A1 10/2022 Ge et al.
2022/0315347 A1 10/2022 Liu et al.
2022/0316306 A1 10/2022 Liu et al.
2022/0316362 A1 10/2022 Zhang et al.
2022/0316461 A1 10/2022 Wang et al.
2022/0325608 A1 10/2022 Zhang et al.
2022/0330411 A1 10/2022 Liu et al.
2022/0333471 A1 10/2022 Zhong et al.
2022/0339646 A1 10/2022 Yu et al.
2022/0341358 A1 10/2022 Ji et al.
2022/0341362 A1 10/2022 Feng et al.
2022/0341415 A1 10/2022 Deng et al.
2022/0345007 A1 10/2022 Liu et al.
2022/0349345 A1 11/2022 Zhang et al.
2022/0353980 A1 11/2022 Liu et al.
2022/0361309 A1 11/2022 Liu et al.
2022/0364452 A1 11/2022 Wang et al.
2022/0364453 A1 11/2022 Chang et al.
2022/0372865 A1 11/2022 Lin et al.
2022/0376280 A1 11/2022 Shao et al.
2022/0381126 A1 12/2022 Cui et al.
2022/0389799 A1 12/2022 Mao et al.
2022/0389803 A1 12/2022 Zhang et al.
2022/0389804 A1 12/2022 Cui et al.
2022/0389865 A1 12/2022 Feng et al.
2022/0389867 A1 12/2022 Li et al.
2022/0412196 A1 12/2022 Cui et al.
2022/0412199 A1 12/2022 Mao et al.
2022/0412200 A1 12/2022 Zhang et al.
2022/0412258 A1 12/2022 Li et al.
2022/0412379 A1 12/2022 Wang et al.
2023/0001524 A1 1/2023 Jiang et al.
2023/0003238 A1 1/2023 Du et al.
2023/0015132 A1 1/2023 Feng et al.
2023/0015529 A1 1/2023 Zhang et al.
2023/0015581 A1 1/2023 Ji et al.
2023/0017968 A1 1/2023 Deng et al.
2023/0029574 A1 2/2023 Zhang et al.
2023/0029671 A1 2/2023 Han et al.
2023/0036118 A1 2/2023 Xing et al.
2023/0040970 A1 2/2023 Liu et al.
2023/0042379 A1 2/2023 Zhang et al.
2023/0047033 A1 2/2023 Fu et al.
2023/0048551 A1 2/2023 Feng et al.
2023/0049462 A1 2/2023 Zhang et al.
2023/0064964 A1 3/2023 Wang et al.
2023/0074794 A1 3/2023 Liu et al.
2023/0085124 A1 3/2023 Zhong et al.
2023/0092506 A1 3/2023 Zhong et al.
2023/0092705 A1 3/2023 Liu et al.
2023/0106683 A1 4/2023 Zhang et al.
2023/0107300 A1 4/2023 Huang et al.
2023/0107791 A1 4/2023 Zhang et al.
2023/0109018 A1 4/2023 Du et al.
2023/0116458 A1 4/2023 Liu et al.
2023/0117362 A1 4/2023 Zhang et al.
2023/0119725 A1 4/2023 Wang et al.
2023/0119876 A1 4/2023 Mao et al.
2023/0119896 A1 4/2023 Zhang et al.
2023/0120810 A1 4/2023 Fu et al.
2023/0121251 A1 4/2023 Cui et al.
2023/0124444 A1 4/2023 Chang et al.
2023/0138582 A1 5/2023 Li et al.
2023/0144116 A1 5/2023 Li et al.
2023/0145963 A1 5/2023 Zhang et al.
2023/0151722 A1 5/2023 Cui et al.
2023/0151723 A1 5/2023 Ji et al.
2023/0152793 A1 5/2023 Wang et al.
2023/0160289 A1 5/2023 Cui et al.
2023/0160510 A1 5/2023 Bao et al.
2023/0163580 A1 5/2023 Ji et al.
2023/0167776 A1 6/2023 Cui et al.

FOREIGN PATENT DOCUMENTS

CA 2043184 C 8/1994
CA 2829762 A1 9/2012
CA 2737321 C 9/2013
CA 2876687 A1 5/2014
CA 2693567 C 9/2014
CA 2964597 A1 10/2017
CA 3138533 A1 11/2020
CA 2919175 C 3/2021
CN 2622404 Y 6/2004
CN 2779054 Y 5/2006
CN 2890325 Y 4/2007
CN 200964929 Y 10/2007
CN 101323151 A 12/2008
CN 201190660 Y 2/2009
CN 201190892 Y 2/2009
CN 201190893 2/2009

(56) References Cited

FOREIGN PATENT DOCUMENTS

| | | | |
|---|---|---|---|
| CN | 101414171 | A | 4/2009 |
| CN | 201215073 | | 4/2009 |
| CN | 201236650 | | 5/2009 |
| CN | 201275542 | | 7/2009 |
| CN | 201275801 | | 7/2009 |
| CN | 201333385 | | 10/2009 |
| CN | 201443300 | | 4/2010 |
| CN | 201496415 | | 6/2010 |
| CN | 201501365 | | 6/2010 |
| CN | 201507271 | | 6/2010 |
| CN | 201560210 | | 8/2010 |
| CN | 201581862 | | 9/2010 |
| CN | 201610728 | | 10/2010 |
| CN | 201610751 | | 10/2010 |
| CN | 201618530 | | 11/2010 |
| CN | 201661255 | | 12/2010 |
| CN | 101949382 | A | 1/2011 |
| CN | 201756927 | | 3/2011 |
| CN | 102128011 | A | 7/2011 |
| CN | 102140898 | A | 8/2011 |
| CN | 102155172 | A | 8/2011 |
| CN | 102182904 | A | 9/2011 |
| CN | 202000930 | | 10/2011 |
| CN | 202055781 | | 11/2011 |
| CN | 202082265 | | 12/2011 |
| CN | 202100216 | | 1/2012 |
| CN | 202100217 | | 1/2012 |
| CN | 202100815 | | 1/2012 |
| CN | 202124340 | | 1/2012 |
| CN | 202140051 | | 2/2012 |
| CN | 202140080 | | 2/2012 |
| CN | 202144789 | | 2/2012 |
| CN | 202144943 | | 2/2012 |
| CN | 202149354 | | 2/2012 |
| CN | 102383748 | A | 3/2012 |
| CN | 202156297 | | 3/2012 |
| CN | 202158355 | | 3/2012 |
| CN | 202163504 | | 3/2012 |
| CN | 202165236 | | 3/2012 |
| CN | 202180866 | | 4/2012 |
| CN | 202181875 | | 4/2012 |
| CN | 202187744 | | 4/2012 |
| CN | 202191854 | U | 4/2012 |
| CN | 202250008 | U | 5/2012 |
| CN | 101885307 | B | 7/2012 |
| CN | 102562020 | A | 7/2012 |
| CN | 202326156 | U | 7/2012 |
| CN | 202370773 | U | 8/2012 |
| CN | 202417397 | U | 9/2012 |
| CN | 202417461 | U | 9/2012 |
| CN | 102729335 | A | 10/2012 |
| CN | 202463955 | U | 10/2012 |
| CN | 202463957 | U | 10/2012 |
| CN | 202467739 | U | 10/2012 |
| CN | 202467801 | U | 10/2012 |
| CN | 202531016 | U | 11/2012 |
| CN | 202544794 | U | 11/2012 |
| CN | 102825039 | A | 12/2012 |
| CN | 202578592 | U | 12/2012 |
| CN | 202579164 | U | 12/2012 |
| CN | 202594808 | U | 12/2012 |
| CN | 202594928 | U | 12/2012 |
| CN | 202596615 | U | 12/2012 |
| CN | 202596616 | U | 12/2012 |
| CN | 102889191 | A | 1/2013 |
| CN | 202641535 | U | 1/2013 |
| CN | 202645475 | U | 1/2013 |
| CN | 202666716 | U | 1/2013 |
| CN | 202669645 | U | 1/2013 |
| CN | 202669944 | U | 1/2013 |
| CN | 202671336 | U | 1/2013 |
| CN | 202673269 | U | 1/2013 |
| CN | 202751982 | U | 2/2013 |
| CN | 102963629 | A | 3/2013 |
| CN | 202767964 | U | 3/2013 |
| CN | 202789791 | U | 3/2013 |
| CN | 202789792 | U | 3/2013 |
| CN | 202810717 | U | 3/2013 |
| CN | 202827276 | U | 3/2013 |
| CN | 202833093 | U | 3/2013 |
| CN | 202833370 | U | 3/2013 |
| CN | 202895467 | U | 4/2013 |
| CN | 202926404 | U | 5/2013 |
| CN | 202935216 | U | 5/2013 |
| CN | 202935798 | U | 5/2013 |
| CN | 202935816 | U | 5/2013 |
| CN | 202970631 | U | 6/2013 |
| CN | 103223315 | A | 7/2013 |
| CN | 203050598 | U | 7/2013 |
| CN | 103233714 | A | 8/2013 |
| CN | 103233715 | A | 8/2013 |
| CN | 103245523 | A | 8/2013 |
| CN | 103247220 | A | 8/2013 |
| CN | 103253839 | A | 8/2013 |
| CN | 103277290 | A | 9/2013 |
| CN | 103321782 | A | 9/2013 |
| CN | 203170270 | U | 9/2013 |
| CN | 203172509 | U | 9/2013 |
| CN | 203175778 | U | 9/2013 |
| CN | 203175787 | U | 9/2013 |
| CN | 102849880 | B | 10/2013 |
| CN | 203241231 | U | 10/2013 |
| CN | 203244941 | U | 10/2013 |
| CN | 203244942 | U | 10/2013 |
| CN | 203303798 | U | 11/2013 |
| CN | 103420532 | A | 12/2013 |
| CN | 203321792 | U | 12/2013 |
| CN | 203412658 | U | 1/2014 |
| CN | 203420697 | U | 2/2014 |
| CN | 203480755 | U | 3/2014 |
| CN | 103711437 | A | 4/2014 |
| CN | 203531815 | U | 4/2014 |
| CN | 203531871 | U | 4/2014 |
| CN | 203531883 | U | 4/2014 |
| CN | 203556164 | U | 4/2014 |
| CN | 203558809 | U | 4/2014 |
| CN | 203559861 | U | 4/2014 |
| CN | 203559893 | U | 4/2014 |
| CN | 203560189 | U | 4/2014 |
| CN | 102704870 | B | 5/2014 |
| CN | 203611843 | U | 5/2014 |
| CN | 203612531 | U | 5/2014 |
| CN | 203612843 | U | 5/2014 |
| CN | 203614062 | U | 5/2014 |
| CN | 203614388 | U | 5/2014 |
| CN | 203621045 | U | 6/2014 |
| CN | 203621046 | U | 6/2014 |
| CN | 203621051 | U | 6/2014 |
| CN | 203640993 | U | 6/2014 |
| CN | 203655221 | U | 6/2014 |
| CN | 103899280 | A | 7/2014 |
| CN | 103923670 | A | 7/2014 |
| CN | 203685052 | U | 7/2014 |
| CN | 203716936 | U | 7/2014 |
| CN | 103990410 | A | 8/2014 |
| CN | 103993869 | A | 8/2014 |
| CN | 203754009 | U | 8/2014 |
| CN | 203754025 | U | 8/2014 |
| CN | 203754341 | U | 8/2014 |
| CN | 203756614 | U | 8/2014 |
| CN | 203770264 | U | 8/2014 |
| CN | 203784519 | U | 8/2014 |
| CN | 203784520 | U | 8/2014 |
| CN | 104057864 | A | 9/2014 |
| CN | 203819819 | U | 9/2014 |
| CN | 203823431 | U | 9/2014 |
| CN | 203835337 | U | 9/2014 |
| CN | 104074500 | A | 10/2014 |
| CN | 203876633 | U | 10/2014 |
| CN | 203876636 | U | 10/2014 |
| CN | 203877364 | U | 10/2014 |
| CN | 203877365 | U | 10/2014 |
| CN | 203877375 | U | 10/2014 |
| CN | 203877424 | U | 10/2014 |

(56) References Cited

FOREIGN PATENT DOCUMENTS

| | | | |
|---|---|---|---|
| CN | 203879476 | U | 10/2014 |
| CN | 203879479 | U | 10/2014 |
| CN | 203890292 | U | 10/2014 |
| CN | 203899476 | U | 10/2014 |
| CN | 203906206 | U | 10/2014 |
| CN | 104150728 | A | 11/2014 |
| CN | 104176522 | A | 12/2014 |
| CN | 104196464 | A | 12/2014 |
| CN | 104234651 | A | 12/2014 |
| CN | 203971841 | U | 12/2014 |
| CN | 203975450 | U | 12/2014 |
| CN | 204020788 | U | 12/2014 |
| CN | 204021980 | U | 12/2014 |
| CN | 204024625 | U | 12/2014 |
| CN | 204051401 | U | 12/2014 |
| CN | 204060661 | U | 12/2014 |
| CN | 104260672 | A | 1/2015 |
| CN | 104314512 | A | 1/2015 |
| CN | 204077478 | U | 1/2015 |
| CN | 204077526 | U | 1/2015 |
| CN | 204078307 | U | 1/2015 |
| CN | 204083051 | U | 1/2015 |
| CN | 204113168 | U | 1/2015 |
| CN | 104340682 | A | 2/2015 |
| CN | 104358536 | A | 2/2015 |
| CN | 104369687 | A | 2/2015 |
| CN | 104402178 | A | 3/2015 |
| CN | 104402185 | A | 3/2015 |
| CN | 104402186 | A | 3/2015 |
| CN | 204209819 | U | 3/2015 |
| CN | 204224560 | U | 3/2015 |
| CN | 204225813 | U | 3/2015 |
| CN | 204225839 | U | 3/2015 |
| CN | 104533392 | A | 4/2015 |
| CN | 104563938 | A | 4/2015 |
| CN | 104563994 | A | 4/2015 |
| CN | 104563995 | A | 4/2015 |
| CN | 104563998 | A | 4/2015 |
| CN | 104564033 | A | 4/2015 |
| CN | 204257122 | U | 4/2015 |
| CN | 204283610 | U | 4/2015 |
| CN | 204283782 | U | 4/2015 |
| CN | 204297682 | U | 4/2015 |
| CN | 204299810 | U | 4/2015 |
| CN | 104594857 | A | 5/2015 |
| CN | 104595493 | A | 5/2015 |
| CN | 104612647 | A | 5/2015 |
| CN | 104612928 | A | 5/2015 |
| CN | 104632126 | A | 5/2015 |
| CN | 204325094 | U | 5/2015 |
| CN | 204325098 | U | 5/2015 |
| CN | 204326983 | U | 5/2015 |
| CN | 204326985 | U | 5/2015 |
| CN | 204344040 | U | 5/2015 |
| CN | 204344095 | U | 5/2015 |
| CN | 104727797 | A | 6/2015 |
| CN | 204402414 | U | 6/2015 |
| CN | 204402423 | U | 6/2015 |
| CN | 204402450 | U | 6/2015 |
| CN | 104803568 | A | 7/2015 |
| CN | 204436360 | U | 7/2015 |
| CN | 204457524 | U | 7/2015 |
| CN | 204472485 | U | 7/2015 |
| CN | 204473625 | U | 7/2015 |
| CN | 204477303 | U | 7/2015 |
| CN | 204493095 | U | 7/2015 |
| CN | 204493309 | U | 7/2015 |
| CN | 104820372 | A | 8/2015 |
| CN | 104832093 | A | 8/2015 |
| CN | 104863523 | A | 8/2015 |
| CN | 204552723 | U | 8/2015 |
| CN | 204553866 | U | 8/2015 |
| CN | 204571831 | U | 8/2015 |
| CN | 204703814 | U | 10/2015 |
| CN | 204703833 | U | 10/2015 |
| CN | 204703834 | U | 10/2015 |
| CN | 105092401 | A | 11/2015 |
| CN | 103790927 | B | 12/2015 |
| CN | 105207097 | A | 12/2015 |
| CN | 204831952 | U | 12/2015 |
| CN | 204899777 | U | 12/2015 |
| CN | 102602323 | B | 1/2016 |
| CN | 105240064 | A | 1/2016 |
| CN | 204944834 | U | 1/2016 |
| CN | 205042127 | U | 2/2016 |
| CN | 205172478 | U | 4/2016 |
| CN | 105536299 | A | 5/2016 |
| CN | 105545207 | A | 5/2016 |
| CN | 205260249 | U | 5/2016 |
| CN | 205297518 | U | 6/2016 |
| CN | 205298447 | U | 6/2016 |
| CN | 205391821 | U | 7/2016 |
| CN | 205400701 | U | 7/2016 |
| CN | 205477370 | U | 8/2016 |
| CN | 205479153 | U | 8/2016 |
| CN | 205503058 | U | 8/2016 |
| CN | 205503068 | U | 8/2016 |
| CN | 205503089 | U | 8/2016 |
| CN | 105958098 | A | 9/2016 |
| CN | 205599180 | U | 9/2016 |
| CN | 106121577 | A | 11/2016 |
| CN | 205709587 | U | 11/2016 |
| CN | 106246120 | A | 12/2016 |
| CN | 205805471 | U | 12/2016 |
| CN | 106321045 | A | 1/2017 |
| CN | 205858306 | U | 1/2017 |
| CN | 106438310 | A | 2/2017 |
| CN | 205937833 | U | 2/2017 |
| CN | 206129196 | U | 4/2017 |
| CN | 106715165 | A | 5/2017 |
| CN | 106761561 | A | 5/2017 |
| CN | 206237147 | U | 6/2017 |
| CN | 206287832 | U | 6/2017 |
| CN | 206346711 | U | 7/2017 |
| CN | 107120822 | A | 9/2017 |
| CN | 107143298 | A | 9/2017 |
| CN | 107159046 | A | 9/2017 |
| CN | 107188018 | A | 9/2017 |
| CN | 206496016 | U | 9/2017 |
| CN | 107234358 | A | 10/2017 |
| CN | 107261975 | A | 10/2017 |
| CN | 206581929 | U | 10/2017 |
| CN | 107476769 | A | 12/2017 |
| CN | 107520526 | A | 12/2017 |
| CN | 206754664 | U | 12/2017 |
| CN | 107605427 | A | 1/2018 |
| CN | 107654196 | A | 2/2018 |
| CN | 107656499 | A | 2/2018 |
| CN | 107728657 | A | 2/2018 |
| CN | 206985503 | U | 2/2018 |
| CN | 207017968 | U | 2/2018 |
| CN | 107859053 | A | 3/2018 |
| CN | 207057867 | U | 3/2018 |
| CN | 207085817 | U | 3/2018 |
| CN | 107883091 | A | 4/2018 |
| CN | 107902427 | A | 4/2018 |
| CN | 107939290 | A | 4/2018 |
| CN | 107956708 | A | 4/2018 |
| CN | 207169595 | U | 4/2018 |
| CN | 207194873 | U | 4/2018 |
| CN | 207245674 | U | 4/2018 |
| CN | 108034466 | A | 5/2018 |
| CN | 108036071 | A | 5/2018 |
| CN | 108087050 | A | 5/2018 |
| CN | 207380566 | U | 5/2018 |
| CN | 108103483 | A | 6/2018 |
| CN | 108179046 | A | 6/2018 |
| CN | 108254276 | A | 7/2018 |
| CN | 108311535 | A | 7/2018 |
| CN | 207583576 | U | 7/2018 |
| CN | 207634064 | U | 7/2018 |
| CN | 207648054 | U | 7/2018 |
| CN | 207650621 | U | 7/2018 |
| CN | 108371894 | A | 8/2018 |

(56) References Cited

FOREIGN PATENT DOCUMENTS

| | | | |
|---|---|---|---|
| CN | 207777153 | U | 8/2018 |
| CN | 108547601 | A | 9/2018 |
| CN | 108547766 | A | 9/2018 |
| CN | 108555826 | A | 9/2018 |
| CN | 108561098 | A | 9/2018 |
| CN | 108561750 | A | 9/2018 |
| CN | 108590617 | A | 9/2018 |
| CN | 207813495 | U | 9/2018 |
| CN | 207814698 | U | 9/2018 |
| CN | 207862275 | U | 9/2018 |
| CN | 108687954 | A | 10/2018 |
| CN | 207935270 | U | 10/2018 |
| CN | 207961582 | U | 10/2018 |
| CN | 207964530 | U | 10/2018 |
| CN | 108789848 | A | 11/2018 |
| CN | 108799473 | A | 11/2018 |
| CN | 108868675 | A | 11/2018 |
| CN | 208086829 | U | 11/2018 |
| CN | 208089263 | U | 11/2018 |
| CN | 208169068 | U | 11/2018 |
| CN | 108979569 | A | 12/2018 |
| CN | 109027662 | A | 12/2018 |
| CN | 109058092 | A | 12/2018 |
| CN | 208179454 | U | 12/2018 |
| CN | 208179502 | U | 12/2018 |
| CN | 208253147 | U | 12/2018 |
| CN | 208260574 | U | 12/2018 |
| CN | 109114418 | A | 1/2019 |
| CN | 109141990 | A | 1/2019 |
| CN | 208313120 | U | 1/2019 |
| CN | 208330319 | U | 1/2019 |
| CN | 208342730 | U | 1/2019 |
| CN | 208430982 | U | 1/2019 |
| CN | 208430986 | U | 1/2019 |
| CN | 109404274 | A | 3/2019 |
| CN | 109429610 | A | 3/2019 |
| CN | 109491318 | A | 3/2019 |
| CN | 109515177 | A | 3/2019 |
| CN | 109526523 | A | 3/2019 |
| CN | 109534737 | A | 3/2019 |
| CN | 208564504 | U | 3/2019 |
| CN | 208564516 | U | 3/2019 |
| CN | 208564525 | U | 3/2019 |
| CN | 208564918 | U | 3/2019 |
| CN | 208576026 | U | 3/2019 |
| CN | 208576042 | U | 3/2019 |
| CN | 208650818 | U | 3/2019 |
| CN | 208669244 | U | 3/2019 |
| CN | 109555484 | A | 4/2019 |
| CN | 109682881 | A | 4/2019 |
| CN | 208730959 | U | 4/2019 |
| CN | 208735264 | U | 4/2019 |
| CN | 208746733 | U | 4/2019 |
| CN | 208749529 | U | 4/2019 |
| CN | 208750405 | U | 4/2019 |
| CN | 208764658 | U | 4/2019 |
| CN | 109736740 | A | 5/2019 |
| CN | 109751007 | A | 5/2019 |
| CN | 208868428 | U | 5/2019 |
| CN | 208870761 | U | 5/2019 |
| CN | 109869294 | A | 6/2019 |
| CN | 109882144 | A | 6/2019 |
| CN | 109882372 | A | 6/2019 |
| CN | 209012047 | U | 6/2019 |
| CN | 209100025 | U | 7/2019 |
| CN | 110080707 | A | 8/2019 |
| CN | 110118127 | A | 8/2019 |
| CN | 110124574 | A | 8/2019 |
| CN | 110145277 | A | 8/2019 |
| CN | 110145399 | A | 8/2019 |
| CN | 110152552 | A | 8/2019 |
| CN | 110155193 | A | 8/2019 |
| CN | 110159225 | A | 8/2019 |
| CN | 110159432 | A | 8/2019 |
| CN | 110159433 | A | 8/2019 |
| CN | 110208100 | A | 9/2019 |
| CN | 110252191 | A | 9/2019 |
| CN | 110284854 | A | 9/2019 |
| CN | 110284972 | A | 9/2019 |
| CN | 209387358 | U | 9/2019 |
| CN | 110374745 | A | 10/2019 |
| CN | 209534736 | U | 10/2019 |
| CN | 110425105 | A | 11/2019 |
| CN | 110439779 | A | 11/2019 |
| CN | 110454285 | A | 11/2019 |
| CN | 110454352 | A | 11/2019 |
| CN | 110467298 | A | 11/2019 |
| CN | 110469312 | A | 11/2019 |
| CN | 110469314 | A | 11/2019 |
| CN | 110469405 | A | 11/2019 |
| CN | 110469654 | A | 11/2019 |
| CN | 110485982 | A | 11/2019 |
| CN | 110485983 | A | 11/2019 |
| CN | 110485984 | A | 11/2019 |
| CN | 110486249 | A | 11/2019 |
| CN | 110500255 | A | 11/2019 |
| CN | 110510771 | A | 11/2019 |
| CN | 110513097 | A | 11/2019 |
| CN | 209650738 | U | 11/2019 |
| CN | 209653968 | U | 11/2019 |
| CN | 209654004 | U | 11/2019 |
| CN | 209654022 | U | 11/2019 |
| CN | 209654128 | U | 11/2019 |
| CN | 209656622 | U | 11/2019 |
| CN | 107849130 | B | 12/2019 |
| CN | 110566173 | A | 12/2019 |
| CN | 110608030 | A | 12/2019 |
| CN | 110617187 | A | 12/2019 |
| CN | 110617188 | A | 12/2019 |
| CN | 110617318 | A | 12/2019 |
| CN | 209740823 | U | 12/2019 |
| CN | 209780827 | U | 12/2019 |
| CN | 209798631 | U | 12/2019 |
| CN | 209799942 | U | 12/2019 |
| CN | 209800178 | U | 12/2019 |
| CN | 209855723 | U | 12/2019 |
| CN | 209855742 | U | 12/2019 |
| CN | 209875063 | U | 12/2019 |
| CN | 110656919 | A | 1/2020 |
| CN | 110787667 | A | 2/2020 |
| CN | 110821464 | A | 2/2020 |
| CN | 110833665 | A | 2/2020 |
| CN | 110848028 | A | 2/2020 |
| CN | 210049880 | U | 2/2020 |
| CN | 210049882 | U | 2/2020 |
| CN | 210097596 | U | 2/2020 |
| CN | 210105817 | U | 2/2020 |
| CN | 210105818 | U | 2/2020 |
| CN | 210105993 | U | 2/2020 |
| CN | 110873093 | A | 3/2020 |
| CN | 210139911 | U | 3/2020 |
| CN | 110947681 | A | 4/2020 |
| CN | 111058810 | A | 4/2020 |
| CN | 111075391 | A | 4/2020 |
| CN | 210289931 | U | 4/2020 |
| CN | 210289932 | U | 4/2020 |
| CN | 210289933 | U | 4/2020 |
| CN | 210303516 | U | 4/2020 |
| CN | 111089003 | A | 5/2020 |
| CN | 111151186 | A | 5/2020 |
| CN | 111167769 | A | 5/2020 |
| CN | 111169833 | A | 5/2020 |
| CN | 111173476 | A | 5/2020 |
| CN | 111185460 | A | 5/2020 |
| CN | 111185461 | A | 5/2020 |
| CN | 111188763 | A | 5/2020 |
| CN | 111206901 | A | 5/2020 |
| CN | 111206992 | A | 5/2020 |
| CN | 111206994 | A | 5/2020 |
| CN | 210449044 | U | 5/2020 |
| CN | 210460875 | U | 5/2020 |
| CN | 210522432 | U | 5/2020 |
| CN | 210598943 | U | 5/2020 |
| CN | 210598945 | U | 5/2020 |

(56) References Cited

FOREIGN PATENT DOCUMENTS

| | | | |
|---|---|---|---|
| CN | 210598946 | U | 5/2020 |
| CN | 210599194 | U | 5/2020 |
| CN | 210599303 | U | 5/2020 |
| CN | 210600110 | U | 5/2020 |
| CN | 111219326 | A | 6/2020 |
| CN | 111350595 | A | 6/2020 |
| CN | 210660319 | U | 6/2020 |
| CN | 210714569 | U | 6/2020 |
| CN | 210769168 | U | 6/2020 |
| CN | 210769169 | U | 6/2020 |
| CN | 210769170 | U | 6/2020 |
| CN | 210770133 | U | 6/2020 |
| CN | 210825844 | U | 6/2020 |
| CN | 210888904 | U | 6/2020 |
| CN | 210888905 | U | 6/2020 |
| CN | 210889242 | U | 6/2020 |
| CN | 111397474 | A | 7/2020 |
| CN | 111412064 | A | 7/2020 |
| CN | 111441923 | A | 7/2020 |
| CN | 111441925 | A | 7/2020 |
| CN | 111503517 | A | 8/2020 |
| CN | 111515898 | A | 8/2020 |
| CN | 111594059 | A | 8/2020 |
| CN | 111594062 | A | 8/2020 |
| CN | 111594144 | A | 8/2020 |
| CN | 211201919 | U | 8/2020 |
| CN | 211201920 | U | 8/2020 |
| CN | 211202218 | U | 8/2020 |
| CN | 111608965 | A | 9/2020 |
| CN | 111664087 | A | 9/2020 |
| CN | 111677476 | A | 9/2020 |
| CN | 111677647 | A | 9/2020 |
| CN | 111692064 | A | 9/2020 |
| CN | 111692065 | A | 9/2020 |
| CN | 211384571 | U | 9/2020 |
| CN | 211397553 | U | 9/2020 |
| CN | 211397677 | U | 9/2020 |
| CN | 211412945 | U | 9/2020 |
| CN | 211500955 | U | 9/2020 |
| CN | 211524765 | U | 9/2020 |
| DE | 4004854 | A1 | 8/1991 |
| DE | 4241614 | A1 | 6/1994 |
| DE | 102009022859 | A1 | 12/2010 |
| DE | 102012018825 | A1 | 3/2014 |
| DE | 102013111655 | A1 | 12/2014 |
| DE | 102015103872 | A1 | 10/2015 |
| DE | 102013114335 | B4 | 12/2020 |
| EP | 0835983 | A2 | 4/1998 |
| EP | 1378683 | A3 | 8/2004 |
| EP | 2143916 | A1 | 1/2010 |
| EP | 2613023 | A2 | 7/2013 |
| EP | 3095989 | A1 | 11/2016 |
| EP | 3211766 | A1 | 8/2017 |
| EP | 3049642 | B1 | 4/2018 |
| EP | 3354866 | A1 | 8/2018 |
| EP | 3075946 | B1 | 5/2019 |
| FR | 2795774 | A1 | 1/2001 |
| GB | 474072 | A | 10/1937 |
| GB | 1438172 | A | 6/1976 |
| JP | S57135212 | A | 8/1982 |
| KR | 20020026398 | A | 4/2002 |
| RU | 13562 | U1 | 4/2000 |
| WO | 9320328 | A1 | 10/1993 |
| WO | 2006025886 | A2 | 3/2006 |
| WO | 2009023042 | A1 | 2/2009 |
| WO | 2011119668 | A1 | 9/2011 |
| WO | 2011133821 | A3 | 12/2011 |
| WO | 2012139380 | A1 | 10/2012 |
| WO | WO-2013158822 | A1 | 10/2013 |
| WO | WO-2013163786 | A1 | 11/2013 |
| WO | 2013185399 | A1 | 12/2013 |
| WO | 2015073005 | A1 | 5/2015 |
| WO | 2015158020 | A1 | 10/2015 |
| WO | 2016014476 | A1 | 1/2016 |
| WO | 2016033983 | A1 | 3/2016 |
| WO | 2016078181 | A1 | 5/2016 |
| WO | 2016086138 | A1 | 6/2016 |
| WO | 2016101374 | A1 | 6/2016 |
| WO | 2016112590 | A1 | 7/2016 |
| WO | 2016186790 | A1 | 11/2016 |
| WO | 2017146279 | A1 | 8/2017 |
| WO | 2017123656 | A3 | 10/2017 |
| WO | 2017213848 | A1 | 12/2017 |
| WO | 2018031031 | A1 | 2/2018 |
| WO | 2018031029 | A8 | 3/2018 |
| WO | 2018038710 | A1 | 3/2018 |
| WO | 2018044293 | A1 | 3/2018 |
| WO | 2018044307 | A1 | 3/2018 |
| WO | 2018071738 | A1 | 4/2018 |
| WO | 2018075034 | A8 | 5/2018 |
| WO | 2018084871 | A1 | 5/2018 |
| WO | 2018101912 | A1 | 6/2018 |
| WO | 2018106210 | A1 | 6/2018 |
| WO | 2018106225 | A1 | 6/2018 |
| WO | 2018106252 | A1 | 6/2018 |
| WO | 2018125176 | A1 | 7/2018 |
| WO | 2018132106 | A1 | 7/2018 |
| WO | 2018101909 | A8 | 8/2018 |
| WO | 2018152051 | A1 | 8/2018 |
| WO | 2018156131 | A1 | 8/2018 |
| WO | 2018160171 | A1 | 9/2018 |
| WO | 2018187346 | A1 | 10/2018 |
| WO | 2019045691 | A1 | 3/2019 |
| WO | 2019046680 | A1 | 3/2019 |
| WO | 2019060922 | A1 | 3/2019 |
| WO | 2019117862 | A1 | 6/2019 |
| WO | 2019126742 | A1 | 6/2019 |
| WO | 2019147601 | A1 | 8/2019 |
| WO | 2019169366 | A1 | 9/2019 |
| WO | 2019195651 | A1 | 10/2019 |
| WO | 2019200510 | A1 | 10/2019 |
| WO | 2019210417 | A1 | 11/2019 |
| WO | 2020018068 | A1 | 1/2020 |
| WO | 2020046866 | A1 | 3/2020 |
| WO | 2020076569 | A1 | 4/2020 |
| WO | 2020097060 | A2 | 5/2020 |
| WO | 2020104088 | A1 | 5/2020 |
| WO | 2020072076 | A8 | 6/2020 |
| WO | 2020131085 | A1 | 6/2020 |
| WO | 2020211083 | A1 | 10/2020 |
| WO | 2020211086 | A1 | 10/2020 |
| WO | 2021038604 | A1 | 3/2021 |
| WO | 2021041783 | A1 | 3/2021 |

OTHER PUBLICATIONS

"Honghua developing new-generation shale-drilling rig, plans testing of frac pump"; Katherine Scott; Drilling Contractor; May 23, 2013; accessed at https://www.drillingcontractororg/honghua-developing-new-generation-shale-drilling-rig-plans-testing-of-frac-pump-23278.

2011 Publications and Services, American Petroleum Institute (2011).

2012 High Horsepower Summit Agenda, Natural Gas for High Horsepower Applications (Sep. 5, 2012).

35% Economy Increase, Dual-fuel System Highlighting Jereh Apollo Frac Pumper, Jereh Group (Apr. 13, 2015), https://www.jereh.com/en/news/press-release/news-detail-7345.htm.

About API, American Petroleum Institute, https://www.api.org /about, accessed Dec. 30, 2021.

About API, American Petroleum Institute, WaybackMachine Capture, https://web.archive.org/web/20110422104346 /http://api.org/aboutapi/, captured Apr. 22, 2011.

Advances in Popular Torque-Link Solution Offer OEMs Greater Benefit, Jun. 21, 2018.

AFD Petroleum Ltd., Automated Hot Zone, Frac Refueling System, Dec. 2018.

AFGlobal Corporation, Durastim Hydraulic Fracturing Pump, A Revolutionary Design for Continuous Duty Hydraulic Fracturing, 2018.

American Petroleum Institute. API 616: Gas Turbines for the Petroleum, Chemical, and Gas Industry Services. 5th ed. Washington, DC: API Publishing Services, 2011.

(56) References Cited

OTHER PUBLICATIONS

American Petroleum Institute. API 674: Positive Displacement Pumps-Reciprocating. 3rd ed. Washington, DC: API Publishing Services, 2010.
Ankit Tiwari, Design of a Cooling System for a Hydraulic Fracturing Equipment, The Pennsylvania State University, The Graduate School, College of Engineering, 2015.
API Member Companies, American Petroleum Institute, WaybackMachine Capture, https://web.archive.org/web/20130424080625/http://api.org/globalitems/globalheaderpages/membership/api-member-companies, accessed Jan. 4, 2021.
API's Global Industry Services, American Petroleum Institute, © Aug. 2020.
Arop, Julius Bankong. Geomechanical review of hydraulic fracturing technology. Thesis (M. Eng.). Cambridge, MA: Massachusetts Institute of Technology, Dept. of Civil and Environmental Engineering. Oct. 29, 2013. https://dspace.mit.edu/handle/1721.1/82176.
B.M. Mahlalela, et al., .Electric Power Generation Potential Based on Waste Heat and Geothermal Resources in South Africa, pangea.Stanford.edu (Feb. 11, 2019).
Blago Minovski, Coupled Simulations of Cooling and Engine Systems for Unsteady Analysis of the Benefits of Thermal Engine Encapsulation, Department of Applied Mechanics, Chalmers University of Technology G?teborg, Sweden 2015.
Business Week: Fiber-optic cables help fracking, cablinginstall.com. Jul. 12, 2013. https://www.cablinginstall.com/cable/article/16474208/businessweek-fiberoptic-cables-help-fracking.
Cameron, A Schlumberger Company, Frac Manifold Systems, 2016.
CanDyne Pump Services, Inc. Weatherford Q700 Pump. Calgary, Alberta, Canada: CanDyne Pump Services. Aug. 15, 2015. http://candyne.com/wp-content/uploads/2014/181905-94921.q700-quintuplex-pump.pdf.
Capstone Turbine Corporation, Capstone Receives Three Megawatt Order from Large Independent Oil & Gas Company in Eagle Ford Shale Play, Dec. 7, 2010.
Chaichan, Miqdam Tariq. "The impact of equivalence ratio on performance and emissions of a hydrogen-diesel dual fuel engine with cooled exhaust gas recirculation." International Journal of Scientific & Engineering Research 6.6 (2015): 938-941.
Chun, M. K., H. K. Song, and R. Lallemand. "Heavy duty gas turbines in petrochemical plants: Samsung's Daesan plant (Korea) beats fuel flexibility records with over 95% hydrogen in process gas." Proceedings of PowerGen Asia Conference, Singapore. 1999.
CNG Delivery, Fracturing with natural gas, dual-fuel drilling with CNG, Aug. 22, 2019.
Cooper et al., Jet Frac Porta-Skid—A New Concept in Oil Field Service Pump Equipments[sic]; Halliburton Services; SPE-2706 (1969).
De Gevigney et al., "Analysis of no-load dependent power losses in a planetary gear train by using thermal network method", International Gear Conference 2014: Aug. 26-28, 2014, Lyon, pp. 615-624.
Department of Energy, United States of America, The Water-Energy Nexus: Challenges and Opportunities purenergypolicy.org (Jun. 2014).
Dowell B908 "Turbo-Jet" Operator's Manual.
Dziubak, Tadeusz, "Experimental Studies of Dust Suction Irregularity from Multi-Cyclone Dust Collector of Two-Stage Air Filter", Energies 2021, 14, 3577, 28 pages.
Ecob, David J., et al. "Design and Development of a Landfill Gas Combustion System for the Typhoon Gas Turbine." ASME 1996 International Gas Turbine and Aeroengine Congress and Exhibition. American Society of Mechanical Engineers Digital Collection, 1996.
Elle Seybold, et al., Evolution of Dual Fuel Pressure Pumping for Fracturing: Methods, Economics, Field Trial Results and Improvements in Availability of Fuel, Copyright 2013, Society of Petroleum Engineers, SPE 166443.
Emmanuel Akita et al., Mewbourne College of Earth & Energy, Society of Petroleum Engineers; Drilling Systems Automation Technical Section (DSATS); 2019.
EMPengieering.com, HEMP Resistant Electrical Generators / Hardened Structures HEMP/GMD Shielded Generators, Virginia.
Europump and Hydrualic Institute, Variable Speed Pumping: A Guide to Successful Applications, Elsevier Ltd, 2004.
Eygun, Christiane, et al., URTeC: 2687987, Mitigating Shale Gas Developments Carbon Footprint: Evaluating and Implementing Solutions in Argentina, Copyright 2017, Unconventional Resources Technology Conference.
Ferdinand P. Beer et al., Mechanics of Materials (6th ed. 2012).
Filipovi?, Ivan, Preliminary Selection of Basic Parameters of Different Torsional Vibration Dampers Intended for use in Medium-Speed Diesel Engines, Transactions of Famena XXXVI-3 (2012).
Final written decision of PGR2021-00102 dated Feb. 6, 2023.
Final written decision of PGR2021-00103 dated Feb. 6, 2023.
FMC Technologies, Operation and Maintenance Manual, L06 Through L16 Triplex Pumps Doc No. OMM50000903 Rev: E p. 1 of 66. Aug. 27, 2009.
Frac Shack, Bi-Fuel FracFueller brochure, 2011.
Frac Tank Hose (FRAC), 4starhose.com. Accessed: Nov. 10, 2019. http://www.4starhose.com/product/frac_tank_hose_frac.aspx.
Fracking companies switch to electric motors to power pumps, iadd-intl.org. Jun. 27, 2019. https://www.iadd-intl.org/articles/fracking-companies-switch-to-electric-motors-to-power-pumps/.
Fracture Design and Stimulation, Mike Eberhard, P.E., Wellconstruction & Operations Technical Workshop Insupport of the EPA Hydraulic Fracturing Study, Mar. 10-11, 2011.
FTS International's Dual Fuel Hydraulic Fracturing Equipment Increases Operational Efficiencies, Provides Cost Benefits, Jan. 3, 2018.
Gardner Denver Hydraulic Fracturing Pumps GD 3000 https://www.gardnerdenver.com/en-us/pumps/triplex-fracking-pump-gd-3000.
*General Purpose* vs. *Special Purpose Couplings*, Jon Mancuso, Proceedings of the Twenty-Third Turbomachinerysymposium (1994).
Ginter, Timothy, and Thomas Bouvay. "Uprate options for the MS7001 heavy duty gas turbine." GE paper GER-3808C, GE Energy 12 (2006).
Green Field Energy Services Deploys Third New Hydraulic Fracturing System, Green Field Energy Services, Inc. (Jul. 11, 2012), https://www.prnewswire.com/news-releases/green-field-energy-services-deploys-third-new-hydraulic-fracturing-spread-162113425.
Green Field Energy Services Natural Gas Driven Turbine Frac Pumps HHP Summit Presentation, Yumpu (Sep. 2012), https://www.yumpu.com/en/document/read/49685291/turbine-frac-pump-assembly-hhp ("Green Field").
Halliburton, Vessel-based Modular Solution (VMS), 2015.
HCI Jet Frac, Screenshots from YouTube, Dec. 11, 2010. https://www.youtube.com/watch?v=6HjXkdbFaFQ.
Hydraulic Fracturing: Gas turbine proves successful in shale gasfield operations, Vericor (2017), https://www.vericor.com/wp-content/uploads/2020/02/7.-Fracing-4500hp-Pump-China-En.pdf ("Vericor Case Study").
Ibragimov, ?. S., Use of gas turbine engines in oil field pumping units; Chem Petrol Eng; (1994) 30: 530. https://doi.org/10.1007/BF01154919. (Translated from Khimicheskaya i Neftyanoe Mashinostroenie, No. 11, pp. 24-26, Nov. 1994.).
IHS Markit Standards Store, https://global.ihs.com/doc_ detail.cfm?document_name=API%20STD%20674&item_s_key=00010672#doc-detail-history-anchor, accessed Dec. 30, 2021; and https://global.ihs.com/ doc_detail.cfm?&input_doc _number=671&input_doc_title=&document_name=API%20STD%20671&item_s_key=00010669&item_key_date=890331&origin=DSSC, accessed Dec. 30, 2021.
Integrated Flow, Skid-mounted Modular Process Systems, https://ifsolutions.com/.
International Search Report and Written Opinion for PCT/US2022/030647, dated Oct. 7, 2022.
ISM, What is Cracking Pressure, 2019.
I-VI Marlow Industries, Thermoelectric Technologies in Oil, Gas, and Mining Industries, blog.marlow.com (Jul. 24, 2019).

(56) References Cited

OTHER PUBLICATIONS

J. Porteiro et al., Feasibility of a new domestic CHP trigeneration with heat pump: II. Availability analysis. Design and development, Applied Thermal Engineering 24 (2004) 1421-1429.
JBG Enterprises, Inc., WS-Series Blowout Prevention Safety Coupling—Quick Release Couplings, http://www.jgbhose.com/products/WS-Series-Blowout-Prevention-Safety-Coupling.asp.
Jereh Apollo 4500 Turbine Frac Pumper Finishes Successful Field Operation in China, Jereh Group (Feb. 13, 2015), as available on Apr. 20, 2015, https://web.archive.org/web/20150420220625/https://www. prnewswire.com/news-releases/jereh-apollo-4500-turbine-frac-pumper-finishes-successful-field-operation-in-china-300035829.html.
Jereh Apollo Turbine Fracturing Pumper Featured on China Central Television, Jereh Group (Mar. 9, 2018), https://www.jereh.com/en/news/press-release/news-detail-7267.htm.
Jereh Debut's Super power Turbine Fracturing Pump, Leading the Industrial Revolution, Jereh Oilfield Services Group (Mar. 19, 2014), https://www.prnewswire.com/news-releases/jereh-debuts-super-power-turbine-fracturing-pump-leading-the-industrial-revolution-250992111.html.
Jereh Group, Jereh Fracturing Equipment. YouTube (Jun. 8, 2015), https://www.youtube.com/watch?v=m0vMiq84P4Q.
Jereh Group, Jereh Fracturing Unit, Fracturing Spread, YouTube (Mar. 30, 2015), https://www.youtube.com/watch?v=PIkDbU5dE0o.
Jereh Unveiled New Electric Fracturing Solution at OTC 2019, Jereh Group (May 7, 2019), as available on May 28, 2019, https://web.archive.org/web/20190528183906/https://www.prnewswire .com/news-releases/jereh-unveiled-new-electric-fracturing-solution-at-otc-2019-300845028.html.
Jp Yadav et al., Power Enhancement of Gas Turbine Plant by Intake Air Fog Cooling, Jun. 2015.
Karassik, Igor, Joseph Messina, Paul Cooper, and Charles Heald. Pump Handbook. 4th ed. New York: McGraw-Hill Education, 2008.
Karen Boman, Turbine Technology Powers Green Field Multi-Fuel Frack Pump, Rigzone (Mar. 7, 2015), as available on Mar. 14, 2015, https://web.archive.org/web/20150314203227/https://www.rigzone.com/news/oil-gas/a/124883/Turbine_Technology_Powers_Green_Field_MultiFuel_Frack_Pump.
Kas'yanov et al., Application of gas-turbine engines in pumping units complexes of hydraulic fracturing of oil and gas reservoirs; Exposition Oil & Gas; (Oct. 2012) (published in Russian).
Lekontsev, Yu M., et al. "Two-side sealer operation." Journal of Mining Science 49.5 (2013): 757-762.
Leslie Turj, Green Field asset sale called 'largest disposition industry has seen,' The INDsider Media (Mar. 19, 2014), http://theind.com/ article-16497-green-field-asset-sale-called-%E2%80%98largest-disposition-industry-has-seen%60.html.
M. Ahmadzadehtalatapeh et al. Performance enhancement of gas turbine units by retrofitting with inlet air cooling technologies (IACTs): an hour-by-hour simulation study, Journal of the Brazilian Society of Mechanical Sciences and Engineering, Mar. 2020.
Marine Turbine Technologies, 1 MW Power Generation Package, http://marineturbine.com/power-generation, 2017.
Marine Turbine. Turbine Powered Frac Units. Franklin, Louisiana: Marine Turbine Technologies, 2020.
Mee Industries: Inlet Air Fogging Systems for Oil, Gas and Petrochemical Processing, Verdict Media Limited Copyright 2020.
Mobile Fuel Delivery, atlasoil.com. Mar. 6, 2019. https://www.atlasoil.com/nationwide-fueling/onsite-and-mobile-fueling.
Neal, J.C. (Gulf Oil Corp. Odessa Texas), Gas Turbine Driven Centrifugal Pumps for High Pressure Water Injection; American Institute of Mining, Metallurgical and Petroleum Engineers, Inc.; SPE-1888 (1967).
Overview of Industry Guidance/Best Practices on Hydraulic Fracturing (HF), American Petroleum Institute, © 2012.
PbNG, Natural Gas Fuel for Drilling and Hydraulic Fracturing, Diesel Displacement / Dual Fuel & Bi-Fuel, May 2014.
Pettigrew, Dana, et al., High Pressure Multi-Stage Centrifugal Pump for 10,000 psi Frac Pump_13 HPHPS Frac Pump, Copyright 2013, Society of Petroleum Engineers, SPE 166191.
Plos One, Dynamic Behavior of Reciprocating Plunger Pump Discharge Valve Based on Fluid Structure Interaction and Experimental Analysis. Oct. 21, 2015.
Porter, John A. (Solar Division International Harvester Co.), Modern Industrial Gas Turbines for the Oil Field; American Petroleum Institute; Drilling and Production Practice; API-67-243 (Jan. 1, 1967).
PowerShelter Kit II, nooutage.com, Sep. 6, 2019.
Procedures for Standards Development, American Petroleum Institute, Third Edition (2006).
Publications, American Petroleum Institute, WaybackMachine Capture, https://web.archive.org/web/20110427043936 /http://www.api.org:80/Publications/, captured Apr. 27, 2011.
Pump Control With Variable Frequency Drives, Kevin Tory, Pumps & Systems: Advances in Motors and Drives, Reprint from Jun. 2008.
Researchgate, Answer by Byron Woolridge, found at https://www.researchgate.net/post/How_can_we_improve_the_efficiency_of_the_gas_turbine_cycles, Jan. 1, 2013.
Review of HHP Summit 2012, Gladstein, Neandross & Associates https://www.gladstein.org/gna-conferences/high-horsepower-summit-2012/.
Rigmaster Machinery Ltd., Model: 2000 RMP-B-PLEX, brochure, downloaded at https://www.rigmaslerrnachinery.com_files/ugd/431e62_eaecd77c9fe54af8b13d08396072da67.pdf.
Rotating Right. Quintuplex Power Pump Model Q700. Edmonton, Alberta, Canada: Weatherford International Ltd. https://www.rotatingright.com/pdf/weatherford/RR%2026-Weatherford%20Model%20Q2700.pdf, 2021.
Shandong Saigao Group Corporation. Q4 (5W115) Quintuplex Plunger Pump. Jinan City, Shandong Province, China; Saigao. Oct. 20, 2014. https://www.saigaogroup.com/product/q400-5w115-quintuplex-plunger-pump.html.
Special-Purpose Couplings for Petroleum, Chemical, and Gas Industry Services, API Standard 671 (4th Edition) (2010).
SPM® QEM 5000 E-Frac Pump Specification Sheet, Weir Group (2019) ("Weir 5000").
Standards, American Petroleum Institute, WaybackMachine Capture, https://web.archive.org/web/20110207195046/http:/www.api.org/Standards/, captured Feb. 7, 2011; and https://web.archive.org/web/20110204112554/http://global.ihs.com/?RID=API1, captured Feb. 4, 2011.
Swagelok, The right valve for controlling flow direction? Check, 2016.
Technology.org, Check valves how do they work and what are the main type, 2018.
The Application of Flexible Couplings for Turbomachinery, Jon R.Mancuso et al., Proceedings of the Eighteenthturbomachinery Symposium (1989).
The Leader in Frac Fueling, suncoastresources.com. Jun. 29, 2015. https://web.archive.org/web/20150629220609/https://www.suncoastresources.com/oilfield/fueling-services/.
The Weir Group, Inc. Weir SPM Pump Product Catalog. Ft. Worth, TX: S.P.M. Flow Control, Inc. Oct. 30, 2017. https://manage.global.weir/assets/files/product%20brochures/SPM_2P140706_Pump_Product_Catalogue_View.pdf.
Tom Hausfeld, GE Power & Water, and Eldon Schelske, Evolution Well Services, TM2500+ Power for Hydraulic Fracturing.
Transcript of Jereh Group, Jereh Fracturing Equipment, YouTube (Jun. 8, 2015), https://www.youtube.com/watch?v=m0vMiq84P4Q.
Transcript of Jereh Group, Jereh Fracturing Unit, Fracturing Spread, YouTube (Mar. 30, 2015).
US 11,459,865, 10/2022, Cui et al. (withdrawn).
US 11,555,493, 01/2023, Chang et al. (withdrawn).
Wallace, E.M., Associated Shale Gas: From Flares to Rig Power, Copyright 2015, Society of Petroleum Engineers, SPE-173491-MS.
Walzel, Brian, Hart Energy, Oil, Gas Industry Discovers Innovative Solutions to Environmental Concerns, Dec. 10, 2018.
Weir Oil & Gas Introduces Industry's First Continuous Duty 5000-Horsepower Pump, Weir Group (Jul. 25, 2019),

(56) References Cited

OTHER PUBLICATIONS https://www.global. weir/newsroom/news-articles/weir-oil-and-gas-introduces-industrys-first-continuous-duty-5000-horsepower-pump/.
Weir SPM. Weir SPM General Catalog: Well Service Pumps, Flow Control Products, Manifold Trailers, Safety Products, Post Sale Services. Ft. Worth, TX: Weir Oil & Gas. May 28, 2016. https://www.pumpfundamentals.com/pumpdatabase2/weir-spm-general.pdf.
Wikipedia, Westinghouse Combustion Turbine Systems Division, https://en.wikipedia.org/wiki/Westinghouse_Combustion_Turbine_Systems_Division, circa 1960.
Wikipedia,Union Pacific GTELs, https://en.wikipedia.org/wiki/Union_Pacific_GTELs, circa 1950.
Williams, C.W. (Gulf Oil Corp. Odessa Texas), The Use of Gas-turbine Engines in an Automated High-Pressure Water-Injection Stations; American Petroleum Institute; API-63-144 (Jan. 1, 1963).
Wolf, J?rgen J., and Marko A. Perkavec. "Safety Aspects and Environmental Considerations for a 10 MW Cogeneration Heavy Duty Gas Turbine Burning Coke Oven Gas with 60% Hydrogen Content." ASME 1992 International Gas Turbine and Aeroengine Congress and Exposition. American Society of Mechanical Engineers Digital Collection, 1992.
WorldCat Library Collections Database Records for API Standard 671 and API Standard 674, https://www.worldcat.org/title/positive-displacement-pumps-reciprocating/oclc/ 858692269&referer=brief_results, accessed Dec. 30, 2021; and https://www.worldcat.org/title/special-purpose-couplings-for-petroleum-chemical-and-gas-industry-services/oclc/871254217&referer=brief_results, accessed Dec. 22, 2021.
Zsi-Foster, Energy | Solar | Fracking | Oil and Gas, https://www.zsi-foster.com/energy-solar-fracking-oil-and-gas.html.

* cited by examiner

SYSTEMS AND METHODS TO OPERATE HYDRAULIC FRACTURING UNITS USING AUTOMATIC FLOW RATE AND/OR PRESSURE CONTROL

CROSS-REFERENCE TO RELATED APPLICATIONS

This application is a continuation of U.S. Non-Provisional application Ser. No. 17/248,485, filed Jan. 27, 2021, titled "SYSTEMS AND METHODS TO OPERATE HYDRAULIC FRACTURING UNITS USING AUTOMATIC FLOW RATE AND/OR PRESSURE CONTROL" which is a continuation-in-part of U.S. Non-Provisional application Ser. No. 17/248,484, filed Jan. 27, 2021, titled "SYSTEMS AND METHODS TO OPERATE HYDRAULIC FRACTURING UNITS USING AUTOMATIC FLOW RATE AND/OR PRESSURE CONTROL" which claims priority to and the benefit of, under 35 U.S.C. § 119(e), U.S. Provisional Application No. 62/705,328, filed Jun. 22, 2020, titled "SYSTEMS AND METHODS TO OPERATE HYDRAULIC FRACTURING UNITS USING AUTOMATIC FLOW RATE AND/OR PRESSURE CONTROL", U.S. Provisional Application No. 62/705,369, filed Jun. 24, 2020, titled "SYSTEMS AND METHODS PROVIDING A CONFIGURABLE STAGED RATE INCREASE FUNCTION TO OPERATE HYDRAULIC FRACTURING UNITS", and U.S. Provisional Application No. 62/705,649, filed Jul. 9, 2020, titled "SYSTEMS AND METHODS PROVIDING A CONFIGURABLE STAGED RATE INCREASE FUNCTION TO OPERATE HYDRAULIC FRACTURING UNITS", the disclosures of all of which are incorporated herein by reference in their entirety.

TECHNICAL FIELD

The present disclosure relates to systems and methods for providing configurable staged rate increase function to operate hydraulic fracturing units and, more particularly, to systems and methods for providing configurable staged rate increase function to operate hydraulic fracturing units to pump fracturing fluid into a wellhead.

BACKGROUND

Hydrocarbon exploration and energy industries employ various systems and operations to accomplish activities including drilling, formation evaluation, stimulation, and production. Hydraulic fracturing may be utilized to produce oil and gas economically from low permeability reservoir rocks or other formations, for example, shale, at a wellsite. During a hydraulic fracturing stage, slurry may be pumped, via hydraulic fracturing pumps, under high pressure to perforations, fractures, pores, faults, or other spaces in the reservoir rocks or formations. The slurry may be pumped at a rate faster than the reservoir rocks or formation may accept. As the pressure of the slurry builds, the reservoir rocks or formation may fail and begin to fracture further. As the pumping of the slurry continues, the fractures may expand and extend in different directions away from a well bore. Once the reservoir rocks or formations are fractured, the hydraulic fracturing pumps may remove the slurry. As the slurry is removed, proppants in the slurry may be left behind and may "prop" or keep open the newly formed fractures, thus preventing the newly formed fractures from closing or, at least, reducing contraction of the newly formed fractures. After the slurry is removed and the proppants are left behind, production streams of hydrocarbons may be obtained from the reservoir rocks or formation.

Prime movers may be used to supply power to hydraulic fracturing pumps for pumping the fracturing fluid into the formation. For example, a plurality of gas turbine engines and/or reciprocating-piston engines may each be mechanically connected to a corresponding hydraulic fracturing pump via a transmission and operated to drive the hydraulic fracturing pump. The prime mover, hydraulic fracturing pump, transmission, and auxiliary components associated with the prime mover, hydraulic fracturing pump, and transmission may be connected to a common platform or trailer for transportation and set-up as a hydraulic fracturing unit at the site of a fracturing operation, which may include up to a dozen or more of such hydraulic fracturing units operating together to perform the fracturing operation.

A hydraulic fracturing operation may include a plurality of hydraulic fracturing stages. Each hydraulic fracturing stage may require configuration of many and various hydraulic fracturing equipment. For example, prior to a next hydraulic fracturing stage, an operator or user may enter multiple data points for the next hydraulic fracturing stage for each piece of equipment, such as, for hydraulic fracturing pumps, a blender, a chemical additive unit, a hydration unit, a conveyor, and/or other hydraulic fracturing equipment located at the wellsite. As each hydraulic fracturing stage arises, data entry or other inputs at each piece of hydraulic fracturing equipment may not be performed efficiently and effectively.

Partly due to the large number of components of a hydraulic fracturing system, it may be difficult to efficiently and effectively control the output of the numerous hydraulic fracturing units and related components. For example, during a fracturing operation, it may be necessary to reduce the output of one or more of the hydraulic fracturing pumps in a coordinated manner, for example, when unexpected well screen-out or over-pressure conditions occur while conducting the fracturing operation. During such occurrences, as well as others, it may be necessary to quickly adjust the outputs of the numerous hydraulic fracturing pumps to reduce the likelihood of equipment damage, which may lead to expensive repairs and excessive down time. In addition, during the start-up of a fracturing operation, as the hydraulic fracturing units increase the output of fracturing fluid, it may be desirable to control the rate at which the outputs of the respective hydraulic fracturing units increase, for example, to prevent damage to the hydraulic fracturing pumps due to uncontrolled over-speed events. Due to the numerous hydraulic fracturing units, this may be difficult and complex. In addition, as a fracturing operation approaches completion, it may be desirable to control the rate at which the hydraulic fracturing units decrease their respective outputs. Due to the numerous hydraulic fracturing units, this may be difficult and complex to execute efficiently and effectively.

Accordingly, Applicant has recognized a need for systems and methods that provide improved operation of hydraulic fracturing units during hydraulic fracturing operations. The present disclosure may address one or more of the above-referenced drawbacks, as well as other possible drawbacks.

SUMMARY

As referenced above, due to the complexity of a hydraulic fracturing operation and the high number of machines involved, it may be difficult to efficiently and effectively control the output of the numerous hydraulic fracturing units and related components to perform the hydraulic fracturing operation. In addition, manual control of the hydraulic fracturing units by an operator or user may result in delayed or ineffective responses to problems that may occur during the hydraulic fracturing operation, such as well screen-out, over-pressure events, and over speeding of the hydraulic fracturing pumps as the hydraulic fracturing units come up to operating speed. Insufficiently prompt responses to such events may lead to premature equipment wear or damage, which may reduce efficiency and lead to delays in completion of a hydraulic fracturing operation.

The present disclosure generally is directed to systems and methods for operating hydraulic fracturing units to pump fracturing fluid into a wellhead. For example, in some embodiments, the systems and methods may provide semi- or fully-autonomous operation of a plurality of hydraulic fracturing units, for example, during start-up, operation, and/or completion of operation of the plurality of hydraulic fracturing units following a hydraulic fracturing operation.

According to some embodiments, a method of operating a plurality of hydraulic fracturing units, each of the hydraulic fracturing units including a hydraulic fracturing pump to pump fracturing fluid into a wellhead and an internal combustion engine to drive the hydraulic fracturing pump, may include receiving, via a supervisory controller, one or more rate ramp signals indicative of a rate ramp operational mode to control a flow rate associated with pumping fracturing fluid into a wellhead. The method also may include receiving, via a supervisory controller, one or more operational parameters associated with pumping fracturing fluid into a wellhead. The one or more operational parameters may include one or more of a target flow rate, a maximum flow rate, a target pressure, or a pressure range for fracturing fluid supplied to the wellhead. The method also may include determining, via the supervisory controller, whether the plurality of hydraulic fracturing units have a capacity sufficient to achieve the one or more of the target flow rate or the target pressure. The method further may include initiating operation of at least some of the plurality of hydraulic fracturing units, and increasing a flow rate from the at least some of the hydraulic fracturing units according to a controlled increasing flow rate schedule toward the one or more of the target flow rate or the target pressure. The controlled increasing flow rate schedule may be configured to cause operation of the hydraulic fracturing units, such that a flow rate of fracturing fluid does not exceed the maximum flow rate and a fracturing fluid pressure substantially remains within the pressure range. The method further still may include determining whether the at least some of the hydraulic fracturing units have achieved the one or more of the target flow rate or the target pressure. When it has been determined that the one or more of the target flow rate or the target pressure has been achieved, the method also may include operating the at least some hydraulic fracturing units to maintain one or more of the target flow rate or the target pressure. When it has been determined that the target flow rate has not been achieved, the method also may include generating one or more signals indicative of a failure to achieve the target flow rate. When it has been determined that the target pressure has not been achieved, the method further may include operating the at least some hydraulic fracturing units to maintain a maximum flow rate.

According some embodiments, a hydraulic fracturing control assembly to operate a plurality of hydraulic fracturing units, each of the hydraulic fracturing units including a hydraulic fracturing pump to pump fracturing fluid into a wellhead and an internal combustion engine to drive the hydraulic fracturing pump, may include an input device configured to facilitate communication of rate ramp signals indicative of a rate ramp operational mode to control a flow rate associated with pumping fracturing fluid into a wellhead, and operational parameters to a supervisory controller. The one or more operational parameters may include one or more of a target flow rate, a maximum flow rate, a target pressure, or a pressure range. The hydraulic fracturing assembly further may include one or more sensors configured to generate one or more sensor signals indicative of one or more of a flow rate of fracturing fluid or a pressure associated with fracturing fluid. The hydraulic fracturing control assembly may further still include a supervisory controller in communication with one or more of the plurality of hydraulic fracturing units, the input device, or the one or more sensors. The supervisory controller may be configured to receive one or more operational parameters associated with pumping fracturing fluid into a wellhead. The one or more operational parameters may include one or more of a target flow rate or a target pressure for fracturing fluid supplied to the wellhead. The supervisory controller also may be configured to determine whether the plurality of hydraulic fracturing units have a capacity sufficient to achieve the one or more of the target flow rate or the target pressure. The supervisory controller further may be configured to increase a flow rate from at least some of the hydraulic fracturing units according to a controlled increasing flow rate schedule toward the one or more of the target flow rate or the target pressure. The controlled increasing flow rate schedule may be configured to cause operation of the hydraulic fracturing units, such that a flow rate of fracturing fluid does not exceed the maximum flow rate and a fracturing fluid pressure substantially remains within the pressure range. The supervisory controller still further may be configured to determine, based at least in part on the one or more sensor signals indicative of one or more of the flow rate of fracturing fluid or the pressure associated with fracturing fluid, whether the at least some of the hydraulic fracturing units have achieved the one or more of the target flow rate or the target pressure. When it has been determined that the one or more of the target flow rate or the target pressure has been achieved, the supervisory controller may be configured to operate the at least some hydraulic fracturing units to maintain one or more of the target flow rate or the target pressure. When it has been determined that the target flow rate has not been achieved, the supervisory controller may be configured to generate one or more signals indicative of a failure to achieve the target flow rate. When it has been determined that the target pressure has not been achieved, the supervisory controller may be configured to operate the at least some hydraulic fracturing units to maintain a maximum flow rate.

According to some embodiments, a hydraulic fracturing system may include a plurality of hydraulic fracturing units. Each of the hydraulic fracturing units may include a hydraulic fracturing pump to displace fracturing fluid into a wellhead and an internal combustion engine to drive the hydraulic fracturing pump. The hydraulic fracturing system also may include an input device configured to facilitate communication of rate ramp signals indicative of a rate ramp operational mode to control a flow rate associated with pumping fracturing fluid into a wellhead, and operational parameters to a supervisory controller. The one or more operational parameters may include one or more of a target flow rate, a maximum flow rate, a target pressure, or a pressure range for fracturing fluid supplied to the wellhead. The hydraulic fracturing system further may include one or more sensors configured to generate one or more sensor signals indicative of one or more of a flow rate of fracturing fluid or a pressure associated with fracturing fluid. The hydraulic fracturing system still further may include a supervisory controller in communication with one or more of the plurality of hydraulic fracturing units, the input device, or the one or more sensors. The supervisory controller may be configured to receive one or more operational parameters associated with pumping fracturing fluid into a wellhead. The one or more operational parameters may include one or more of a target flow rate or a target pressure for fracturing fluid supplied to the wellhead. The supervisory controller also may be configured to determine whether the plurality of hydraulic fracturing units have a capacity sufficient to achieve the one or more of the target flow rate or the target pressure. The supervisory controller further may be configured to increase a flow rate from at least some of the hydraulic fracturing units according to a controlled increasing flow rate schedule toward the one or more of the target flow rate or the target pressure. The controlled increasing flow rate schedule may be configured to cause operation of the hydraulic fracturing units, such that a flow rate of fracturing fluid does not exceed the maximum flow rate and a fracturing fluid pressure substantially remains within the pressure range. The supervisory controller still further may be configured to determine, based at least in part on the one or more sensor signals indicative of one or more of the flow rate of fracturing fluid or the pressure associated with fracturing fluid, whether the at least some of the hydraulic fracturing units have achieved the one or more of the target flow rate or the target pressure. When it has been determined that the one or more of the target flow rate or the target pressure has been achieved, the supervisory controller may be configured to operate the at least some hydraulic fracturing units to maintain one or more of the target flow rate or the target pressure. When it has been determined that the target flow rate has not been achieved, the supervisory controller may be configured to generate one or more signals indicative of a failure to achieve the target flow rate. When it has been determined that the target pressure has not been achieved, the supervisory controller may be configured to operate the at least some hydraulic fracturing units to maintain a maximum flow rate.

Still other aspects and advantages of these exemplary embodiments and other embodiments, are discussed in detail herein. Moreover, it is to be understood that both the foregoing information and the following detailed description provide merely illustrative examples of various aspects and embodiments, and are intended to provide an overview or framework for understanding the nature and character of the claimed aspects and embodiments. Accordingly, these and other objects, along with advantages and features of the present disclosure herein disclosed, will become apparent through reference to the following description and the accompanying drawings. Furthermore, it is to be understood that the features of the various embodiments described herein are not mutually exclusive and may exist in various combinations and permutations.

BRIEF DESCRIPTION OF THE DRAWINGS

The accompanying drawings, which are included to provide a further understanding of the embodiments of the present disclosure, are incorporated in and constitute a part of this specification, illustrate embodiments of the present disclosure, and together with the detailed description, serve to explain principles of the embodiments discussed herein. No attempt is made to show structural details of this disclosure in more detail than can be necessary for a fundamental understanding of the embodiments discussed herein and the various ways in which they can be practiced. According to common practice, the various features of the drawings discussed below are not necessarily drawn to scale. Dimensions of various features and elements in the drawings can be expanded or reduced to more clearly illustrate embodiments of the disclosure.

DETAILED DESCRIPTION

The drawings include like numerals to indicate like parts throughout the several views, the following description is provided as an enabling teaching of exemplary embodiments, and those skilled in the relevant art will recognize that many changes may be made to the embodiments described. It also will be apparent that some of the desired benefits of the embodiments described can be obtained by selecting some of the features of the embodiments without utilizing other features. Accordingly, those skilled in the art will recognize that many modifications and adaptations to the embodiments described are possible and may even be desirable in certain circumstances. Thus, the following description is provided as illustrative of the principles of the embodiments and not in limitation thereof.

The phraseology and terminology used herein is for the purpose of description and should not be regarded as limiting. As used herein, the term "plurality" refers to two or more items or components. The terms "comprising," "including," "carrying," "having," "containing," and "involving," whether in the written description or the claims and the like, are open-ended terms, i.e., to mean "including but not limited to," unless otherwise stated. Thus, the use of such terms is meant to encompass the items listed thereafter, and equivalents thereof, as well as additional items. The transitional phrases "consisting of" and "consisting essentially of," are closed or semi-closed transitional phrases, respectively, with respect to any claims. Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish claim elements.

Figure 1:
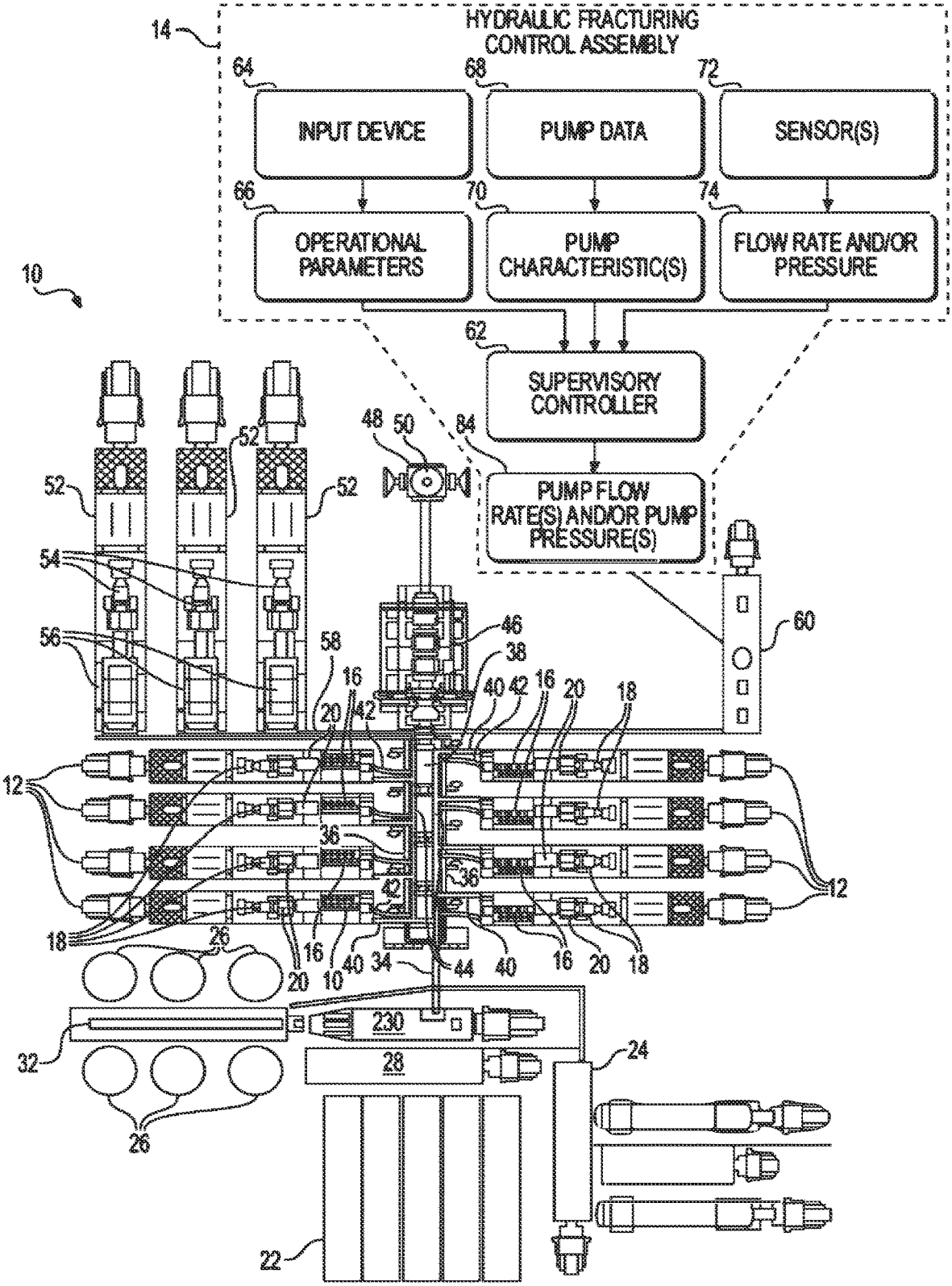
FIG. 1 schematically illustrates an example hydraulic fracturing system including a plurality of hydraulic fracturing units, and including a block diagram of a hydraulic fracturing control assembly according to embodiments of the disclosure.

FIG. 1 schematically illustrates a top view of an example hydraulic fracturing system 10 including a plurality of hydraulic fracturing units 12, and including a block diagram of a hydraulic fracturing control assembly 14 according to embodiments of the disclosure. In some embodiments, one or more of the hydraulic fracturing units 12 may include a hydraulic fracturing pump 16 driven by an internal combustion engine 18, such a gas turbine engine or a reciprocating-piston engine. For example, in some embodiments, each of the hydraulic fracturing units 12 may include a directly-driven turbine (DDT) hydraulic fracturing pump 16, in which the hydraulic fracturing pump 16 is connected to one or more gas turbine engines (GTEs) that supply power to the respective hydraulic fracturing pump 16 for supplying fracturing fluid at high pressure and high flow rates to a formation. For example, the GTE may be connected to a respective hydraulic fracturing pump 16 via a transmission 20 (e.g., a reduction transmission) connected to a drive shaft, which, in turn, is connected to a driveshaft or input flange of a respective hydraulic fracturing pump 16, which may be a reciprocating hydraulic fracturing pump. Other types of engine-to-pump arrangements are contemplated as will be understood by those skilled in the art.

In some embodiments, one or more of the GTEs may be a dual-fuel or bi-fuel GTE, for example, capable of being operated using of two or more different types of fuel, such as natural gas and diesel fuel, although other types of fuel are contemplated. For example, a dual-fuel or bi-fuel GTE may be capable of being operated using a first type of fuel, a second type of fuel, and/or a combination of the first type of fuel and the second type of fuel. For example, the fuel may include gaseous fuels, such as, for example, compressed natural gas (CNG), natural gas, field gas, pipeline gas, methane, propane, butane, and/or liquid fuels, such as, for example, diesel fuel (e.g., #2 diesel), bio-diesel fuel, bio-fuel, alcohol, gasoline, gasohol, aviation fuel, and other fuels as will be understood by those skilled in the art. Gaseous fuels may be supplied by CNG bulk vessels, a gas compressor, a liquid natural gas vaporizer, line gas, and/or well-gas produced natural gas. Other types and associated fuel supply sources are contemplated. The one or more internal combustion engines 18 may be operated to provide horsepower to drive the transmission 20 connected to one or more of the hydraulic fracturing pumps 16 to fracture a formation during a well stimulation project or fracturing operation.

In some embodiments, the fracturing fluid may include, for example, water, proppants, and/or other additives, such as thickening agents and/or gels. For example, proppants may include grains of sand, ceramic beads or spheres, shells, and/or other particulates, and may be added to the fracking fluid, along with gelling agents to create a slurry as will be understood by those skilled in the art. The slurry may be forced via the hydraulic fracturing pumps 16 into the formation at rates faster than can be accepted by the existing pores, fractures, faults, or other spaces within the formation. As a result, pressure builds rapidly to the point where the formation fails and begins to fracture. By continuing to pump the fracturing fluid into the formation, existing fractures in the formation are caused to expand and extend in directions farther away from a well bore, thereby creating additional flow paths to the well. The proppants may serve to prevent the expanded fractures from closing or may reduce the extent to which the expanded fractures contract when pumping of the fracturing fluid is ceased. Once the well is fractured, large quantities of the injected fracturing fluid may be allowed to flow out of the well, and the water and any proppants not remaining in the expanded fractures may be separated from hydrocarbons produced by the well to protect downstream equipment from damage and corrosion. In some instances, the production stream may be processed to neutralize corrosive agents in the production stream resulting from the fracturing process.

In the example shown in FIG. 1, the hydraulic fracturing system 10 may include one or more water tanks 22 for supplying water for fracturing fluid, one or more chemical additive units 24 for supplying gels or agents for adding to the fracturing fluid, and one or more proppant tanks 26 (e.g., sand tanks) for supplying proppants for the fracturing fluid. The example fracturing system 10 shown also includes a hydration unit 28 for mixing water from the water tanks 22 and gels and/or agents from the chemical additive units 24 to form a mixture, for example, gelled water. The example shown also includes a blender 30, which receives the mixture from the hydration unit 28 and proppants via conveyers 32 from the proppant tanks 26. The blender 30 may mix the mixture and the proppants into a slurry to serve as fracturing fluid for the hydraulic fracturing system 10. Once combined, the slurry may be discharged through low-pressure hoses 34, which convey the slurry into two or more low-pressure lines 36 in a frac manifold 38. In the example shown, the low-pressure lines 36 in the frac manifold 38 feed the slurry to the hydraulic fracturing pumps 16 through low-pressure suction hoses 40.

The hydraulic fracturing pumps 16, driven by the respective internal combustion engines 18, discharge the slurry (e.g., the fracking fluid including the water, agents, gels, and/or proppants) at high flow rates and/or high pressures through individual high-pressure discharge lines 42 into two or more high-pressure flow lines 44, sometimes referred to as "missiles," on the frac manifold 38. The flow from the high-pressure flow lines 44 is combined at the frac manifold 38, and one or more of the high-pressure flow lines 44 provide fluid flow to a manifold assembly 46, sometimes referred to as a "goat head." The manifold assembly 46 delivers the slurry into a wellhead manifold 48. The wellhead manifold 48 may be configured to selectively divert the slurry to, for example, one or more wellheads 50 via operation of one or more valves. Once the fracturing process is ceased or completed, flow returning from the fractured formation discharges into a flowback manifold, and the returned flow may be collected in one or more flowback tanks as will be understood by those skilled in the art.

As schematically depicted in FIG. 1, one or more of the components of the fracturing system 10 may be configured to be portable, so that the hydraulic fracturing system 10 may be transported to a well site, quickly assembled, operated for a relatively short period of time, at least partially disassembled, and transported to another location of another well site for use. For example, the components may be carried by trailers and/or incorporated into trucks, so that they may be easily transported between well sites.

As shown in FIG. 1, some embodiments of the hydraulic fracturing system 10 may include one or more electrical power sources 52 configured to supply electrical power for operation of electrically powered components of the hydraulic fracturing system 10. For example, one or more of the electrical power sources 52 may include an internal combustion engine 54 (e.g., a GTE or a reciprocating-piston engine) provided with a source of fuel (e.g., gaseous fuel and/or liquid fuel) and configured to drive a respective electrical power generation device 56 to supply electrical power to the hydraulic fracturing system 10. In some embodiments, one or more of the hydraulic fracturing units 12 may include electrical power generation capability, such as an auxiliary internal combustion engine and an auxiliary electrical power generation device driven by the auxiliary internal combustion engine. As shown is FIG. 1, some embodiments of the hydraulic fracturing system 10 may include electrical power lines 56 for supplying electrical power from the one or more electrical power sources 52 to one or more of the hydraulic fracturing units 12.

Some embodiments also may include a data center 60 configured to facilitate receipt and transmission of data communications related to operation of one or more of the components of the hydraulic fracturing system 10. Such data communications may be received and/or transmitted via hard-wired communications cables and/or wireless communications, for example, according to known communications protocols, such as Wi-Fi®, Bluetooth®, ZigBee®, or forms of near field communications. In addition, signal communication may include one or more intermediate controllers or relays disposed between elements that are in signal communication with one another. For example, the data center 60 may contain at least some components of the hydraulic fracturing control assembly 14, such as a supervisory controller 62 configured to receive signals from components of the hydraulic fracturing system 10 and/or communicate control signals to components of the hydraulic fracturing system 10, for example, to at least partially control operation of one or more components of the hydraulic fracturing system 10, such as, for example, the internal combustion engines 18, the transmissions 20, and/or the hydraulic fracturing pumps 16 of the hydraulic fracturing units 12, the chemical additive units 24, the hydration units 28, the blender 30, the conveyers 32, the frac manifold 38, the manifold assembly 46, the wellhead manifold 48, and/or any associated valves, pumps, and/or other components of the hydraulic fracturing system 10.

Figure 2:
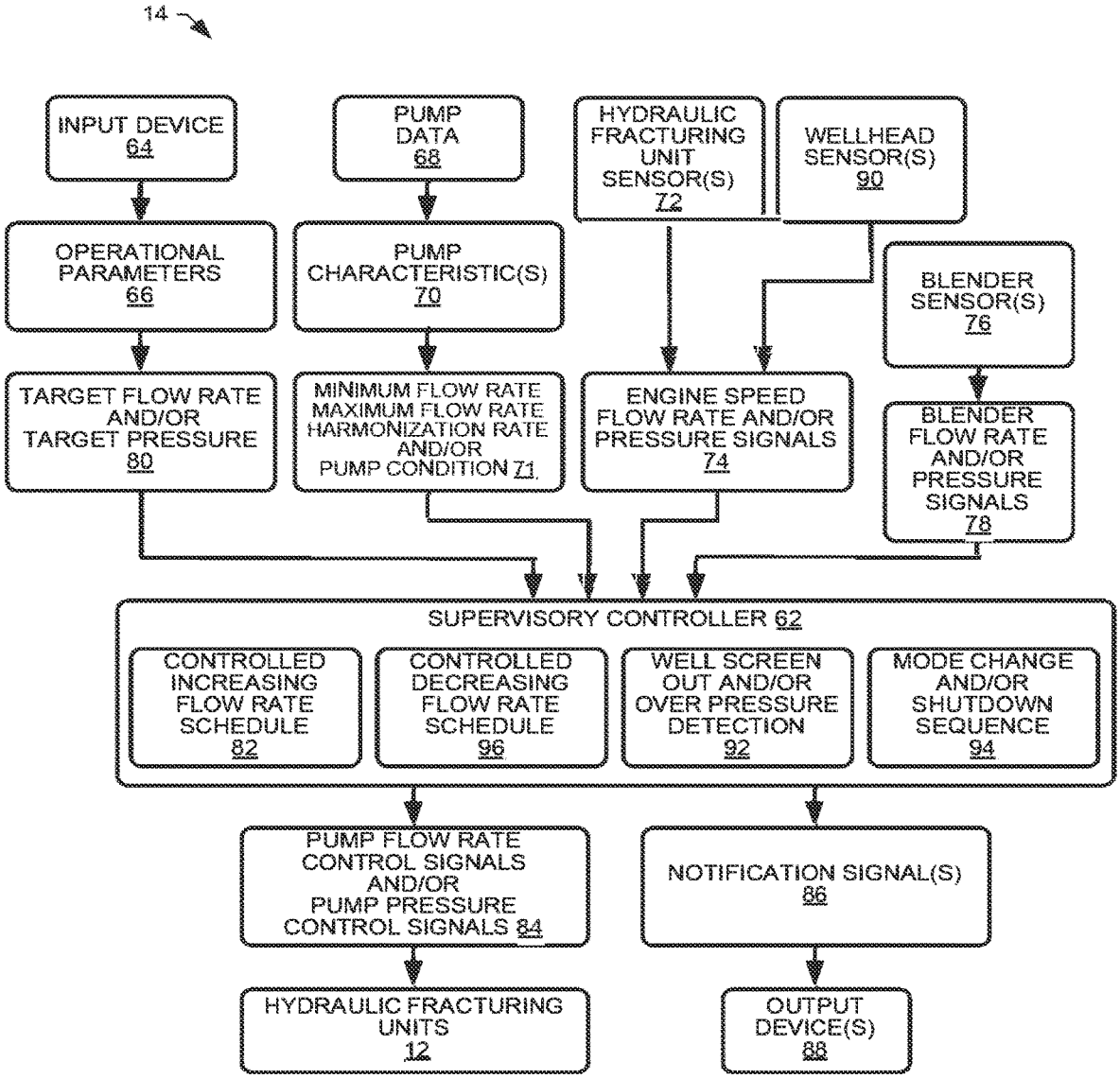
FIG. 2 is a block diagram of an example hydraulic fracturing control assembly according to an embodiment of the disclosure.

FIGS. 1 and 2 also include block diagrams of example hydraulic fracturing control assemblies 14 according to embodiments of the disclosure. Although FIGS. 1 and 2 depict certain components as being part of the example hydraulic fracturing control assemblies 14, one or more of such components may be separate from the hydraulic fracturing control assemblies 14. In some embodiments, the hydraulic fracturing control assembly 14 may be configured to semi- or fully-autonomously monitor and/or control operation of one or more of the hydraulic fracturing units 12 and/or other components of the hydraulic fracturing system 10, for example, as described herein. For example, the hydraulic fracturing control assembly 14 may be configured to operate a plurality of the hydraulic fracturing units 12, each of which may include a hydraulic fracturing pump 16 to pump fracturing fluid into a wellhead 50 and an internal combustion engine 18 to drive the hydraulic fracturing pump 16 via the transmission 20.

As shown in FIGS. 1 and 2, some embodiments of the hydraulic fracturing control assembly 14 may include an input device 64 configured to facilitate communication of rate ramp signals indicative of a rate ramp operational mode to control a flow rate associated with pumping fracturing fluid into a wellhead. The input device 64 also may be configured to facilitate communication of operational parameters 66 to a supervisory controller 62. In some embodiments, the input device 64 may include a computer configured to provide one or more operational parameters 66 to the supervisory controller 62, for example, from a location remote from the hydraulic fracturing system 10 and/or a user input device, such as a keyboard linked to a display associated with a computing device, a touchscreen of a smartphone, a tablet, a laptop, a handheld computing device, and/or other types of input devices as will be understood by those skilled in the art.

For example, the supervisory controller 62 may be in signal communication with an input device 64, such as a display, terminal, and/or a computing device, as well as associated input devices. Further, the display may be included with a computing device. The computing device may include a user interface (the user interface to be displayed on the display). In such examples, the user interface may be a graphical user interface (GUI). In another example, the user interface may be an operating system. In such examples, the operating system may include various firmware, software, and/or drivers that allow a user to communicate or interface with, via input devices, the hardware of the computing device and, thus, with the supervisory controller 62. The computing device may include other peripherals or input devices, for example, a mouse, pointer device, a keyboard, and/or a touchscreen. The supervisory controller 62 may send or transmit prompts, requests, or notifications to the display, for example, through the computing device to the display. In some embodiments, a user (as used herein, "user" may refer an operator, a single operator, a person, or any personnel at the wellsite hydraulic fracturing system 10) may send data (such as, through data entry, via an input device, into a computing device associated with the display for a hydraulic fracturing stage profile) and responses (such as, through user selection of a prompt, via the input device, on the display) from the display to the supervisory controller 62.

In some embodiments, the operational parameters 66 may include, but are not limited to, a target flow rate, a maximum flow rate, a target pressure, a pressure range, and/or a minimum flow rate associated with fracturing fluid supplied to the wellhead 50. In some examples, a user associated with a hydraulic fracturing operation performed by the hydraulic fracturing system 10 may provide one more of the operational parameters 66 to the supervisory controller 62, and/or one or more of the operational parameters 66 may be stored in computer memory and provided to the supervisory controller 62 upon initiation of at least a portion of the hydraulic fracturing operation.

In some embodiments, a rate ramp mode may be enabled or disabled during a hydraulic fracturing stage. For example, a user may select a button (e.g., a physical or virtual display button) on a user interface. In some embodiments, prior to selecting or enabling the rate ramp mode, the user may configure and/or set-up the rate ramp mode, so increases in fracturing flow rate may be performed efficiently. In some examples, when configuring the rate ramp mode, the user may set a maximum allowable fracturing fluid flow rate (e.g., a maximum amount of barrels of fracturing fluid to be added to the fracturing fluid flow rate and, in some examples, within a user-defined fracturing fluid pressure range). For example, during low pressure pumping at the beginning of a hydraulic fracturing stage, the maximum fracturing fluid flow rate increase may be relatively higher, for example, as there may be a relatively reduced chance for the fracturing fluid pressure to spike when the fluid flow rate is increased. In some embodiments, when the fracturing fluid pressure is approaching a maximum allowable fluid pressure (e.g., a user-defined maximum fluid pressure), the rate of increase of the fluid flow rate may be reduced, for example, so the fracturing fluid pressure does not rapidly increase, which may result in an over-pressure event may that result in the supervisory controller 62 intervening and/or may cause a main discharge line pressure relief system to release pressure.

In some embodiments, once the operational parameters are accepted by the supervisory controller 62 as being within allowable ranges stored or pre-programmed into the supervisory controller 62, the rate ramp mode may be activated and used during the hydraulic fracturing stage. In some embodiments, the supervisory controller 62 may use sensor signals 74 (e.g., analog inputs) from one or more pressure sensors (e.g., the hydraulic fracturing unit sensors 72 and/or the wellhead sensors 90) to determine the output pressure from the hydraulic fracturing units 12 and/or at the wellhead 50. In some embodiments, the supervisory controller 62 may be configured to use the sensor signals to determine the pressure range in which the hydraulic fracturing units 12 are operating, for example, relative to the rate ramp mode (e.g., according to the controller increasing flow rate schedule 82). In some embodiments, regardless of whether the hydraulic fracturing system 10 is being operated in a manual mode or according to a constant flow rate mode, the configured rate for the pressure range may designate the maximum flow rate that may be added to the hydraulic fracturing stage at any single rate increase.

In some embodiments, once an initial flow rate increase has been executed, a time delay may be performed to ensure that the flow rate does not increase immediately after each addition of a flow rate increase to the hydraulic fracturing stage. Once the time delay is complete, the user or the supervisory controller 62, in some examples, may increase the flow rate again. In some embodiments, once the fracturing fluid pressure has increased to a next pressure range according to the controlled increasing flow rate schedule 82, the increase in flow rate that may be added to the flow rate may decrease and a time delay maybe executed again. In some embodiments, during semi- or fully-autonomous control or in pressure mode, the rate ramp mode may be present and operating substantially simultaneously with automatic flow rate and automatic pressure modes, which may ensure or increase the likelihood that flow rate increases during these functions are performed efficiently and at a controlled rate, which results in a target flow rate being achieved, for example, in an S-bend curve fashion.

In some embodiments, an equipment profiler (e.g., a pump profiler) may calculate, record, store, and/or access data related each of the hydraulic fracturing units 12 including, but not limited to, pump data 68 including pump characteristics 70, maintenance data associated with the hydraulic fracturing units 12 (e.g., maintenance schedules and/or histories associated with the hydraulic fracturing pump 16, the internal combustion engine 18, and/or the transmission 20), operation data associated with the hydraulic fracturing units 12 (e.g., historical data associated with horsepower, fluid pressures, fluid flow rates, etc., associated with operation of the hydraulic fracturing units 12), data related to the transmissions 20 (e.g., hours of operation, efficiency, and/or installation age), data related to the internal combustion engines 18 (e.g., hours of operation, available power, and/or installation age), information related to the hydraulic fracturing pumps 16 (e.g., hours of operation, plunger and/or stroke size, maximum speed, efficiency, health, and/or installation age), equipment health ratings (e.g., pump, engine, and/or transmission condition), and/or equipment alarm history (e.g., life reduction events, pump cavitation events, pump pulsation events, and/or emergency shutdown events). In some embodiments, the pump characteristics 70 may include, but are not limited to minimum flow rate, maximum flow rate, harmonization rate, and/or pump condition, collectively identified as 71 in FIG. 2.

In the embodiments shown in FIGS. 1 and 2, the hydraulic fracturing control assembly 14 may also include one or more sensors 72 configured to generate one or more sensor signals 74 indicative of a flow rate of fracturing fluid supplied by a respective one of the hydraulic fracturing pump 16 or a hydraulic fracturing unit 12 and/or supplied to the wellhead 50, a pressure associated with fracturing fluid provided by a respective hydraulic fracturing pump 16 of a hydraulic fracturing unit 12 and/or supplied to the wellhead 50, and/or an engine speed associated with operation of a respective internal combustion engine 18 of a hydraulic fracturing unit 12. For example, one or more sensors 72 may be connected to one or more of the hydraulic fracturing units 12 and may be configured to generate signals indicative of a fluid pressure supplied by an individual hydraulic fracturing pump 16 of a hydraulic fracturing unit, a flow rate associated with fracturing fluid supplied by a hydraulic fracturing pump 16 of a hydraulic fracturing unit 12, and/or an engine speed of an internal combustion engine 18 of a hydraulic fracturing unit 12. In some embodiments, one or more of the sensors 72 may be connected to the wellhead 50 and may be configured to generate signals indicative of fluid pressure of hydraulic fracturing fluid at the wellhead 50 and/or a flow rate associated with the fracturing fluid at the wellhead 50. Other sensors (e.g., other sensor types for providing similar or different information) at the same or other locations of the hydraulic fracturing system 10 are contemplated.

As shown in FIG. 2, in some embodiments, the hydraulic fracturing control assembly 14 also may include one or more blender sensors 76 associated with the blender 30 and configured to generate blender signals 78 indicative of an output of the blender 30, such as, for example, a flow rate and/or a pressure associated with fracturing fluid supplied to the hydraulic fracturing units 12 by the blender 30. Operation of one or more of the hydraulic fracturing units 12 may be controlled, for example, to prevent the hydraulic fracturing units 12 from supplying a greater flow rate of fracturing fluid to the wellhead 50 than the flow rate of fracturing fluid supplied by the blender 30, which may disrupt the fracturing operation and/or damage components of the hydraulic fracturing units 12 (e.g., the hydraulic fracturing pumps 16).

As shown in FIGS. 1 and 2, some embodiments of the hydraulic fracturing control assembly 14 may include a supervisory controller 62 in communication with the plurality of hydraulic fracturing units 12, the input device 64, and/or one or more of the sensors 72 and/or 76. For example, communications may be received and/or transmitted between the supervisory controller 62, the hydraulic fracturing units 12, and/or the sensors 72 and/or 76 via hardwired communications cables and/or wireless communications, for example, according to known communications protocols.

In some embodiments, the supervisory controller 62 may be configured to receive one or more operational parameters 66 associated with pumping fracturing fluid into the wellhead 50. For example, the operational parameters 66 may include a target flow rate and/or a target pressure 80 for fracturing fluid supplied to the wellhead 50. The supervisory controller 62 also may be configured to receive one or more pump characteristics 70, for example, associated with each of the hydraulic fracturing pumps 16 of the respective hydraulic fracturing units 12. As described previously herein, in some embodiments, the pump characteristics 70 may include a minimum flow rate, a maximum flow rate, a harmonization rate, and/or a pump condition 82 (individually or collectively) provided by the corresponding hydraulic fracturing pump 16 of a respective hydraulic fracturing unit 12. The pump characteristics 70 may be provided by a user, for example, via the input device 64 and/or via a pump profiler, as described previously herein.

In some embodiments, the supervisory controller 62 may be configured to determine whether the hydraulic fracturing units 12 have a capacity sufficient to achieve the target flow rate and/or the target pressure 80. For example, the supervisory controller 62 may be configured to make such determinations based at least partially on one or more of the pump characteristics 70, which the supervisory controller 62 may use to calculate (e.g., via addition) the collective capacity of the hydraulic fracturing units 12 to supply a sufficient flow rate and/or a sufficient pressure to achieve the target flow rate and/or the target pressure 80 at the wellhead 50. For example, the supervisory controller 62 may be configured to determine a total pump flow rate by combining at least one of the pump characteristics 70 for each of the plurality of hydraulic fracturing pumps 16, and comparing the total pump flow rate to the target flow rate. In some embodiments, determining the total pump flow rate may include adding the maximum flow rates of each of the hydraulic fracturing pumps 16.

In some embodiments, the supervisory controller 62 may be configured to receive one or more signals indicative of a pump condition of one or more hydraulic fracturing pumps 16 of the plurality of hydraulic fracturing units 16 and determine the maximum flow rate for each of the hydraulic fracturing pumps 16 based at least in part on the one or more signals indicative of pump condition. In some embodiments, the pump condition may include one or more of total pump strokes, maximum recorded pressure produced, maximum recorded flow produced, maximum recorded pump speed produced, total pump hours of operation, pressure pump efficiency health, pump installation age, pump deration based on health, pump cavitation events, pump pulsation events, emergency shut-down events, and/or any other use-related characteristics of the hydraulic fracturing pumps 16.

In some embodiments, upon initiation of a fracturing operation, for example, by a user associated with the hydraulic fracturing system 10, the supervisory controller 62 may be configured to increase a flow rate from at least some of the hydraulic fracturing units 12 according to a controlled increasing flow rate schedule 82 toward the target flow rate and/or the target pressure 80. In some embodiments, the controlled increasing flow rate schedule may cause operation of the hydraulic fracturing units, such that a flow rate of fracturing fluid does not exceed the maximum flow rate and a fracturing fluid pressure substantially remains within the pressure range. For example, rather than allowing the hydraulic fracturing units 12 to increase respective flow rate outputs in an uncontrolled manner (e.g., at a rate provided by the output of the internal combustion engine 18), the supervisory controller 62 may ramp-up the flow rate at a lower rate of change than could be achieved without control. This may reduce the likelihood or prevent the hydraulic fracturing pumps 16 from over-speeding and/or being subjected to cavitation by the fracturing fluid when increasing the flow rate toward the target flow rate and/or target pressure 80. In some embodiments, the controlled flow rate increase provided by the controlled increasing flow rate schedule 82 may be substantially constant (e.g., the rate of change of the flow rate may remain substantially constant), may be increasing as the flow rate increases, may be decreasing as the flow rate increases, and/or may increase or decrease based at least partially on the flow rate. In some examples, flow rates provided by different hydraulic fracturing units 12 may change according to different schedules and/or strategies, for example, such that the hydraulic fracturing units 12 do not increase flow rate at the same rate and/or according to the same schedule.

In some embodiments, the supervisory controller 62 may be configured to increase the flow rate from at least some of the hydraulic fracturing units 12 by maintaining a rate of change of the flow rate provided by at least some of the hydraulic fracturing units 12 below a maximum rate of change of the flow rate until at least some of the hydraulic fracturing units 12 have achieved the target flow rate and/or the target pressure. For example, the supervisory controller 62 may be configured to determine the maximum rate of change of the flow rate by changing the maximum rate of change of the flow rate as the total flow rate increases to achieve the target flow rate and/or the target pressure. In some embodiments, the supervisory controller 62 may be configured to receive one or more signals indicative fracturing fluid pressure at the wellhead 50, and determine the maximum rate of change of the flow rate based at least in part on the one or more signals indicative of the fluid pressure at the wellhead 50.

Table 1 below provides an example controlled increasing flow rate schedule 82. According to the example in Table 1, the rate of change of the flow rate is reduced as the fracturing fluid pressure increases, from a maximum rate of change of 3 barrels per minute per second (BPM/sec), up until a fracturing fluid pressure of 500 pounds per square inch (psi). Above 500 psi fracturing fluid pressure, the rate of change of the flow rate decreases to 2 BPM/see until the fracturing fluid pressure reaches 5,000 psi. From 5,000 psi to 10,000 psi fracturing fluid pressure, the rate of change of the flow rate is reduced to 1 BPM/sec. Above 10,000 psi, the rate of change of the flow rate is further reduced to 0.5 BPM/sec. In some embodiments, the supervisory controller 62 may be configured to generate one or more pump flow rate signals and/or pump pressure signals 84, which may be communicated to one or more of the hydraulic fracturing units 12 to control operation of the hydraulic fracturing pumps 16, the internal combustion engines 18, and/or the transmissions 20, such that the output of the hydraulic fracturing pumps 16 corresponds to the one or more control signals 84.

TABLE 1

| Wellhead Pressure Range (psi) | Maximum Rate of Change of Flow Rate (BPM/sec) |
|---|---|
| 0-500 psi | 3 BPM/sec |
| 500-5,000 psi | 2 BPM/sec |
| 5,000-10,000 psi | 1 BPM/sec |
| 10,000-15,000 psi | 0.5 BPM/sec |
| Slow Rate Adjustment | 0.5 BPM/sec |

As described in more detail below, during operation of the hydraulic fracturing system 10, the supervisory controller 62 may be configured to receive one or more signals indicative of a maximum fluid pressure at the wellhead 50. For example, a user may use the input device 64 to provide a maximum fluid pressure at the wellhead 50, the maximum fluid pressure may be stored and/or accessed by the supervisory controller 62, and/or the maximum fluid pressure may be calculated by the supervisory controller 62 based at least in part on, for example, one or more of the operational parameters 66, one or more of the pump characteristics 70, and/or information relating to the well. In some embodiments, when the fluid pressure at the wellhead 50 increases to within an upper range of the maximum fluid pressure, the supervisory controller 62 may be configured to generate one or more notification signals 86 indicative of the fluid pressure being within the upper range of the maximum fluid pressure. The upper range may range from about 25% below the maximum pressure to about 5% below the maximum pressure (e.g., about 10% below the maximum pressure). In some embodiments, when the fracturing fluid pressure at the wellhead 50 increases to within the upper range of the maximum fluid pressure, the supervisory controller 62 may be configured to reduce a rate of change of the flow rate provided by the hydraulic fracturing units 12 and/or reduce the target flow rate, for example, according to a rate of flow rate change (e.g., 2.5% per second), and/or generate one or more notification signals 86 indicative of reducing the target rate, which may be received by one or more output devices 88 to notify an on-site user and/or remotely located personnel, for example, as described herein.

In some embodiments, a maximum operating pressure set point may be established that may be less than a wellhead kick-out pressure, for example, a fracturing fluid pressure at the wellhead 50, above which the supervisory controller 62 will cause the hydraulic fracturing system 10 to reduce pumping output and/or cease pumping output. In such embodiments, if it is determined that the fracturing fluid pressure at the wellhead 50 approaches to within a specified upper range of the wellhead kick-out pressure, the supervisory controller 62 may be configured to generate one or more notification signals 86 to notify an on-site or remotely-located user or computing device communicating an indication (e.g., an alarm) of the fracturing fluid pressure approaching the wellhead kick-out pressure. In some embodiments, the notification signals 86 may be communicated to one or more output devices 88, which may be configured to provide a visual, audible, and/or tactile (e.g., vibration) alarm for a user located on-site and/or personnel located remotely from the hydraulic fracturing operation, such as at a fracturing management facility. The output device(s) 88 may include a computer display device, a hand-held computing device, such as a smartphone, a tablet, and/or a dedicated held-held display device. In some embodiments, the output device(s) 88 may include a speaker, a siren, an alarm, and/or a hand-held computing device. In some embodiments, following reducing the target flow rate, when the fracturing fluid pressure at the wellhead 50 falls below a lower range of the maximum fluid pressure, the supervisory controller 62 may be configured to increase the flow rate provided by the hydraulic fracturing units 12, for example, until the fracturing fluid pressure at the wellhead 50 returns to within the upper range of the maximum fluid pressure.

In some embodiments, the supervisory controller 62 also may be configured to generate one or more control signals 84 causing one or more of the hydraulic fracturing units 12 to operate according to a slow rate adjustment mode, for example, to reduce the likelihood or prevent the fracturing fluid pressure from reaching or exceeding the wellhead kick-out pressure. For example, as shown in Table 1, the slow rate adjustment may be set to 0.5 BPM/sec. In some examples, the upper range (e.g., within twenty percent, fifteen percent, ten percent, or five percent of the wellhead kick-out pressure) may be set by the user and/or may be predetermined and stored in memory accessible by the supervisory controller 62. Upon triggering of the slow rate adjustment mode, some embodiments of supervisory controller 62 may be configured communicate one or more control signals 84 to one or more of the hydraulic fracturing units 12, so that they can operate to provide the flow rate corresponding to the slow rate adjustment. In some embodiments, the slow rate adjustment may be set by the user and/or may be predetermined and stored in memory accessible by the supervisory controller 62.

In some embodiments, the supervisory controller 62 may be configured to determine, based at least in part on the one or more sensor signals 74 indicative of flow rate of fracturing fluid and/or the pressure associated with fracturing fluid at the wellhead 50, whether at least some of the hydraulic fracturing units 12 have achieved the target flow rate and/or the target pressure 80. In some embodiments, the supervisory controller 62 may receive sensor signals 74 from one or more wellhead sensors 90 configured to generate one or more signals indicative of the flow rate and/or fracturing fluid pressure 84. In some embodiments, the supervisory controller 62 may receive sensor signals 74 indicative of flow rate of fracturing fluid and/or the pressure associated with fracturing fluid from the one or more sensors 72 associated with each of the hydraulic fracturing units 12. In some such embodiments, the supervisory controller 62 may be configured to combine (e.g., add together) the flow rates and/or pressures from the sensors 74 to determine a total flow rate and/or a total pressure. In some embodiments, the supervisory controller 62 may be configured to receive sensor signals 74 from the one or more hydraulic fracturing units 12 and the wellhead sensors 90 and determine whether the at least some of the hydraulic fracturing units 12 have achieved the target flow rate and/or the target pressure 80, for example, at the wellhead 50.

In some embodiments, the supervisory controller 62, based at least in part on determination of whether the hydraulic fracturing units 12 have achieved the target flow rate and/or the target pressure 80, may be configured to control operation of one or more of the hydraulic fracturing units 12. For example, when it has been determined (e.g., via the supervisory controller 62) that the one or more of the target flow rate or the target pressure 80 has been achieved, the supervisory controller 62 may be configured to cause one or more of the hydraulic fracturing units 12 to operate to substantially maintain the target flow rate and/or the target pressure 80. For example, the supervisory controller 62 may generate the pump flow rate control signals and/or the pump pressure control signals 84 (see FIG. 2), which may be received by an engine control unit and/or a pump control unit (e.g., at a remote terminal unit), which may control operation of the internal combustion engine 18 and/or the hydraulic fracturing pump 16 of one or more of the hydraulic fracturing units 12, so that the hydraulic fracturing units 12 supply fracturing fluid to the wellhead 50 according to the target flow rate and/or the target pressure 80.

In some examples, once the target flow rate and/or the target pressure 80 has been achieved, the supervisory controller 62 may be configured to receive one or more signals indicative of a total flow rate of fracturing fluid supplied by the hydraulic fracturing units 12 to the wellhead 50. Based at least in part on the one or more signals indicative of the total flow rate, the supervisory controller 62 may be configured to determine whether the total flow rate is decreasing relative to the target flow rate. Based at least in part on this determination, the supervisory controller 62 may be configured to increase the flow rate to substantially maintain the target flow rate, for example, when it has been determined (e.g., by the supervisory controller 62) that the total flow rate is decreasing relative to the target flow rate. In some embodiments, when it has been determined that the total flow rate is substantially equal to the target flow rate, the supervisory controller 62 may be configured to maintain the target flow rate.

In some embodiments, when it has been determined (e.g., via the supervisory controller 62) that the target flow rate has not been achieved, the supervisory controller 62 may be configured to generate one or more notification signals 86 indicative of a failure to achieve the target flow rate. For example, prior to initiation of the fracturing operation, a user may use the input device 64 to select via, for example, a graphical user interface, that the hydraulic fracturing system 10 operate according to a first mode of operation, which may be configured to control operation of the one or more hydraulic fracturing units 12 according to a flow rate-based strategy, for example, as explained in more detail with respect to FIGS. 3A and 3B. In some such embodiments, when it has been determined that a target flow rate has not been achieved, the notification signals 86 may be received by one or more output devices 88, for example, as described previously herein, which may serve to notify a user or other personnel of the failure to achieve the target flow rate.

In some embodiments, when it has been determined (e.g., via the supervisory controller 62) that the target pressure has not been achieved, the supervisory controller 62 may be configured to operate the hydraulic fracturing units 12 to substantially maintain a maximum flow rate. For example, prior to initiation of the fracturing operation, a user may use the input device 64 to select via, for example, a graphical user interface, that the hydraulic fracturing system 10 operate according to a second mode of operation, which may be configured to control operation of the one or more hydraulic fracturing units 12 according to a fracturing fluid pressure-based strategy, for example, as explained in more detail with respect to FIGS. 4A, 4B, and 4C. In some such embodiments, when it has been determined that the target pressure has not been achieved, the supervisory controller 62 may be configured to cause one or more of the hydraulic fracturing units 12 to operate to substantially maintain a respective maximum flow rate, which may result in providing a highest available fracturing fluid pressure at the wellhead 50. For example, the supervisory controller 62 may generate the pump flow rate control signals 84 (see FIG. 2), which may be received by an engine control unit and/or a pump control unit (e.g., at a remote terminal unit), which may control operation of the internal combustion engine 18 and/or the hydraulic fracturing pump 16 of one or more of the hydraulic fracturing units 12, so that the hydraulic fracturing units 12 supply the maximum available flow rate to the wellhead 50.

In some embodiments, when the hydraulic fracturing control assembly 14 is operating according to the second mode of operation (e.g., the target pressure-based mode), when the maximum total flow rate has not been achieved, the supervisory controller 62 may be configured to substantially maintain the fracturing fluid pressure at the wellhead 50 to within a pressure differential of the fracturing fluid pressure by (1) increasing the total flow rate to increase the fracturing fluid pressure at the wellhead 50 to be within the pressure differential, or (2) decreasing the total flow rate to decrease the fracturing fluid pressure at the wellhead 50 to be within the pressure differential. In some embodiments, the pressure differential may be included with the operational parameters 66, which may be provided by the user prior to beginning pumping of fracturing fluid by the hydraulic fracturing units 12, for example, via the input device 64. The pressure differential may range from about 100 psi to about 800 psi, from about 200 psi to about 600 psi, or from about 300 psi to about 500 psi.

In some embodiments, when hydraulic fracturing control assembly 14 is operating according to the second mode of operation (e.g., the target pressure-based mode), the supervisory controller 62 may be configured to receive the one or more operational parameters associated with pumping fracturing fluid into a wellhead 50, including receiving a maximum flow rate, which may be provided by the user. In such embodiments, the supervisory controller 62 may be configured to increase the flow rate from the hydraulic fracturing units 12 while substantially maintaining the flow rate from the hydraulic fracturing units 12 below the maximum flow rate.

Some embodiments of the supervisory controller 62 may be configured to substantially maintain the flow rate and/or fluid pressure provided by the hydraulic fracturing units 12, for example, if a user causes generation of one or more signals indicative of switching out of the first mode of operation or the second mode of operation, for example, to a third manual mode of operation. For example, if the supervisory controller 62 is controlling operation of the hydraulic fracturing units 12 according to the first or second modes of operation, the user may cause the supervisory controller 62 to exit the mode of operation, such that the user may manually control operation of the hydraulic fracturing units 12. For example, the user may use the input device 64 to exit the first or second mode of operation. Under such circumstances, the supervisory controller 62 may be configured to cause the hydraulic fracturing units 12 to continue to operate at flow rates substantially the same as flow rates at the time of receipt of the one or more signals indicative of ceasing the first or second modes of operation. Thereafter, the user may manually generate control signals for controlling operation and/or the output of the hydraulic fracturing units 12. In some embodiments, even when operation has been switched to a manual mode, safety systems to detect and control operation during events, such as well screen-outs and/or over-pressure conditions, may continue to be controlled by the supervisory controller 62.

In some embodiments, the supervisory controller 62 may also be configured to receive one more signals indicative of fluid pressure (e.g., at the wellhead 50) and determine whether a well screen-out or an over-pressure condition exists, collectively identified as 92 in FIG. 2, during the hydraulic fracturing operation. For example, the supervisory controller 62 may receive sensor signals 74 from the wellhead sensors 90 and/or the hydraulic fracturing unit sensors 72 and determine whether a screen-out or over-pressure condition is occurring. In some examples, the supervisory controller 62 may leverage artificial intelligence to predict and/or detect such occurrences at an early stage. For example, the supervisory controller 62 may execute an analytical model, such a machine learning-trained analytical model, to recognize an imminent occurrence and/or the initial stages of the occurrence of a screen-out and/or over-pressure condition. According to some embodiments, in some such situations, the supervisory controller 62 may be configured such that when a well screen-out or an over-pressure condition is imminent or exists, the supervisory controller 62 may generate one or more notification signals 86 indicative of the one or more of the well screen-out or the over-pressure condition. The supervisory controller 62 further may be configured to cease increasing the flow rate from one or more of the hydraulic fracturing units 12. For example, the supervisory controller 62 may be configured to generate one or more control signals to cause one or more of the hydraulic fracturing units 12 to reduce output according to a mode change and/or shutdown sequence, such as the slow rate adjustment mode described previously herein, and/or cease operation of one or more of the hydraulic fracturing units 12, for example, according to an emergency stop protocol.

In some embodiments, at the completion of one or more stages of the fracturing operation, the supervisory controller 62 may be configured to decrease the flow rate from the hydraulic fracturing units 12 according to a controlled decreasing flow rate schedule 96 (see FIG. 2) toward no flow of the fracturing fluid from the hydraulic fracturing units 12. For example, the supervisory controller 62 may be configured to receive one or more signals indicative of completion of the one or more stages. In some examples, the one or more signals may be automatically generated, for example, via a computing device according to an analytical model, manually entered, for example, via the input device 64, and/or triggered based at least in part on elapsed time (e.g., an elapsed time of operation of the hydraulic fracturing units 12). Based at least in part on the one or more signals indicative of completion of the one or more stages, the supervisory controller 62 may be configured to generate one or more control signals to cause the hydraulic fracturing units 12 to reduce the flow rate of fracturing fluid according to the controlled decreasing flow rate schedule 96. In some examples, the controlled decreasing flow rate schedule 96 may be similar to an inverted version of the controlled increasing flow rate schedule shown in Table 1, with rate of decreasing change of the flow rate increasing as the pressure drops. Other controlled decreasing flow rate schedules are contemplated.

FIGS. 3A, 3B, 4A, 4B, and 4C are block diagrams of example methods 300 and 400 of operating a plurality of hydraulic fracturing units according to embodiments of the disclosure, illustrated as a collection of blocks in a logical flow graph, which represent a sequence of operations. In the context of software, the blocks represent computer-executable instructions stored on one or more computer-readable storage media that, when executed by one or more processors, perform the recited operations. Generally, computer-executable instructions include routines, programs, objects, components, data structures, and the like that perform particular functions or implement particular data types. The order in which the operations are described is not intended to be construed as a limitation, and any number of the described blocks can be combined in any order and/or in parallel to implement the methods.

Figure 3A:
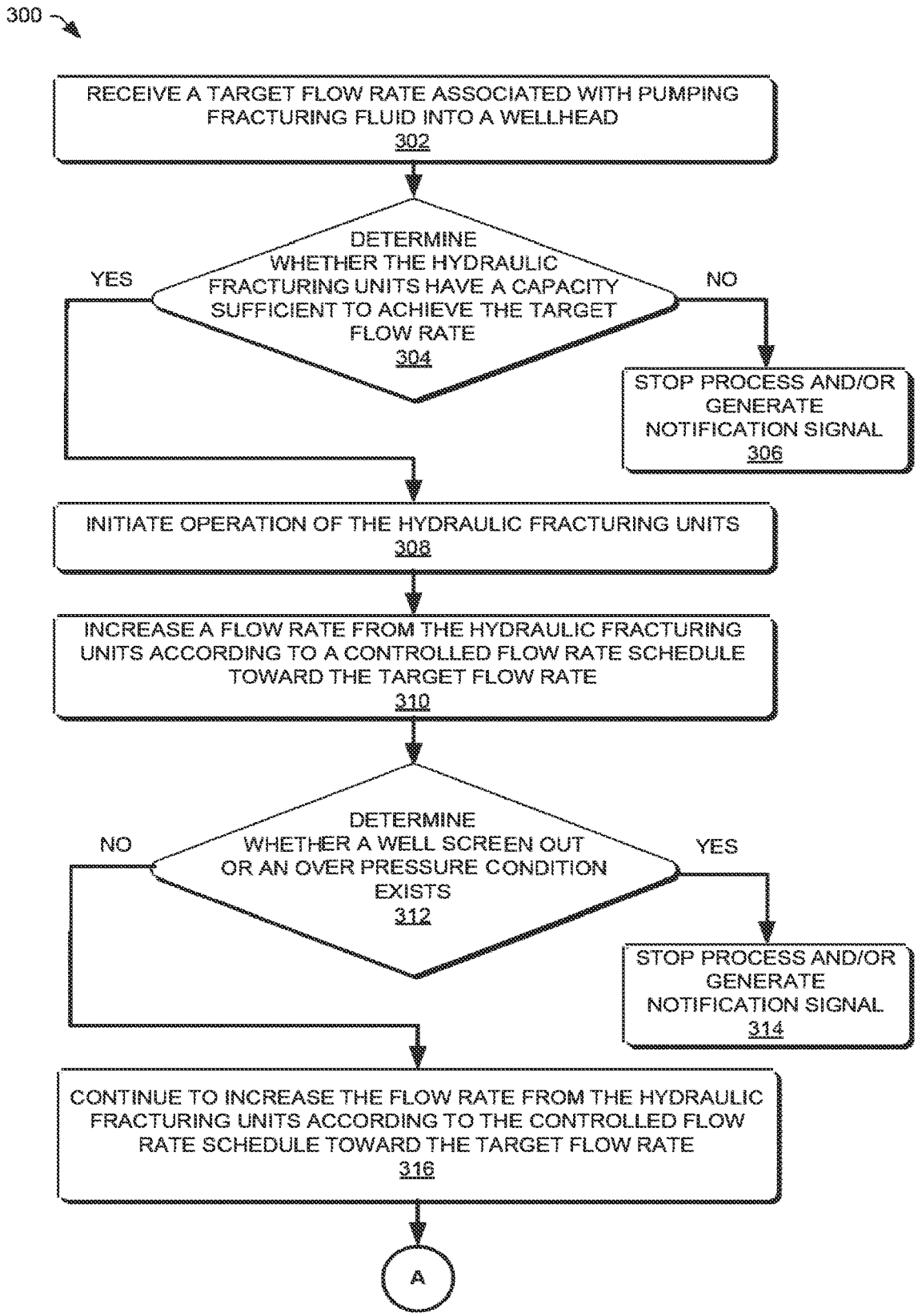
FIG. 3A is a block diagram of an example method of operating a plurality of hydraulic fracturing units according to an embodiment of the disclosure.
Figure 3B:
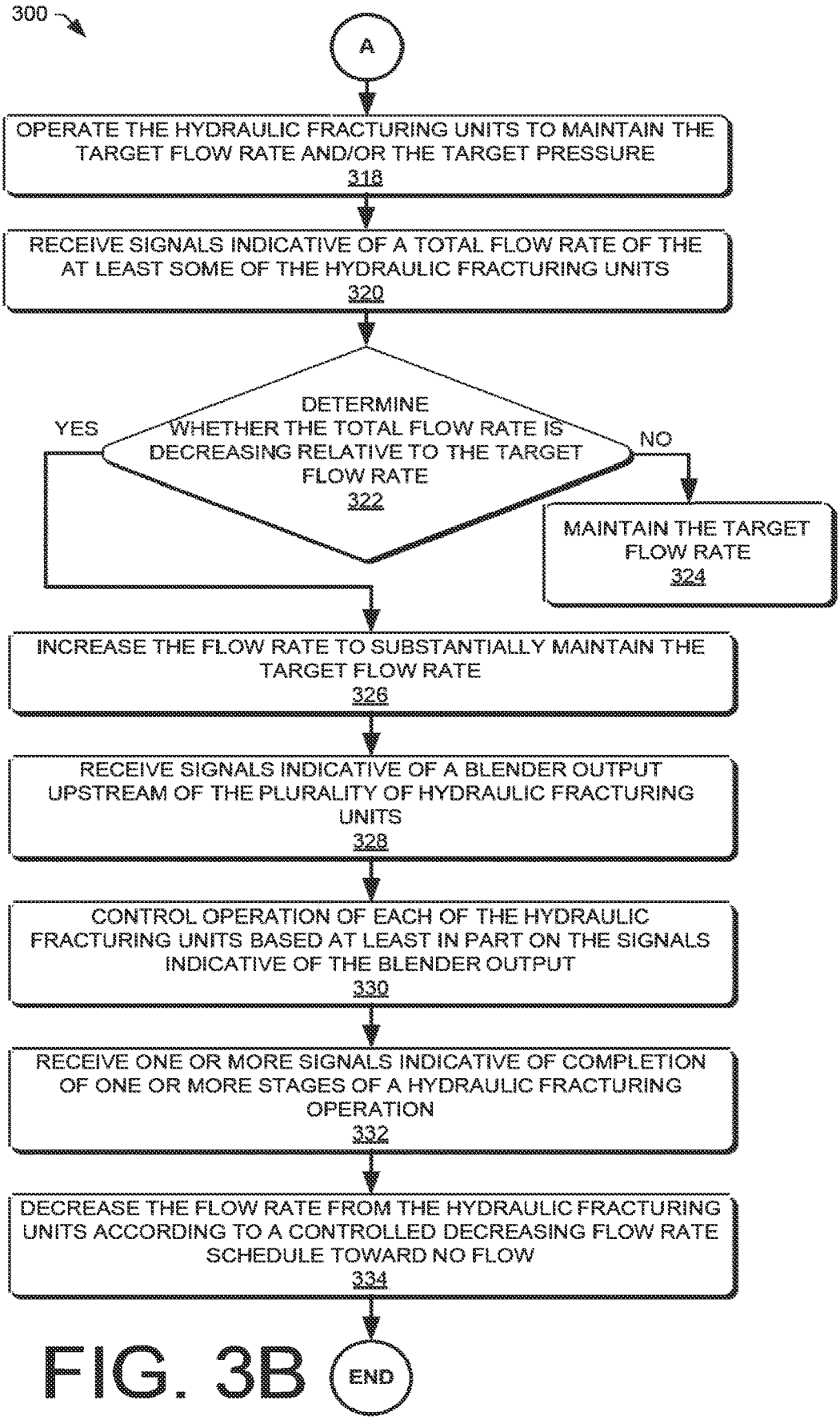
FIG. 3B is a continuation of the example method of operating a plurality of hydraulic fracturing units of the block diagram of FIG. 3A according to an embodiment of the disclosure.

FIGS. 3A and 3B depict a flow diagram of an embodiment of a method 300 of operating a plurality of hydraulic fracturing units, according to an embodiment of the disclosure. For example, the example method 300 may be configured to operate according to a first mode of operation, which controls operation of one or more hydraulic fracturing units according to a flow rate-based strategy, for example, as previously described herein.

The example method 300, at 302, may include receiving a target flow rate associated with pumping fracturing fluid into a wellhead. For example, a user of the hydraulic fracturing system may use an input device to provide operational parameters associated with the fracturing operation, which may include one or more of a target flow rate, a maximum flow rate, a target pressure, or a pressure range for fracturing fluid supplied to the wellhead. A supervisory controller may receive the operational parameters as a basis for controlling operation of the hydraulic fracturing units. In some examples of the method 300, the user may specify operation of the hydraulic fracturing units according to a first mode of operation, which controls operation of one or more hydraulic fracturing units according to a flow rate-based strategy. In some examples of the method 300, the supervisory controller may receive one or more rate ramp signals indicative of a rate ramp operational mode to control a flow rate associated with pumping fracturing fluid into a wellhead.

At 304, the example method 300 further may include determining whether the hydraulic fracturing units have a capacity sufficient to achieve the target flow rate. For example, the supervisory controller may be configured to calculate the capacity based at least in part on pump characteristics received from a pump profiler, for example, as previously described herein.

If, at 304, it is determined that the hydraulic fracturing units lack sufficient capacity to achieve the target flow rate, at 306, the example method 300 also may include stopping the hydraulic fracturing process and/or generating one or more notification signals indicative of the insufficient capacity, for example, as discussed herein.

If, at 304, it is determined that the hydraulic fracturing units have a capacity sufficient to achieve the target flow rate, at 308, the example method 300 also may include initiating operation of the hydraulic fracturing units. For example, the supervisory controller may generate control signals for commencing operation of the hydraulic fracturing units.

The example method 300, at 310, also may include increasing a flow rate from the hydraulic fracturing units according to a controlled increasing flow rate schedule toward the target flow rate, for example, as previously described herein. In some examples of the method 300, the controlled increasing flow rate schedule may cause operation of the hydraulic fracturing units, such that a flow rate of fracturing fluid does not exceed the maximum flow rate and a fracturing fluid pressure substantially remains within the pressure range.

At 312, the example method 300 also may include determining whether a well screen-out or an over-pressure condition exists. In some embodiments of the method 300, this may be performed substantially continuously by the supervisory controller during the hydraulic fracturing operation, for example, as described previously herein.

If, at 312, it is determined that a well screen-out or an over-pressure condition exists, at 314, the example method 300 also may include one or more determination or other action steps. For example, if the rate ramp is running, and it is identified that a potential well screen-out situation is approaching, commencing, or occurring, then a first step may be a reduction of the proppant concentration, and thereafter a reduction of the rate. The reduced rate thereafter may be maintained. If, when maintaining the reduced rate, the pressure still is not at a constant and continues increasing, then the rate may be reduced further or potentially the job may be ceased. Accordingly, the method further may include ceasing the hydraulic fracturing process and/or generating one of more notification signals indicative of the insufficient capacity as will be understood by those skilled in the art. In some embodiments of the method 300, one or more of these determinations or actions may be performed by the supervisory controller during the hydraulic fracturing operation, for example, as described previously herein.

If, at 312, it is determined that a well screen-out or an over-pressure condition does not exist, at 316, the example method 300 further may include continuing to increase the flow rate from the hydraulic fracturing units according to the controlled increasing flow rate schedule toward the target flow rate. In some embodiments of the method 300, this may be performed by the supervisory controller, for example, as described previously herein.

Referring to FIG. 3B, the example method 300, at 318, further may include operating the hydraulic fracturing units to maintain the target flow rate and/or a target pressure. In some embodiments of the method 300, this may be performed during the fracturing operation by the supervisory controller, for example, as described previously herein.

The example method 300, at 320, further may include receiving signals indicative of a total flow rate of the hydraulic fracturing units. For example, the supervisory controller may receive the signals, for example, as described previously herein.

The example method 300, at 322, may include determining whether the total flow rate is decreasing relative to the target flow rate. In some embodiments of the method 300, this may be performed during the fracturing operation by the supervisory controller, for example, as described previously herein.

If, at 322, it is determined that the total flow rate is not decreasing relative to the target flow rate, at 324, the example method 300 also may include maintaining the target flow rate. In some embodiments of the method 300, this may be performed during the fracturing operation by the supervisory controller, for example, as described previously herein.

If, at 322, it is determined that the total flow rate is decreasing relative to the target flow rate, at 326, the example method 300 further may include increasing the flow rate to substantially maintain the target flow rate. In some embodiments of the method 300, this may be performed by the supervisory controller, for example, as described previously herein.

The example method 300, at 328, further may include receiving signals indicative of a blender output upstream of the plurality of hydraulic fracturing units. In some embodiments of the method 300, this may be performed substantially continuously during the hydraulic fracturing operation by the supervisory controller.

The example method 300, at 330, also may include controlling operation of each of the hydraulic fracturing units based at least in part on the signals indicative of the blender output. For example, if the blender output is insufficient to supply the hydraulic fracturing units with fracturing fluid to maintain the target flow rate, the target flow rate may be reduced to a point at which the blender output is sufficient to supply fracturing fluid to the hydraulic fracturing units to achieve the lowered target flow rate.

At 332, the example method 300 also may include receiving one or more signals indicative of completion of one or more stages of a hydraulic fracturing operation. For example, when the fracturing operation is substantially complete, the user may use an input device to indicate that the fracturing operation is complete. In some embodiments, the supervisory controller may be configured to automatically generate the one or more signals indicative of completion, for example, based at least partially on duration of operation, a total amount of fracturing fluid pumped by the hydraulic fracturing units, and/or pressure at the wellhead.

At 334, the example method 300 may further include decreasing the flow rate from the hydraulic fracturing units according to a controlled decreasing flow rate schedule toward zero or no flow, for example, as previously described herein. After 334, the example method 300 may end.

Figure 4A:
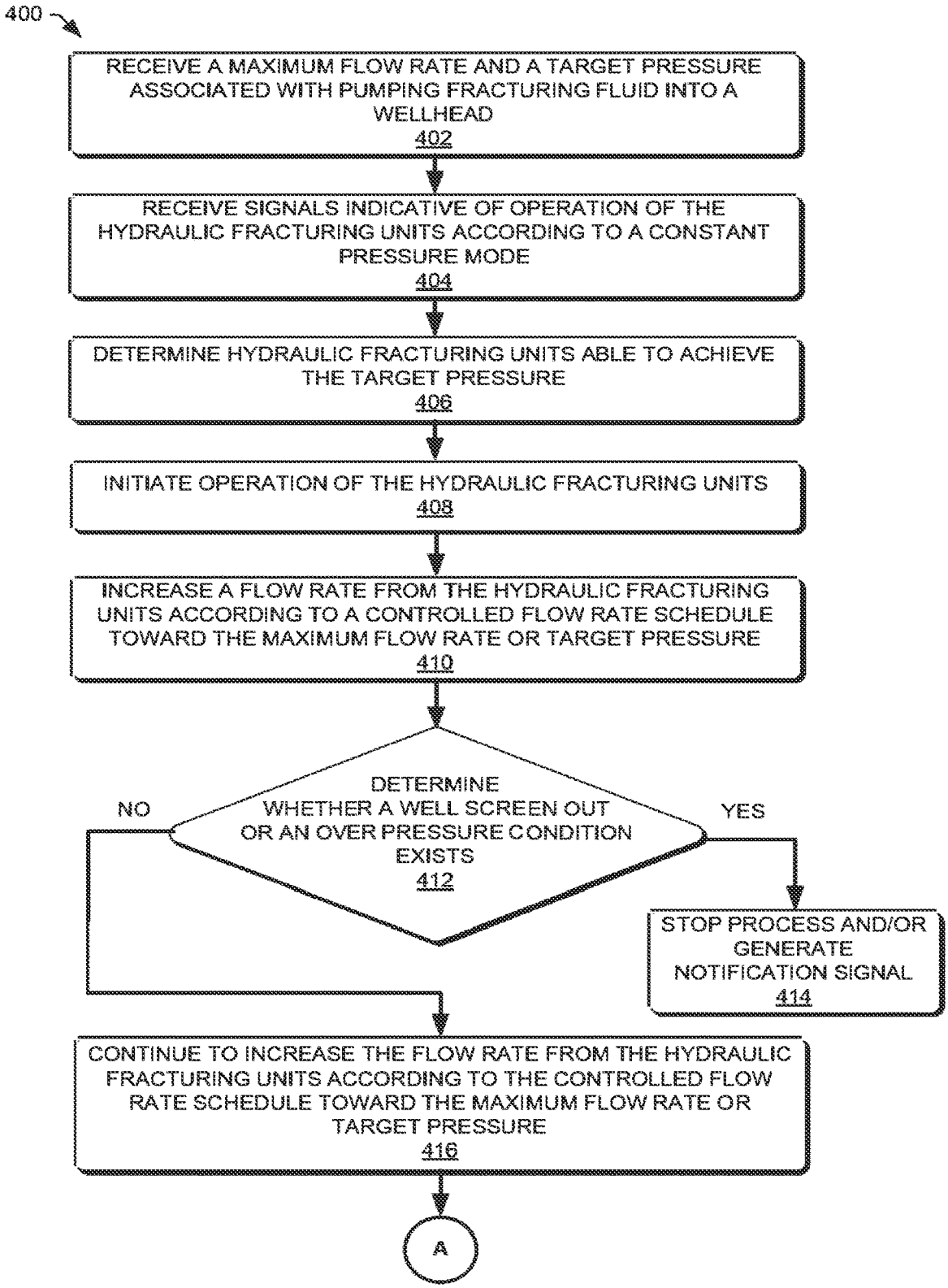
FIG. 4A is a block diagram of another example method of operating a plurality of hydraulic fracturing units according to an embodiment of the disclosure.
Figure 4B:
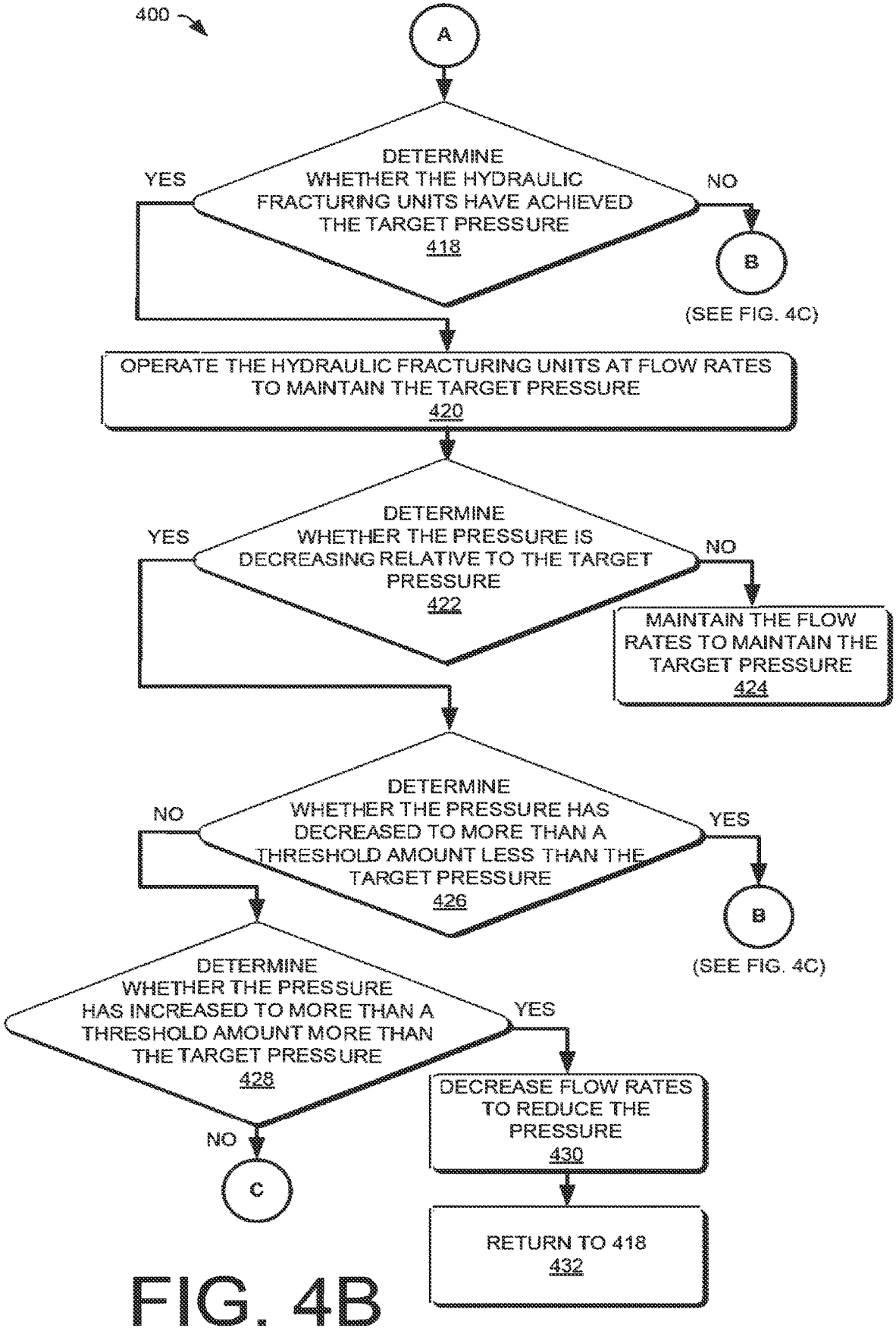
FIG. 4B is a continuation of the example method of operating a plurality of hydraulic fracturing units of the block diagram of FIG. 4A according to an embodiment of the disclosure.
Figure 4C:
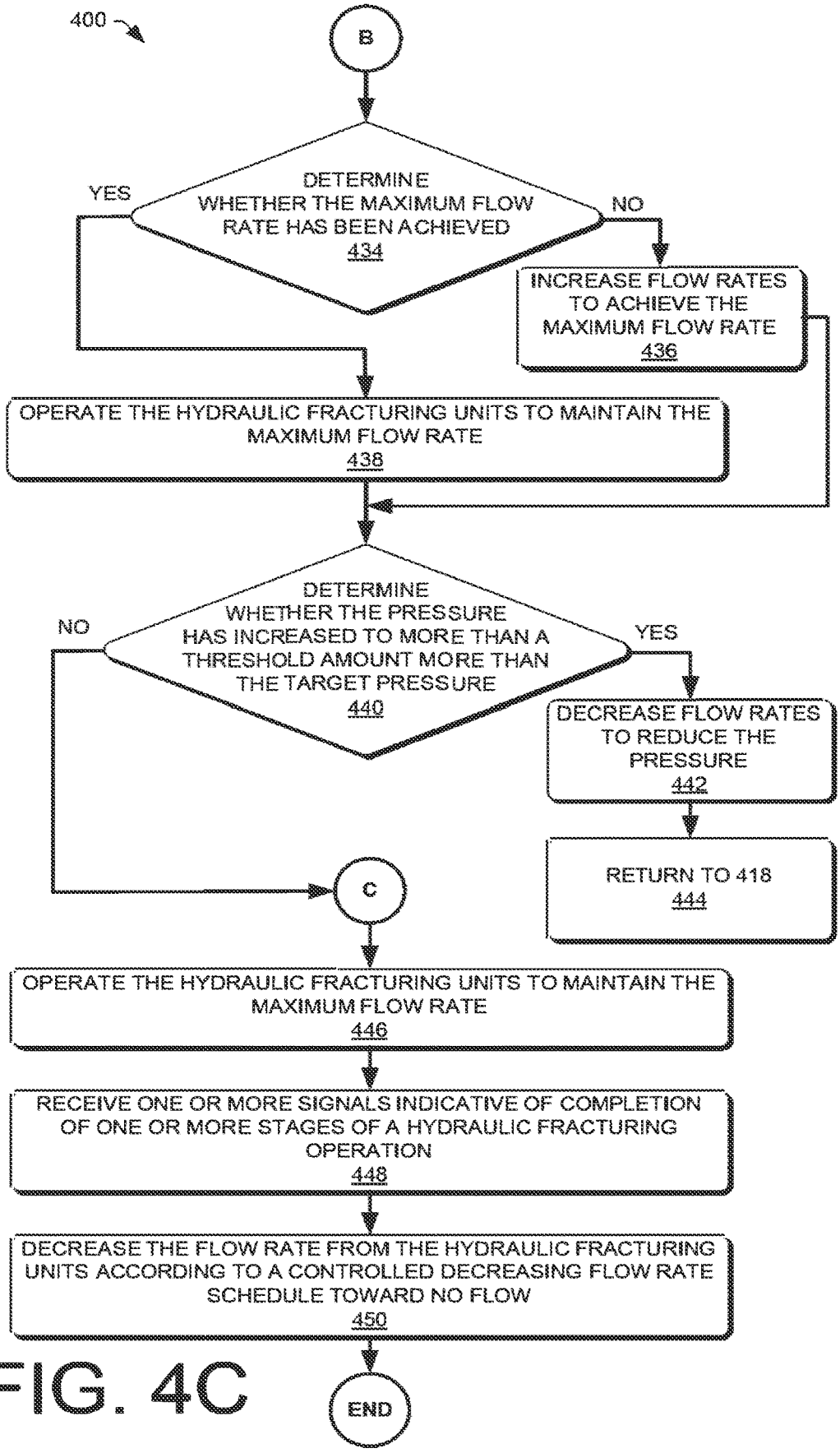
FIG. 4C is a continuation of the example method of operating a plurality of hydraulic fracturing units of the block diagram of FIGS. 4A and 4B according to an embodiment of the disclosure.

FIGS. 4A, 4B, and 4C depict a flow diagram of an embodiment of a method 400 of operating a plurality of hydraulic fracturing units, according to an embodiment of the disclosure. For example, the example method 400 may be configured to operate according to a second mode of operation, which controls operation of one or more hydraulic fracturing units according to a pressure-based strategy, for example, as previously described herein.

The example method 400, at 402, may include receiving a maximum flow rate and a target pressure associated with pumping fracturing fluid into a wellhead. For example, a user may use the input device to provide operational parameters, which may include one or more of a target flow rate, a maximum flow rate, a target pressure, or a pressure range for fracturing fluid supplied to the wellhead. A user of the hydraulic fracturing system may use an input device to provide operational parameters associated with the fracturing operation. A supervisory controller may receive the operational parameters as a basis for controlling operation of the hydraulic fracturing units. In some examples of the method 400, the user may specify operation of the hydraulic fracturing units according to a second mode of operation, which controls operation of one or more hydraulic fracturing units according to a pressure-based strategy. In some examples of the method 400, the supervisory controller may receive one or more rate ramp signals indicative of a rate ramp operational mode to control a flow rate associated with pumping fracturing fluid into a wellhead.

At 404, the example method 400 further may include receiving signals indicative of operation of the hydraulic fracturing units according to a constant pressure mode, for example, as compared to a target flow rate mode, for example, as described with respect to FIGS. 3A and 3B.

At 406, the example method 400 also may include determining whether the hydraulic fracturing units are able to achieve the target pressure. For example, the supervisory controller may receive pump characteristics for each of the hydraulic fracturing units and determine whether the hydraulic fracturing units have sufficient capacity to achieve the target pressure, for example, as described previously herein.

The example method 400, at 408, further may include initiating operation of the hydraulic fracturing units. For example, the supervisory controller may generate control signals for commencing operation of the hydraulic fracturing units.

The example method 400, at 410, also may include increasing a flow rate from the hydraulic fracturing units according to a controlled increasing flow rate schedule toward the maximum flow rate or target pressure, for example, as previously described herein with respect to FIG. 2. In some examples of the method 400, the controlled increasing flow rate schedule may cause operation of the hydraulic fracturing units, such that a flow rate of fracturing fluid does not exceed the maximum flow rate and a fracturing fluid pressure substantially remains within the pressure range.

At 412, the example method 400 also may include determining whether a well screen-out or an over-pressure condition exists. In some embodiments of the method 400, this may be performed by the supervisory controller substantially continuously during the hydraulic fracturing operation.

If, at 412, it is determined that a well screen-out or an over-pressure condition exists, at 414, the example method 400 also may include stopping the hydraulic fracturing process and/or generating one of more notification signals indicative of the insufficient capacity, for example, as discussed herein.

If, at 412, it is determined that a well screen-out or an over-pressure condition does not exist, at 416, the example method 400 further may include continuing to increase the flow rate from the hydraulic fracturing units according to the controlled increasing flow rate schedule toward the maximum pressure or the target pressure, for example, as previously described herein.

Referring to FIG. 4B, at 418, the example method 400 may further include determining whether the hydraulic fracturing units have achieved the target pressure. In some embodiments of the method 400, this may be performed during the fracturing operation by the supervisory controller, for example, as described previously herein.

If, at 418, it is determined that the hydraulic fracturing units have not achieved the target pressure, the example method 400 may skip to 434 (see FIG. 4C).

If, at 418, it is determined that the hydraulic fracturing units have achieved the target pressure, at 420, the example method 400 may include operating the hydraulic fracturing units at flow rates to maintain the target pressure. In some embodiments of the method 400, this may be performed during the fracturing operation by the supervisory controller, for example, as described previously herein.

The example method 400, at 422, further may include determining whether the pressure is decreasing relative to the target pressure. For example, the supervisory controller may receive signals indicative of the pressure at the wellhead and determine whether the pressure has decreased relative to the target pressure, for example, as previously described herein.

If, at 422, it is determined that the pressure is not decreasing relative to the target pressure, at 424, the example method 400 also may include maintaining the flow rates to maintain the target pressure. In some embodiments of the method 400, this may be performed during the fracturing operation by the supervisory controller, for example, as described previously herein.

If, at 422, it is determined that the pressure is decreasing relative to the target pressure, at 426, the example method 400 further may include determining whether the pressure has decreased to more than a threshold amount less than the target pressure. In some embodiments of the method 400, this may be performed during the fracturing operation by the supervisory controller, for example, as described previously herein.

If, at 426, it is determined that the pressure has decreased to more than the threshold amount less than the target pressure, the example method 400 may skip to 434 (see FIG. 4C).

If, at 426, it is determined that the pressure has not decreased to more than the threshold amount less than the target pressure, at 428, the example method 400 further may include determining whether the pressure has increased to more than a threshold amount more than the target pressure. In some embodiments of the method 400, this may be performed during the fracturing operation by the supervisory controller, for example, as described previously herein.

If, at 426, it is determined that the pressure has increased to more than a threshold amount more than the target pressure, the example method 400, at 430, may include decreasing the flow rates to reduce the pressure. In some embodiments of the method 400, this may be performed during the fracturing operation by the supervisory controller, for example, as described previously herein. At 432, the example method 400 also may include returning to 418.

If, at 428, it is determined that the pressure has not increased to more than a threshold amount more than the target pressure, the example method 400 may skip to 446 (see FIG. 4C).

Referring to FIG. 4C, the example method 400, at 434, further may include determining whether the maximum flow rate has been achieved. For example, 434 may be performed following 418 and 426, for example, when the pressure fails to achieve the target pressure. In some embodiments, the method 400 includes increasing the flow rate to the maximum flow rate achievable by the hydraulic fracturing units to achieve the highest pressure possible using the hydraulic fracturing units. At 434, the method 400 may include determining whether the maximum flow rate has been achieved. In some embodiments of the method 400, this may be performed during the fracturing operation by the supervisory controller, for example, as described previously herein.

If, at 434, it is determined that the maximum flow rate has not been achieved, at 436, the method 400 also may include increasing the flow rates to achieve the maximum flow rate. In some embodiments of the method 400, this may be performed during the fracturing operation by the supervisory controller, for example, as described previously herein.

If, at 434, it is determined that the maximum flow rate has been achieved, at 438, the method 400 further may include operating the hydraulic fracturing units to maintain the maximum flow rate. In some embodiments of the method 400, this may be performed during the fracturing operation by the supervisory controller, for example, as described previously herein.

At 440, the example method 400 may further include determining whether the pressure has increased to more than a threshold amount more than the target pressure. In some embodiments of the method 400, this may be performed during the fracturing operation by the supervisory controller, for example, as described previously herein.

If, at 440, it is determined that the pressure has increased to more than the threshold amount more than the target pressure, at 442, the method 400 also may include decreasing flow rates to reduce the pressure. In some embodiments of the method 400, this may be performed during the fracturing operation by the supervisory controller, for example, as described previously herein. At 444, the example method 400 further may include returning to 418 (see FIG. 4B), for example, to determine whether the target pressure has been achieved. In some embodiments of the method 400, this may be performed during the fracturing operation by the supervisory controller, for example, as described previously herein.

If, at 440, it is determined that the pressure has not increased to more than the threshold amount more than the target pressure, at 446, the method 400 further may include operating the hydraulic fracturing units to maintain the maximum flow rate. In some embodiments of the method 400, this may be performed during the fracturing operation by the supervisory controller, for example, as described previously herein.

The example method 400, at 448, further may include receiving one or more signals indicative of completion of one or more stages of a hydraulic fracturing operation. For example, when the fracturing operation is substantially complete, the user may use an input device to indicate that the fracturing operation is complete. In some embodiments, the supervisory controller may be configured to automatically generate the one or more signals indicative of completion, for example, based at least partially on duration of operation, a total amount of fracturing fluid pumped by the hydraulic fracturing units, and/or pressure at the wellhead.

The example method 400, at 450, may include decreasing the flow rate from the hydraulic fracturing units according to a controlled decreasing flow rate schedule toward zero or no flow, for example, as previously described herein. After 450, the example method 400 may end.

It should be appreciated that subject matter presented herein may be implemented as a computer process, a computer-controlled apparatus, a computing system, or an article of manufacture, such as a computer-readable storage medium. While the subject matter described herein is presented in the general context of program modules that execute on one or more computing devices, those skilled in the art will recognize that other implementations may be performed in combination with other types of program modules. Generally, program modules include routines, programs, components, data structures, and other types of structures that perform particular tasks or implement particular abstract data types.

Those skilled in the art will also appreciate that aspects of the subject matter described herein may be practiced on or in conjunction with other computer system configurations beyond those described herein, including multiprocessor systems, microprocessor-based or programmable consumer electronics, minicomputers, mainframe computers, handheld computers, mobile telephone devices, tablet computing devices, special-purposed hardware devices, network appliances, and the like.

Figure 5:
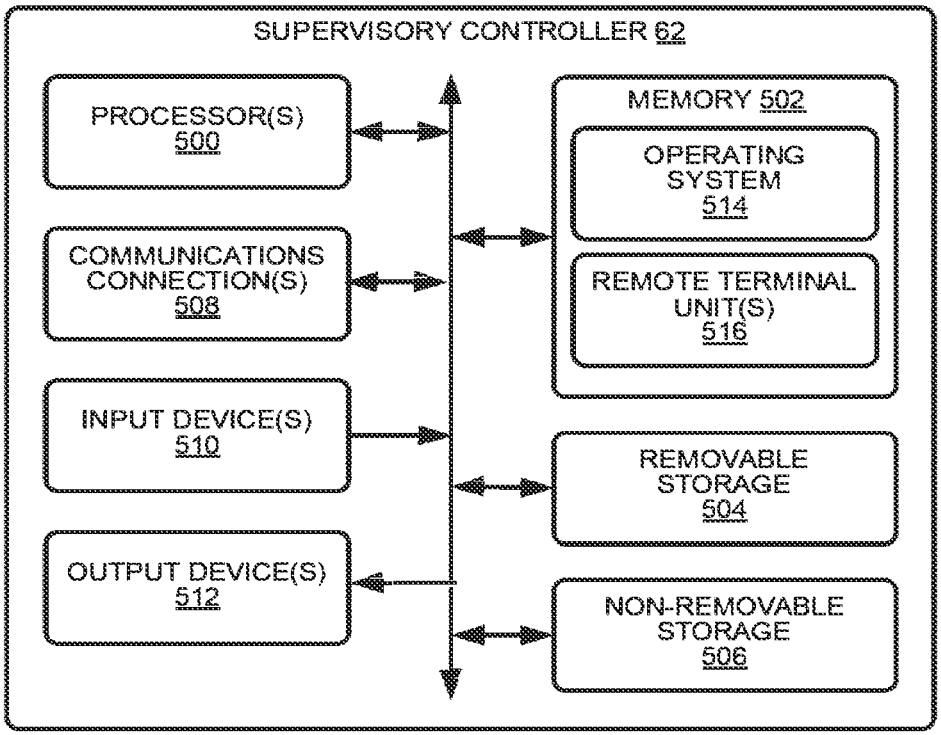
FIG. 5 is a schematic diagram of an example supervisory controller configured to operate a plurality of hydraulic fracturing units according to embodiments of the disclosure.

FIG. 5 illustrates an example supervisory controller 62 configured for implementing certain systems and methods for supplying fuel to a plurality GTEs (e.g., dual- or bi-fuel GTEs configured to operate using two different types of fuel) according to embodiments of the disclosure, for example, as described herein. The supervisory controller 62 may include one or more processor(s) 500 configured to execute certain operational aspects associated with implementing certain systems and methods described herein. The processor(s) 500 may communicate with a memory 502. The processor(s) 500 may be implemented and operated using appropriate hardware, software, firmware, or combinations thereof. Software or firmware implementations may include computer-executable or machine-executable instructions written in any suitable programming language to perform the various functions described. In some examples, instructions associated with a function block language may be stored in the memory 502 and executed by the processor(s) 500.

The memory 502 may be used to store program instructions that are loadable and executable by the processor(s) 500, as well as to store data generated during the execution of these programs. Depending on the configuration and type of the supervisory controller 62, the memory 502 may be volatile (such as random access memory (RAM)) and/or non-volatile (such as read-only memory (ROM), flash memory, etc.). In some examples, the memory devices may include additional removable storage 504 and/or non-removable storage 506 including, but not limited to, magnetic storage, optical disks, and/or tape storage. The disk drives and their associated computer-readable media may provide non-volatile storage of computer-readable instructions, data structures, program modules, and other data for the devices. In some implementations, the memory 502 may include multiple different types of memory, such as static random access memory (SRAM), dynamic random access memory (DRAM), or ROM.

The memory 502, the removable storage 504, and the non-removable storage 506 are all examples of computer-readable storage media. For example, computer-readable storage media may include volatile and non-volatile, removable and non-removable media implemented in any method or technology for storage of information such as computer-readable instructions, data structures, program modules or other data. Additional types of computer storage media that may be present may include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile discs (DVD) or other optical storage, magnetic cassettes, magnetic tapes, magnetic disk storage or other magnetic storage devices, or any other medium which may be used to store the desired information and which may be accessed by the devices. Combinations of any of the above should also be included within the scope of computer-readable media.

The supervisory controller 62 may also include one or more communication connection(s) 508 that may facilitate a control device (not shown) to communicate with devices or equipment capable of communicating with the supervisory controller 62. The supervisory controller 62 may also include a computer system (not shown). Connections may also be established via various data communication channels or ports, such as USB or COM ports to receive cables connecting the supervisory controller 62 to various other devices on a network. In some examples, the supervisory controller 62 may include Ethernet drivers that enable the supervisory controller 62 to communicate with other devices on the network. According to various examples, communication connections 508 may be established via a wired and/or wireless connection on the network.

The supervisory controller 62 may also include one or more input devices 510, such as a keyboard, mouse, pen, voice input device, gesture input device, and/or touch input device. The one or more input device(s) 510 may correspond to the one or more input devices 64 described herein with respect to FIGS. 1 and 2. It may further include one or more output device(s) 512, such as a display, printer, and/or speakers. In some examples, computer-readable communication media may include computer-readable instructions, program modules, or other data transmitted within a data signal, such as a carrier wave or other transmission. As used herein, however, computer-readable storage media may not include computer-readable communication media.

Turning to the contents of the memory 502, the memory 502 may include, but is not limited to, an operating system (OS) 514 and one or more application programs or services for implementing the features and embodiments disclosed herein. Such applications or services may include remote terminal unit(s) 516 for executing certain systems and methods for controlling operation of the hydraulic fracturing units 12 (e.g., semi- or full-autonomously controlling operation of the hydraulic fracturing units 12), for example, upon receipt of one or more control signals generated by the supervisory controller 62. In some embodiments, each of the hydraulic fracturing units 12 may include a remote terminal unit 516. The remote terminal unit(s) 516 may reside in the memory 502 or may be independent of the supervisory controller 62. In some examples, the remote terminal unit(s) 516 may be implemented by software that may be provided in configurable control block language and may be stored in non-volatile memory. When executed by the processor(s) 500, the remote terminal unit(s) 516 may implement the various functionalities and features associated with the supervisory controller 62 described herein.

As desired, embodiments of the disclosure may include a supervisory controller 62 with more or fewer components than are illustrated in FIG. 5. Additionally, certain components of the example supervisory controller 62 shown in FIG. 5 may be combined in various embodiments of the disclosure. The supervisory controller 62 of FIG. 5 is provided by way of example only.

References are made to block diagrams of systems, methods, apparatuses, and computer program products according to example embodiments. It will be understood that at least some of the blocks of the block diagrams, and combinations of blocks in the block diagrams, may be implemented at least partially by computer program instructions. These computer program instructions may be loaded onto a general purpose computer, special purpose computer, special purpose hardware-based computer, or other programmable data processing apparatus to produce a machine, such that the instructions which execute on the computer or other programmable data processing apparatus create means for implementing the functionality of at least some of the blocks of the block diagrams, or combinations of blocks in the block diagrams discussed.

These computer program instructions may also be stored in a non-transitory computer-readable memory that can direct a computer or other programmable data processing apparatus to function in a particular manner, such that the instructions stored in the computer-readable memory produce an article of manufacture including instruction means that implement the function specified in the block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide task, acts, actions, or operations for implementing the functions specified in the block or blocks.

One or more components of the systems and one or more elements of the methods described herein may be implemented through an application program running on an operating system of a computer. They may also be practiced with other computer system configurations, including hand-held devices, multiprocessor systems, microprocessor-based or programmable consumer electronics, mini-computers, mainframe computers, and the like.

Application programs that are components of the systems and methods described herein may include routines, programs, components, data structures, etc., that may implement certain abstract data types and perform certain tasks or actions. In a distributed computing environment, the application program (in whole or in part) may be located in local memory or in other storage. In addition, or alternatively, the application program (in whole or in part) may be located in remote memory or in storage to allow for circumstances where tasks can be performed by remote processing devices linked through a communications network.

This application is a continuation-in-part of U.S. Non-Provisional application Ser. No. 17/248,484, filed Jan. 27, 2021, titled "SYSTEMS AND METHODS TO OPERATE HYDRAULIC FRACTURING UNITS USING AUTOMATIC FLOW RATE AND/OR PRESSURE CONTROL" which claims priority to and the benefit of, under 35 U.S.C. § 119(e), U.S. Provisional Application No. 62/705,328, filed Jun. 22, 2020, titled "SYSTEMS AND METHODS TO OPERATE HYDRAULIC FRACTURING UNITS USING AUTOMATIC FLOW RATE AND/OR PRESSURE CONTROL", U.S. Provisional Application No. 62/705,369, filed Jun. 24, 2020, titled "SYSTEMS AND METHODS PROVIDING A CONFIGURABLE STAGED RATE INCREASE FUNCTION TO OPERATE HYDRAULIC FRACTURING UNITS", and U.S. Provisional Application No. 62/705,649, filed Jul. 9, 2020, titled "SYSTEMS AND METHODS PROVIDING A CONFIGURABLE STAGED RATE INCREASE FUNCTION TO OPERATE HYDRAULIC FRACTURING UNITS", the disclosures of all of which are incorporated herein by reference in their entirety.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims.

What is claimed is:

1. A method of operating a plurality of hydraulic fracturing units, each of the hydraulic fracturing units including a hydraulic fracturing pump to pump fracturing fluid into a wellhead and an internal combustion engine to drive the hydraulic fracturing pump, the method comprising:

receiving, via a supervisory controller, one or more operational parameters associated with pumping fracturing fluid into the wellhead, the one or more operational parameters including one or more of a target flow rate, a maximum flow rate, a target pressure, or a pressure range for fracturing fluid supplied to the wellhead;

determining, via the supervisory controller, whether the plurality of hydraulic fracturing units have a capacity sufficient to achieve the one or more of the target flow rate or the target pressure;

initiating operation of at least some of the plurality of hydraulic fracturing units;

increasing a flow rate from the at least some of the hydraulic fracturing units according to a controlled increasing flow rate schedule toward the one or more of the target flow rate or the target pressure, the controlled increasing flow rate schedule causing operation of the hydraulic fracturing units such that a flow rate of fracturing fluid does not exceed the maximum flow rate and a fracturing fluid pressure substantially remains within the pressure range;

determining whether the at least some of the hydraulic fracturing units have achieved the one or more of the target flow rate or the target pressure; and one or more of:

when it has been determined that the one or more of the target flow rate or the target pressure has been achieved, operating the at least some hydraulic fracturing units to maintain one or more of the target flow rate or the target pressure;

when it has been determined that the target flow rate has not been achieved, generating one or more signals indicative of a failure to achieve the target flow rate; or when it has been determined that the target pressure has not been achieved, operating the at least some hydraulic fracturing units to maintain a maximum flow rate.

2. The method of claim 1, wherein determining whether the plurality of hydraulic fracturing units have a capacity sufficient to achieve the one or more of the target flow rate or the target pressure comprises:

receiving pump characteristics for each of the plurality of hydraulic fracturing pumps;

determining a total pump flow rate by combining at least one of the pump characteristics for each of the plurality of hydraulic fracturing pumps; and comparing the total pump flow rate to the target flow rate, wherein the plurality of pump characteristics comprises one or more of a minimum flow rate, a maximum flow rate, a harmonization range, and a pump condition for each of the plurality of hydraulic fracturing pumps; and determining the total pump flow rate comprises adding the maximum flow rates of each of the hydraulic fracturing pumps.

3. The method of claim 1, wherein one or more of:

increasing a flow rate from the at least some of the hydraulic fracturing units according to the controlled increasing flow rate schedule comprises maintaining a rate of change of the flow rate provided by the at least some of the hydraulic fracturing units below a maximum rate of change of the flow rate until the at least some of the hydraulic fracturing units have achieved the one or more of the target flow rate or the target pressure; or determining the maximum rate of change of the flow rate comprises changing the maximum rate of change of the flow rate as the total flow rate increases to achieve the one or more of the target flow rate or the target pressure.

4. The method of claim 1, further comprising:

receiving one or more signals indicative of a total flow rate of the at least some of the hydraulic fracturing units;

determining whether the total flow rate is decreasing relative to the target flow rate; and one of:

when it has been determined that the total flow rate is decreasing relative to the target flow rate, increasing the flow rate to substantially maintain the target flow rate; or when it has been determined that the total flow rate is substantially equal to the target flow rate, maintaining the target flow rate.

5. The method of claim 1, wherein:

receiving one or more operational parameters associated with pumping fracturing fluid into a wellhead comprises receiving a target pressure for fracturing fluid supplied to the wellhead; and when it has been determined that the target pressure has not been achieved, the method further comprises:

determining whether a maximum total flow rate has been achieved; and one of:

when the maximum total flow rate has been achieved, maintaining the maximum total flow rate; or when the maximum total flow rate has not been achieved, increasing flow rates of the at least some hydraulic fracturing units to achieve the maximum total flow rate.

6. The method of claim 5, wherein one or more of:

(1) when the maximum total flow rate has not been achieved, the method further comprises maintaining a fluid pressure at the wellhead within a pressure differential of the fluid pressure by one of increasing the total flow rate to increase the fluid pressure at the wellhead to be within the pressure differential or decreasing the total flow rate to decrease the fluid pressure at the wellhead to be within the pressure differential; or (2) receiving the one or more operational parameters associated with pumping fracturing fluid into a wellhead comprises receiving a maximum flow rate; and increasing the flow rate from the at least some of the hydraulic fracturing units comprises maintaining the flow rate from the at least some of the hydraulic fracturing units below the maximum flow rate.

7. The method of claim 1, further comprising:

receiving, via the supervisory controller, one or more signals indicative of a maximum fluid pressure at the wellhead;

monitoring fluid pressure at the wellhead; and when the fluid pressure at the wellhead increases to within an upper range of the maximum fluid pressure, causing one or more of:

generating one or more signals indicative of the fluid pressure being within the upper range of the maximum fluid pressure;

reducing a rate of change of the flow rate provided by the at least some of the hydraulic fracturing units; or reducing the target flow rate.

8. The method of claim 7, wherein following reducing the target flow rate, when the fluid pressure at the wellhead falls below a lower range of the maximum fluid pressure, the method further comprises increasing the flow rate provided by the at least some of the hydraulic fracturing units until the fluid pressure at the wellhead returns to within the upper range of the maximum fluid pressure.

9. The method of claim 1, wherein the method comprises a first mode of operation, and the method further comprises:

receiving, via the supervisory controller, one or more signals indicative of ceasing the first mode of operation; and causing the at least some hydraulic fracturing units to continue to operate at flow rates substantially the same as flow rates at a time of receipt of the one or more signals indicative of ceasing the first mode of operation.

10. The method of claim 1, further comprising:

receiving one or more signals indicative of a pressure associated with an output of each of the hydraulic fracturing pumps of the at least some hydraulic fracturing units; and controlling operation of each of the at least some hydraulic fracturing units based at least in part on the one or more signals indicative of the pressure associated with the output of each of the hydraulic fracturing pumps.

11. A hydraulic fracturing control assembly to operate a plurality of hydraulic fracturing units, each of the hydraulic fracturing units including a hydraulic fracturing pump to pump fracturing fluid into a wellhead and an internal combustion engine to drive the hydraulic fracturing pump, the hydraulic fracturing control assembly comprising:

an input device configured to facilitate communication of:

operational parameters to a supervisory controller, the one or more operational parameters including one or more of a target flow rate, a maximum flow rate, a target pressure, or a pressure range for fracturing fluid supplied to the wellhead;

one or more sensors configured to generate one or more sensor signals indicative of one or more of a flow rate of fracturing fluid or a pressure associated with fracturing fluid; and a supervisory controller in communication with one or more of the plurality of hydraulic fracturing units, the input device, or the one or more sensors, the supervisory controller being configured to:

receive one or more operational parameters associated with pumping fracturing fluid into a wellhead, the one or more operational parameters including one or more of a target flow rate or a target pressure for fracturing fluid supplied to the wellhead;

determine whether the plurality of hydraulic fracturing units have a capacity sufficient to achieve the one or more of the target flow rate or the target pressure;

increase a flow rate from at least some of the hydraulic fracturing units according to a controlled increasing flow rate schedule toward the one or more of the target flow rate or the target pressure, the controlled increasing flow rate schedule causing operation of the hydraulic fracturing units such that a flow rate of fracturing fluid does not exceed the maximum flow rate and a fracturing fluid pressure substantially remains within the pressure range;

determine, based at least in part on the one or more sensor signals indicative of one or more of the flow rate of fracturing fluid or the pressure associated with fracturing fluid, whether the at least some of the hydraulic fracturing units have achieved the one or more of the target flow rate or the target pressure; and one or more of:

when it has been determined that the one or more of the target flow rate or the target pressure has been achieved, operate the at least some hydraulic fracturing units to maintain one or more of the target flow rate or the target pressure;

when it has been determined that the target flow rate has not been achieved, generate one or more signals indicative of a failure to achieve the target flow rate; or when it has been determined that the target pressure has not been achieved, operate the at least some hydraulic fracturing units to maintain a maximum flow rate.

12. The hydraulic fracturing control assembly of claim 11, wherein:

the hydraulic fracturing units comprise a plurality of hydraulic fracturing pumps, each of the plurality of hydraulic fracturing pumps being associated with one of the plurality of hydraulic fracturing units; and the supervisory controller is configured to:

receive pump characteristics for each of the plurality of hydraulic fracturing pumps;

determine a total pump flow rate based at least partially on at least one of the pump characteristics for each of the plurality of hydraulic fracturing pumps; and compare the total pump flow rate to the target flow rate.

13. The hydraulic fracturing control assembly of claim 12, wherein:

the plurality of pump characteristics comprises one or more of a minimum flow rate, a maximum flow rate, a harmonization range, and a pump condition for each of the plurality of hydraulic fracturing pumps; and the supervisory controller is configured to add the maximum flow rates of each of the hydraulic fracturing pumps to determine the total pump flow rate.

14. The hydraulic fracturing system of claim 11, wherein the supervisory controller is configured to one or more of:

receive one or more signals indicative of a pump condition of one or more hydraulic fracturing pumps of the plurality of hydraulic fracturing units;

determine a maximum flow rate for each of the one or more hydraulic fracturing pumps based at least in part on the one or more signals indicative of a pump condition of the one or more hydraulic fracturing pumps; or maintain a rate of change of the flow rate provided by the at least some of the hydraulic fracturing units below a maximum rate of change of the flow rate until the at least some of the hydraulic fracturing units have achieved the one or more of the target flow rate or the target pressure.

15. The hydraulic fracturing system of claim 14, wherein the supervisory controller is configured to one or more of:

change the maximum rate of change of the flow rate as the total flow rate increases to achieve the one or more of the target flow rate or the target pressure to determine the maximum rate of change of the flow rate; or the one or more sensors include one or more wellhead sensors configured to generate one or more signals indicative of one or more of fluid flow rate or fluid pressure at the wellhead, and the supervisory controller is configured to:

receive one or more signals indicative one or more of fluid flow rate or fluid pressure at the wellhead; and determine the maximum rate of change of the flow rate based at least in part on the one or more signals indicative of one or more of the fluid flow rate of fluid pressure at the wellhead.

16. The hydraulic fracturing control assembly of claim 11, wherein the supervisory controller is further configured to:

determine whether a well screen-out or an over-pressure condition exists based at least in part on the receiving the one more signals indicative of one or more of the flow rate of fracturing fluid or the pressure associated with fracturing fluid; and when one or more of a well screen-out or an over-pressure condition exists, the supervisory controller is configured to one or more of:

generate one or more signals indicative of the one or more of the well screen-out or the over-pressure condition; or cease increasing of the flow rate from the at least some of the hydraulic fracturing units.

17. The hydraulic fracturing control assembly of claim 16, wherein:

the one or more operational parameters associated with pumping fracturing fluid into a wellhead comprises a target pressure for fracturing fluid supplied to the wellhead; and when it has been determined that the target pressure has not been achieved, the supervisory controller is further configured to:

determine whether a maximum total flow rate has been achieved; and one of:

when the maximum total flow rate has been achieved, maintain the maximum total flow rate; or when the maximum total flow rate has not been achieved, one or more of:

increase flow rates of the at least some hydraulic fracturing units to achieve the maximum total flow rate;

maintain a fluid pressure at the wellhead within a pressure differential of the fluid pressure by one of increasing the total flow rate to increase the fluid pressure at the wellhead to be within the pressure differential or decreasing the total flow rate to decrease the fluid pressure at the wellhead to be within the pressure differential.

18. A hydraulic fracturing system comprising:

a plurality of hydraulic fracturing units, each of the hydraulic fracturing units comprising:

a hydraulic fracturing pump to pump fracturing fluid into a wellhead;

a gas turbine engine mechanically linked to the hydraulic fracturing pump;

one or more sensors configured to generate one or more sensor signals indicative of one or more of a flow rate of fracturing fluid or a pressure associated with fracturing fluid; and a supervisory controller in communication with one or more of the plurality of hydraulic fracturing units, the input device, or the one or more sensors, the supervisory controller being configured to:

receive one or more operational parameters associated with pumping fracturing fluid into a wellhead, the one or more operational parameters including one or more of a target flow rate or a target pressure for fracturing fluid supplied to the wellhead;

determine whether the plurality of hydraulic fracturing units have a capacity sufficient to achieve the one or more of the target flow rate or the target pressure;

increase a flow rate from at least some of the hydraulic fracturing units according to a controlled increasing flow rate schedule toward the one or more of the target flow rate or the target pressure, the controlled increasing flow rate schedule causing operation of the hydraulic fracturing units such that a flow rate of fracturing fluid does not exceed the maximum flow rate and a fracturing fluid pressure substantially remains within the pressure range;

determine, based at least in part on the one or more sensor signals indicative of one or more of the flow rate of fracturing fluid or the pressure associated with fracturing fluid, whether the at least some of the hydraulic fracturing units have achieved the one or more of the target flow rate or the target pressure; and one or more of:

when it has been determined that the one or more of the target flow rate or the target pressure has been achieved, operate the at least some hydraulic fracturing units to maintain one or more of the target flow rate or the target pressure;

when it has been determined that the target flow rate has not been achieved, generate one or more signals indicative of a failure to achieve the target flow rate; or when it has been determined that the target pressure has not been achieved, operate the at least some hydraulic fracturing units to maintain a maximum flow rate.

19. The hydraulic fracturing control assembly of claim 18, wherein:

the hydraulic fracturing units comprise a plurality of hydraulic fracturing pumps, each of the plurality of hydraulic fracturing pumps being associated with one of the plurality of hydraulic fracturing units; and the supervisory controller is configured to:

receive pump characteristics for each of the plurality of hydraulic fracturing pumps;

determine a total pump flow rate based at least partially on at least one of the pump characteristics for each of the plurality of hydraulic fracturing pumps; and compare the total pump flow rate to the target flow rate.

20. The hydraulic fracturing control assembly of claim 19, wherein:

the plurality of pump characteristics comprises one or more of a minimum flow rate, a maximum flow rate, a harmonization range, and a pump condition for each of the plurality of hydraulic fracturing pumps; and the supervisory controller is configured to add the maximum flow rates of each of the hydraulic fracturing pumps to determine the total pump flow rate.

* * * * *